US008770713B2

(12) United States Patent
Kyoso

(10) Patent No.: US 8,770,713 B2
(45) Date of Patent: Jul. 8, 2014

(54) NOZZLE SURFACE CLEANING APPARATUS AND METHOD, AND INKJET RECORDING APPARATUS

(75) Inventor: Tadashi Kyoso, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 198 days.

(21) Appl. No.: 13/359,764

(22) Filed: Jan. 27, 2012

(65) Prior Publication Data

US 2012/0194610 A1 Aug. 2, 2012

(30) Foreign Application Priority Data

Jan. 28, 2011 (JP) ..... 2011-017104

(51) Int. Cl.
*B41J 2/165* (2006.01)
*B41J 29/38* (2006.01)

(52) U.S. Cl.
USPC ..... 347/33; 347/14; 347/22

(58) Field of Classification Search
USPC ..... 347/33, 14, 22
See application file for complete search history.

(56) References Cited

U.S. PATENT DOCUMENTS

2008/0316253 A1 12/2008 Inuoe
2010/0238234 A1 9/2010 Inuoe

FOREIGN PATENT DOCUMENTS

| | | | | |
|---|---|---|---|---|
| JP | 10-097153 | A | | 4/1998 |
| JP | 2003-270426 | A | | 9/2003 |
| JP | 2003270426 | A | * | 9/2003 |
| JP | 2006-218702 | A | | 8/2006 |
| JP | 2009-862 | A | | 1/2009 |
| JP | 2010-241127 | A | | 10/2010 |

* cited by examiner

*Primary Examiner* — Jannelle M Lebron
(74) *Attorney, Agent, or Firm* — Birch, Stewart, Kolasch & Birch, LLP

(57) ABSTRACT

A nozzle surface cleaning apparatus cleans a nozzle surface of an inkjet head. The nozzle surface cleaning apparatus includes: a wiping device which performs a wiping operation on the nozzle surface with a wiping member having permeability; an observation device which observes a soiled state of the wiping member having been used in the wiping operation; and a judgment device which makes a judgment on appropriateness of a setting of the wiping operation on a basis of the soiled state observed by the observation device.

28 Claims, 34 Drawing Sheets

NOZZLE SURFACE CLEANING APPARATUS AND METHOD, AND INKJET RECORDING APPARATUS

BACKGROUND OF THE INVENTION

1. Field of the Invention

The present invention relates to a nozzle surface cleaning apparatus, a nozzle surface cleaning method and an inkjet recording apparatus, and more particularly to a nozzle surface cleaning apparatus, a nozzle surface cleaning method and an inkjet recording apparatus in which a nozzle surface is cleaned by being wiped with a wiping member having permeability.

2. Description of the Related Art

In an inkjet recording apparatus, when a nozzle surface (a surface in which nozzles are formed) of an inkjet head becomes soiled, ejection defects occur. Then, cleaning of the nozzle surface is carried out periodically.

Known methods of cleaning the nozzle surface include a method of cleaning by wiping the nozzle surface with a blade and a method of cleaning by wiping the nozzle surface with a web, and so on.

Japanese Patent Application Publication No. 2009-000862 discloses a method in which the nozzle surface is wiped with a blade, and deformation in the shape of the tip portion of the blade is detected and the replacement time of the blade is predicted, in order to reduce the replacement frequency of the blade.

Japanese Patent Application Publication No. 2006-218702 discloses a method in which the nozzle surface is wiped with a blade, and progress of wear of the blade is made uniform by determining the ejection status of each nozzle after wiping and changing the abutment position of the blade in accordance with requirements.

Japanese Patent Application Publication No. 2010-241127 discloses a method in which the nozzle surface is wiped with a new web at all times by pressing the web that travels between a pair of reels against the nozzle surface through a pressing roller.

SUMMARY OF THE INVENTION

In the cleaning apparatus having the composition which wipes the nozzle surface with the blade, as described in Japanese Patent Application Publication No. 2009-000862 or 2006-218702, it is possible to optimize wiping by determining the shape of the tip portion of the blade or determining the ejection status after the cleaning.

However, in the cleaning apparatus having the composition which wipes the nozzle surface with the wiping member having permeability, such as the web as described in Japanese Patent Application Publication No. 2010-241127, since the wiping method is completely different, it is not possible to optimize wiping by the conventional optimization methods as described in Japanese Patent Application Publication Nos. 2009-000862 and 2006-218702. More specifically, in the cleaning apparatus having the composition which wipes the nozzle surface with the permeable wiping member, soiling is absorbed by the permeable wiping member, in contrast to the blade, and therefore it is necessary to set the pressure applied on the nozzle surface to an optimum value in order to perform efficient wiping. Further, in the case of a web, a kink can occur and the web needs to be set correctly. Furthermore, when performing wiping by the traveling web, it is necessary to wipe the nozzle surface while causing the web to travel at an optimum speed.

Consequently, in the cleaning apparatus having the composition which wipes the nozzle surface with the permeable wiping member, such as a web, there is a problem in that it is not possible to optimize wiping by the conventional optimization methods.

The present invention has been contrived in view of these circumstances, an object thereof being to provide a nozzle surface cleaning method, a nozzle surface cleaning apparatus and an inkjet recording apparatus in which wiping settings can be simply optimized.

In order to attain the aforementioned object, the present invention is directed to a nozzle surface cleaning apparatus which cleans a nozzle surface of an inkjet head, the apparatus comprising: a wiping device which performs a wiping operation on the nozzle surface with a wiping member having permeability; an observation device which observes a soiled state of the wiping member having been used in the wiping operation; and a judgment device which makes a judgment on appropriateness of a setting of the wiping operation on a basis of the soiled state observed by the observation device.

According to this aspect of the present invention, the appropriateness of the setting of the wiping operation is judged on the basis of the state of soiling on the wiping member that has been used in the wiping operation. If the setting of the wiping operation is inappropriate, then the wiping member is abnormally soiled (in a soiling mode which is different to that in a case where the setting of the wiping operation is appropriate). Then, it is possible to judge whether the setting of the wiping operation is appropriate or not by observing the soiled state of the wiping member having been used in the wiping operation. For example, a soiled state of the wiping member having been used in a wiping operation of which the setting is appropriate is determined in advance as the standard soiled state, and a soiled state of the wiping member having been used in a wiping operation of which the setting is the subject for the judgment is compared with the standard soiled state. Thereby, it is possible to readily judge whether the setting of the wiping operation is appropriate or not.

Preferably, the nozzle surface cleaning apparatus further comprises a setting correction device which corrects the setting of the wiping operation in accordance with the judgment made by the judgment device.

According to this aspect of the present invention, the setting of the wiping operation performed by the wiping device is corrected in accordance with the result of the judgment for the appropriateness of the setting on the basis of the observed soiled state of the wiping member having been used in the wiping operation. Thus, it is possible to wipe the nozzle surface under the correct setting at all times, and the nozzle surface can be cleaned without causing wiping traces, or the like.

Preferably, the nozzle surface cleaning apparatus further comprises a wetting device which wets the nozzle surface before the wiping operation.

According to this aspect of the present invention, the nozzle surface is wetted before the wiping operation. Thereby, it is possible to wipe away solidified dirt, and the like, with good efficiency. The method of wetting the nozzle surface can employ, for instance, a method of depositing a cleaning liquid (a liquid having a cleaning effect) onto the nozzle surface or a method of causing ink to seep out from the nozzles, or the like.

Preferably, the wiping member includes a web; the wiping device includes a web drive device which causes the web to travel in a web travelling direction along a web travelling path, and a pressing roller about which the web is wrapped;

and the wiping device performs the wiping operation by pressing the travelling web against the nozzle surface by means of the pressing roller while the wiping device moves relatively along the nozzle surface.

According to this aspect of the present invention, the wiping member is constituted of the web, and the nozzle surface is wiped with the web while the pressing roller presses the web against the nozzle surface and the web drive device causes the web to travel. By pressing the web against the nozzle surface while causing the web to travel, it is possible to wipe the nozzle surface using a new surface of the web at all times, and thereby the nozzle surface can be cleaned effectively.

Preferably, the observation device observes, as the soiled state, a soiled density distribution on the web in a direction perpendicular to the web travelling direction; and the judgment device makes a judgment on appropriateness of a pressing position of the web against the nozzle surface on a basis of the soiled density distribution observed by the observation device.

According to this aspect of the present invention, the density distribution of soiling on the web in the direction perpendicular to the direction of the travel of the web is observed as the state of soiling, and the appropriateness of the position at which the web is pressed against the nozzle surface in the wiping operation is judged on the basis of the observed soiled density distribution on the web having been used in the wiping operation. If the pressing position of the web is displaced from the appropriate position, then the position where the soiled density distribution appears is displaced. Then, it is possible to judge the appropriateness of the pressing position of the web with respect to the nozzle surface, on the basis of the observed soiled density distribution. Thus, it is possible to readily judge the appropriateness of the pressing position of the web.

Preferably, the setting correction device corrects the pressing position in accordance with the judgment made by the judgment device.

According to this aspect of the present invention, the pressing position of the web against the nozzle surface in the wiping operation is corrected in accordance with the result of the judgment for the appropriateness of the pressing position on the basis of the observed soiled density distribution on the web having been used in the wiping operation. More specifically, a soiled density distribution in the case of appropriate setting is acquired in advance as the standard, and the amount of displacement of the position where the soiled density distribution appears is observed by comparison with the standard, whereby it is possible to determine an amount of correction for achieving the appropriate setting. By adjusting the pressing position of the web in accordance with the determined amount of correction, it is possible to correct the pressing position of the web.

Preferably, the observation device observes, as the soiled state, a soiled density distribution on the web in a direction perpendicular to the web travelling direction; and the judgment device makes a judgment on appropriateness of parallelism of the web with respect to the nozzle surface on a basis of the soiled density distribution observed by the observation device.

According to this aspect of the present invention, the density distribution of soiling on the web in the direction perpendicular to the direction of the travel of the web is observed as the state of soiling, and the appropriateness of the parallelism of the web with respect to the nozzle surface in the wiping operation is judged on the basis of the observed soiled density distribution on the web having been used in the wiping operation. If the web is pressed in unparallel against the nozzle surface (i.e., if the axis of the pressing roller is not parallel to the nozzle surface), then a density gradient occurs in the soiled density distribution on the web. Then, it is possible to readily judge whether the web is pressed in parallel or not by observing the soiled density distribution.

Preferably, the setting correction device corrects inclination of the pressing roller with respect to the nozzle surface in accordance with the judgment made by the judgment device.

According to this aspect of the present invention, the inclination of the pressing roller with respect to the nozzle surface in the wiping operation is corrected in accordance with the result of the judgment for the parallelism of the web with respect to the nozzle surface on the basis of the observed soiled density distribution on the web having been used in the wiping operation. If the web is pressed in an inclined fashion with respect to the nozzle surface, then the density gradient appears in the density distribution of the soiling absorbed by the web. Then, a soiled density distribution in a normal case (a case where the web is parallel to the nozzle surface) is determined in advance as the standard, and the direction and amount of the inclination of the pressing roller in the wiping operation can be determined by determining the density gradient of the observed soiled density distribution on the web having been used in the wiping operation, in comparison with the standard. Thereby, it is possible to determine an amount of correction for correcting the inclination (the direction and amount of the correction for the inclination of the pressing roller). Thus, it is possible to readily eliminate the inclination of the web.

Preferably, the observation device observes, as the soiled state, a soiled density distribution on the web in a direction perpendicular to the web travelling direction; and the judgment device makes a judgment on appropriateness of a pressing force of the web against the nozzle surface on a basis of the soiled density distribution observed by the observation device.

According to this aspect of the present invention, the density distribution of soiling on the web in the direction perpendicular to the direction of the travel of the web is observed as the state of soiling, and the appropriateness of the pressing force of the web against the nozzle surface in the wiping operation is judged on the basis of the observed soiled density distribution on the web having been used in the wiping operation. If the pressing force of the web against the nozzle surface is inappropriate, then a weak or dark soiled density is obtained, compared to a case where the pressing force is appropriate. Then, it is possible to readily judge whether the pressing force of the web against the nozzle surface is appropriate or not on the basis of the observed appearance of the soiled density distribution.

Preferably, the setting correction device corrects the pressing force of the web against the nozzle surface applied by the pressing roller in accordance with the judgment made by the judgment device.

According to this aspect of the present invention, the pressing force of the web against the nozzle surface applied by the pressing roller in the wiping operation is corrected in accordance with the result of the judgment for the appropriateness of the pressing force on the basis of the observed soiled density distribution on the web having been used in the wiping operation. If the pressing force is inappropriate, then the density difference in the soiled density distribution differs in comparison with a case where the pressing force is appropriate. Then, a soiled density distribution in a case where the pressing force is appropriate is determined in advance as the standard, and the amount of excess or insufficiency in the pressing force in the wiping operation can be determined by determining the amount of the density difference in the observed soiled density distribution on the web having been used in the wiping operation, in comparison with the standard. Thus, it is possible to readily adjust the pressing force.

Preferably, the observation device observes, as the soiled state, a soiled density distribution on the web in a direction perpendicular to the web travelling direction; and the judgment device makes a judgment on appropriateness of a nozzle meniscus position in the inkjet head on a basis of the soiled density distribution observed by the observation device.

According to this aspect of the present invention, the density distribution of soiling on the web in the direction perpendicular to the direction of the travel of the web is observed as the state of soiling, and the appropriateness of the nozzle meniscus position in the inkjet head in the wiping operation is judged on the basis of the observed soiled density distribution on the web having been used in the wiping operation. If the nozzle meniscus position is inappropriate, then the density difference in the soiled density distribution differs in comparison with a case where the nozzle meniscus position is appropriate. Then, a soiled density distribution in a case where the nozzle meniscus position is appropriate is determined in advance as the standard, and an amount of displacement of the nozzle meniscus position in the wiping operation can be determined by determining the amount of the density difference in the observed soiled density distribution on the web having been used in the wiping operation, in comparison with the standard. Thus, it is possible to judge whether the nozzle meniscus position in the wiping operation is appropriate or not on the basis of the observed appearance of the soiled density distribution.

Preferably, the setting correction device corrects the nozzle meniscus position in accordance with the judgment made by the judgment device.

According to this aspect of the present invention, the nozzle meniscus position in the wiping operation is corrected in accordance with the result of the judgment for the appropriateness of the nozzle meniscus position on the basis of the observed soiled density distribution on the web having been used in the wiping operation. If the nozzle meniscus position is not appropriate, then the density difference in the soiled density distribution differs in comparison with a case where the nozzle meniscus position is appropriate. Then, a soiled density distribution in a case where the nozzle meniscus position is appropriate is determined in advance as the standard, and the amount of displacement of the nozzle meniscus position in the wiping operation can be determined by determining the amount of the density difference in the observed soiled density distribution on the web having been used in the wiping operation, in comparison with the standard. Thus, it is possible to readily adjust the nozzle meniscus position.

Preferably, the observation device observes, as the soiled state, a soiled density distribution on the web in a direction perpendicular to the web travelling direction; and the judgment device makes a judgment on presence of a kink in the web on a basis of the soiled density distribution observed by the observation device.

According to this aspect of the present invention, the density distribution of soiling on the web in the direction perpendicular to the direction of the travel of the web is observed as the state of soiling, and the presence of a kink in the web in the wiping operation is judged on the basis of the observed soiled density distribution on the web having been used in the wiping operation. If there is a kink in the web, then non-uniformity occurs in the soiled density distribution. Then, it is possible to readily judge whether there is a kink in the web or not by judging whether there is a non-uniformity in the observed soiled density distribution or not.

Preferably, the setting correction device corrects at least one of the kink in the web and a tension of the web in accordance with the judgment made by the judgment device.

According to this aspect of the present invention, the kink in the web and/or the tension of the web in the wiping operation is corrected in accordance with the result of the judgment for the presence of the kink on the basis of the observed soiled density distribution on the web having been used in the wiping operation. Then, it is possible to readily correct the travel of the web.

Preferably, the observation device observes, as the soiled state, a soiled density distribution on the web in a direction perpendicular to the web travelling direction; and the judgment device makes a judgment on appropriateness of a wetting amount of the nozzle surface on a basis of the soiled density distribution observed by the observation device.

According to this aspect of the present invention, the density distribution of soiling on the web in the direction perpendicular to the direction of the travel of the web is observed as the state of soiling, and the appropriateness of the wetting amount of the nozzle surface in the wiping operation is judged on the basis of the observed soiled density distribution on the web having been used in the wiping operation. If the amount of wetting of the nozzle surface is excessive or insufficient, then the end portions (edge portions) in the web widthwise direction of the soiled density distribution in particular show a difference to a normal case. Then, it is possible to readily judge whether the wetting amount is appropriate or not by observing the state of the end portions of the soiled density distribution.

Preferably, the setting correction device corrects the wetting amount of the nozzle surface in accordance with the judgment made by the judgment device.

According to this aspect of the present invention, the amount of wetting of the nozzle surface in the wiping operation is corrected in accordance with the result of the judgment for the appropriateness of the amount of wetting on the basis of the observed soiled density distribution on the web having been used in the wiping operation. If the amount of wetting of the nozzle surface is excessive or insufficient, then the end portions (edge portions) in the web widthwise direction of the soiled density distribution in particular show a different distribution to a normal case. Then, a soiled density distribution in a case where the wetting amount of the nozzle surface is appropriate is determined in advance as the standard, and the amount of correction of the wetting amount in the wiping operation can be determined by determining the amount of change in the edge portions (for example, the amount of displacement of the positions of the edge portions) in the observed soiled density distribution on the web having been used in the wiping operation, in comparison with the standard. Thus, it is possible to readily adjust the amount of wetting of the nozzle surface in the wiping operation.

Preferably, the observation device observes, as the soiled state, a soiled region length on the web in the web travelling direction; and the judgment device makes a judgment on appropriateness of at least one of a travelling speed of the web and a relative movement speed of the wiping device with respect to the nozzle surface on a basis of the soiled region length observed by the observation device.

According to this aspect of the present invention, the length of the soiled region on the web in the direction of travel of the web is observed as the state of soiling, and the appropriateness of the speed of travel of the web and/or the relative speed of movement of the wiping device with respect to the nozzle surface in the wiping operation is judged on the basis of the observed length of the soiled region on the web having been used in the wiping operation. If the speed of travel of the web and/or the relative speed of movement of the wiping device is inappropriate, then the length of the soiled region becomes longer or shorter than in a case where the speed of travel of the web and the relative speed of movement of the wiping device are appropriate. Then, it is possible to readily judge whether the speed of travel of the web and the relative speed of movement of the wiping device are appropriate or not by observing the length of the soiled region.

Preferably, the setting correction device corrects the at least one of the travelling speed of the web and the relative movement speed of the wiping device in accordance with the judgment made by the judgment device.

According to this aspect of the present invention, the speed of travel of the web and/or the relative speed of movement of the wiping device in the wiping operation is corrected in accordance with the result of the judgment for the appropriateness of that on the basis of the observed length of the soiled region on the web having been used in the wiping operation. If the speed of travel of the web and/or the relative speed of movement of the wiping device is inappropriate, then the length of the soiled region becomes longer or shorter than in a case where the speed of travel of the web and the relative speed of movement of the wiping device are appropriate. Then, a length of a soiled region in a case where the speed of travel of the web and the relative speed of movement of the wiping device are appropriate is determined in advance as the standard, and the amount of correction for setting appropriate speeds in the wiping operation can be determined by determining the amount of the divergence in the observed length of the soiled region on the web having been used in the wiping operation, in comparison with the standard. Thus, it is possible to readily achieve correction of the speed of travel of the web and/or the relative speed of movement of the wiping device.

Preferably, the observation device observes, as the soiled state, a soiled density distribution on the web in a direction perpendicular to the web travelling direction; and the judgment device makes at least one of: a judgment on appropriateness of a pressing position of the web against the nozzle surface; a judgment on appropriateness of parallelism of the web with respect to the nozzle surface; a judgment on appropriateness of a pressing force of the web against the nozzle surface; a judgment on appropriateness of a nozzle meniscus position in the inkjet head; a judgment on presence of a kink in the web; and a judgment on appropriateness of a wetting amount of the nozzle surface, on a basis of the soiled density distribution observed by the observation device.

According to this aspect of the present invention, the density distribution of soiling on the web in the direction perpendicular to the direction of the travel of the web is observed as the state of soiling, and appropriateness in the wiping operation of at least one of: a pressing position of the web against the nozzle surface; appropriateness of parallelism of the web with respect to the nozzle surface; appropriateness of a pressing force of the web against the nozzle surface; appropriateness of a nozzle meniscus position in the inkjet head; presence of a kink in the web; and appropriateness of a wetting amount of the nozzle surface, is judged on the basis of the observed soiled density distribution on the web having been used in the wiping operation. Then, it is possible to judge the appropriateness of the plurality of settings.

Preferably, the observation device observes, as the soiled state, a soiled density distribution on the web in a direction perpendicular to the web travelling direction, and a soiled region length on the web in the web travelling direction; the judgment device makes at least one of: a judgment on appropriateness of a pressing position of the web against the nozzle surface; a judgment on appropriateness of parallelism of the web with respect to the nozzle surface; a judgment on appropriateness of a pressing force of the web against the nozzle surface; a judgment on appropriateness of a nozzle meniscus position in the inkjet head; a judgment on presence of a kink in the web; and a judgment on appropriateness of a wetting amount of the nozzle surface, on a basis of the soiled density distribution observed by the observation device; and the judgment device makes a judgment on appropriateness of at least one of a travelling speed of the web and a relative movement speed of the wiping device with respect to the nozzle surface on a basis of the soiled region length observed by the observation device.

According to this aspect of the present invention, the density distribution of soiling on the web in the direction perpendicular to the direction of the travel of the web, and the length of the soiled region on the web in the direction of travel of the web are observed as the state of soiling. Then, appropriateness in the wiping operation of at least one of: a pressing position of the web against the nozzle surface; appropriateness of parallelism of the web with respect to the nozzle surface; appropriateness of a pressing force of the web against the nozzle surface; appropriateness of a nozzle meniscus position in the inkjet head; presence of a kink in the web; and appropriateness of a wetting amount of the nozzle surface, is judged on the basis of the observed soiled density distribution on the web having been used in the wiping operation, and appropriateness of the speed of travel of the web and/or the relative speed of movement of the wiping device with respect to the nozzle surface in the wiping operation is judged on the basis of the observed length of the soiled region on the web having been used in the wiping operation. Thus, it is possible to judge the appropriateness of the plurality of settings.

Preferably, the inkjet head is constituted of a plurality of head modules joined together; the observation device observes the soiled state of the wiping member for each of the head modules; and the judgment device makes the judgment on the appropriateness of the setting of the wiping operation for each of the head modules on the basis of the soiled state observed for each of the head modules by the observation device.

According to this aspect of the present invention, the inkjet head is composed by joining together the plurality of head modules. The state of soiling on the wiping member that has been used in the wiping operation is observed for each module, and the appropriateness of the setting of the wiping operation is judged for each module. Thus, in the case where the inkjet head is constituted of the plurality of head modules, it is possible to clean the nozzle surface more accurately.

Preferably, the setting correction device corrects the setting of the wiping operation for each of the head modules in accordance with the judgment made for each of the head modules by the judgment device.

According to this aspect of the present invention, the setting of the wiping operation is corrected for each module. Thereby, in the case where the inkjet head is constituted of the plurality of head modules, it is possible to clean the nozzle surface more accurately.

Preferably, the setting correction device corrects the setting of the wiping operation during the wiping operation.

According to this aspect of the present invention, the setting of the wiping operation is corrected during the wiping operation. Thereby, it is possible to wipe the nozzle surface with optimum settings, at all times.

Preferably, the observation device includes: an imaging device which captures an image of the wiping member having been used in the wiping operation; and an analyzation device which analyzes the image captured by the imaging device to determine the soiled state of the wiping member.

According to this aspect of the present invention, the image of the wiping member that has been used in the wiping operation is captured by the imaging device, the image thus obtained is analyzed, and the state of soling of the wiping member having been used in the wiping operation is observed. Thereby, it is possible to observe the state of soiling of the wiping member simply and accurately.

Preferably, the wiping member includes a web; the wiping device includes a web drive device which causes the web to travel in a web travelling direction along a web travelling path, and a pressing roller about which the web is wrapped; the wiping device performs the wiping operation by pressing the travelling web against the nozzle surface by means of the pressing roller while the wiping device moves relatively along the nozzle surface; and the imaging device includes a line scanner which is arranged in a direction perpendicular to the web travelling direction.

According to this aspect of the present invention, the image of the web that has been used in the wiping operation is acquired through the line scanner, and thereby the image of the wiping member having been used in the wiping operation is obtained. Thus, it is possible to accurately acquire the image of the wiping member having been used in the wiping operation, by means of a simple composition.

Preferably, the line scanner is integrally attached to the wiping device.

According to this aspect of the present invention, the line scanner is integrally incorporated in the wiping device. Thus, it is possible to capture the image of the web at all times, even in a case where the wiping device is moved so as to wipe the nozzle surface.

Preferably, the judgment device has a plurality of judgment standards for the judgment; and the judgment device makes the judgment while switching the judgment standards in accordance with at least one of: a number of sheets which have been printed with the inkjet head; and a duration in which the inkjet head has been used.

According to this aspect of the present invention, the judgment standards can be switched in accordance with the number of print sheets or the printing duration. Since the state of soiling changes over time, the standards for the judgment are established in accordance with the number of print sheets or the printing duration, and the appropriateness of the setting can be judged under appropriate conditions at all times, by switching the judgment standards as appropriate.

In order to attain the aforementioned object, the present invention is also directed to an inkjet recording apparatus, comprising: a conveyance device which conveys a medium; the above-described nozzle surface cleaning apparatus; and the inkjet head which records an image by ejecting and depositing ink droplets onto the medium conveyed by the conveyance device.

According to this aspect of the present invention, it is possible to clean the inkjet head mounted on the inkjet recording apparatus in an optimum state at all times.

In order to attain the aforementioned object, the present invention is also directed to an inkjet recording apparatus, comprising: a conveyance device which conveys a medium along a medium conveyance path; and a plurality of head units each of which includes: the above-described nozzle surface cleaning apparatus; and the inkjet head which is arranged along the medium conveyance path and records an image by ejecting and depositing ink droplets onto the medium conveyed by the conveyance device, wherein in each of the head units, the judgment device in the nozzle surface cleaning apparatus has a judgment standard for the judgment specifically for the corresponding inkjet head.

According to this aspect of the present invention, the inkjet recording apparatus is provided with the nozzle surface cleaning apparatuses respectively for the inkjet heads, and the judgment standards are set respectively for the inkjet heads. The state of soiling of the wiping members for the inkjet heads varies with the ink used and the arrangement of the inkjet heads, and therefore it is possible to judge whether the settings are appropriate or not by setting the judgment standards respectively for the inkjet heads.

Preferably, the conveyance device includes a drum, the medium being held on a circumferential surface of the drum and being conveyed by rotation of the drum; and the inkjet head in each of the head units is arranged around the drum in such a manner that the nozzle surface faces the circumferential surface of the drum.

According to this aspect of the present invention, the inkjet heads are arranged about the periphery of the drum. In this case, the inkjet heads are arranged with the nozzle surfaces inclined with respect to the horizontal plane, and therefore it is possible to judge whether the settings are appropriate or not more accurately, by setting the judgment standards respectively for the inkjet heads.

In order to attain the aforementioned object, the present invention is also directed to a method of cleaning a nozzle surface of an inkjet head, comprising the steps of: performing a wiping operation on the nozzle surface with a wiping member having permeability; observing a soiled state of the wiping member having been used in the wiping operation; and making a judgment on appropriateness of a setting of the wiping operation on a basis of the soiled state observed in the observing step.

According to this aspect of the present invention, the appropriateness of the setting of the wiping operation is judged on the basis of the state of soiling on the wiping member that has been used in the wiping operation. If the setting of the wiping operation is inappropriate, then the wiping member is abnormally soiled (in a soiling mode which is different to that in a case where the setting of the wiping operation is appropriate). Then, it is possible to judge whether the setting of the wiping operation is appropriate or not by observing the soiled state of the wiping member having been used in the wiping operation. For example, a soiled state of the wiping member having been used in a wiping operation of which the setting is appropriate is determined in advance as the standard soiled state, and a soiled state of the wiping member having been used in a wiping operation of which the setting is the subject for the judgment is compared with the standard soiled state. Thereby, it is possible to readily judge whether the setting of the wiping operation is appropriate or not.

Preferably, the method further comprises the step of correcting the setting of the wiping operation in accordance with the judgment.

According to this aspect of the present invention, the setting of the wiping operation is corrected in accordance with the result of the judgment for the appropriateness of the setting on the basis of the observed soiled state of the wiping member having been used in the wiping operation. Thus, it is possible to wipe the nozzle surface under the correct setting at all times, and the nozzle surface can be cleaned without causing wiping traces, or the like.

According to the present invention, it is possible to readily optimize the settings of the wiping operation.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Composition of Inkjet Recording Apparatus

Figure 1:
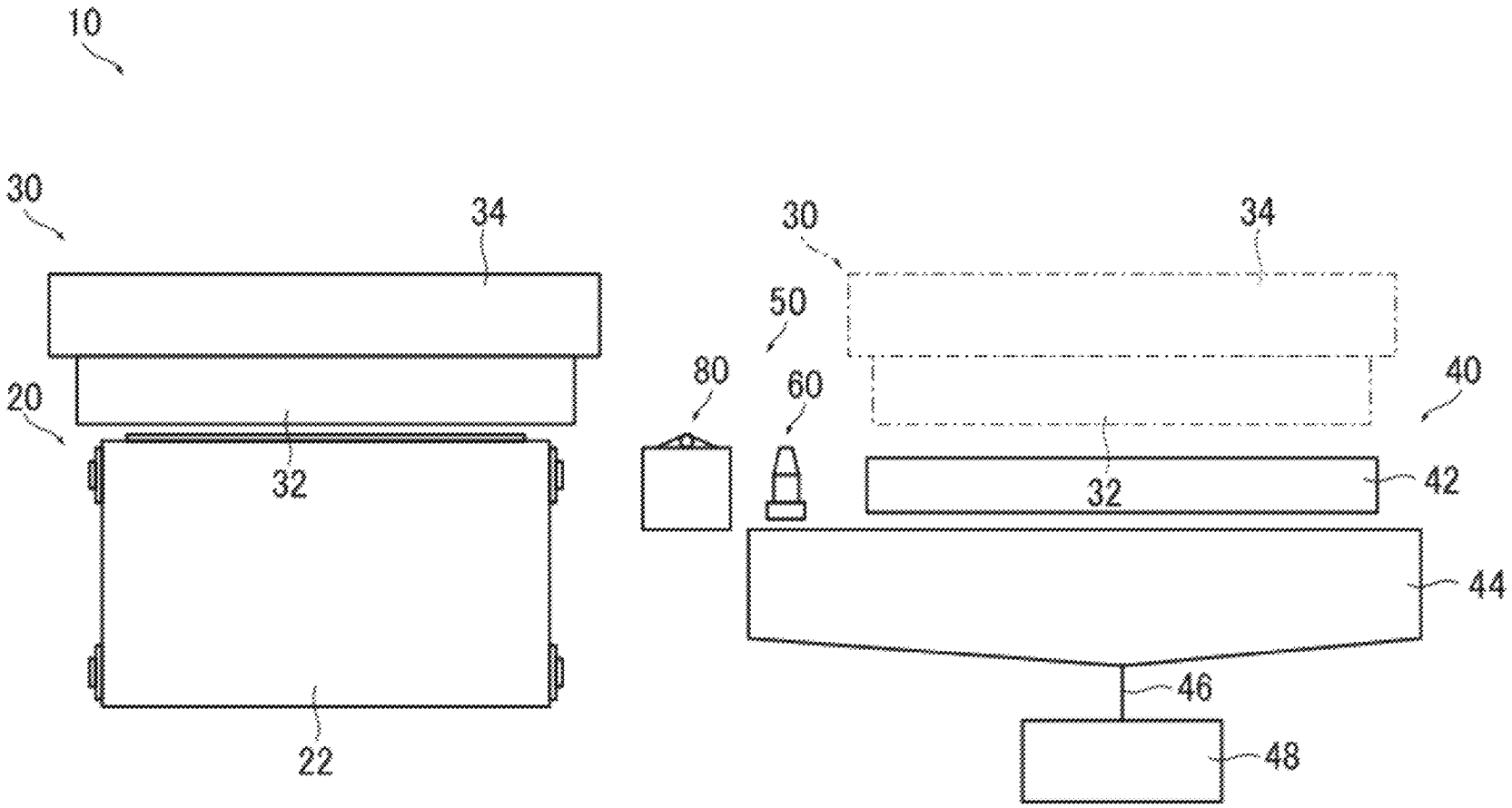
FIG. 1 is a front view diagram showing a composition of the principal part of an inkjet recording apparatus according to a first embodiment of the present invention.
Figure 2:
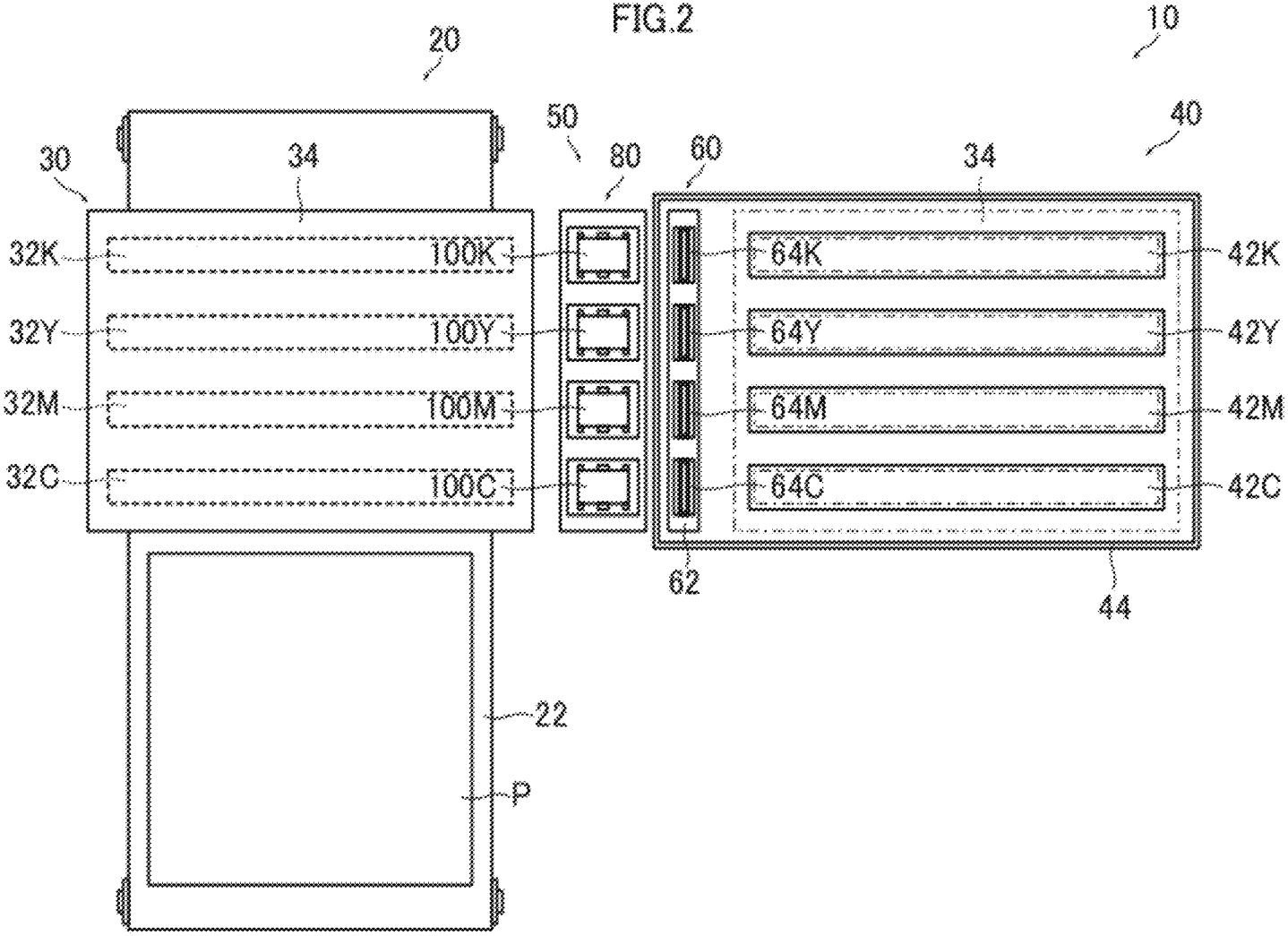
FIG. 2 is a plan diagram showing the composition of the principal part of the inkjet recording apparatus.
Figure 3:
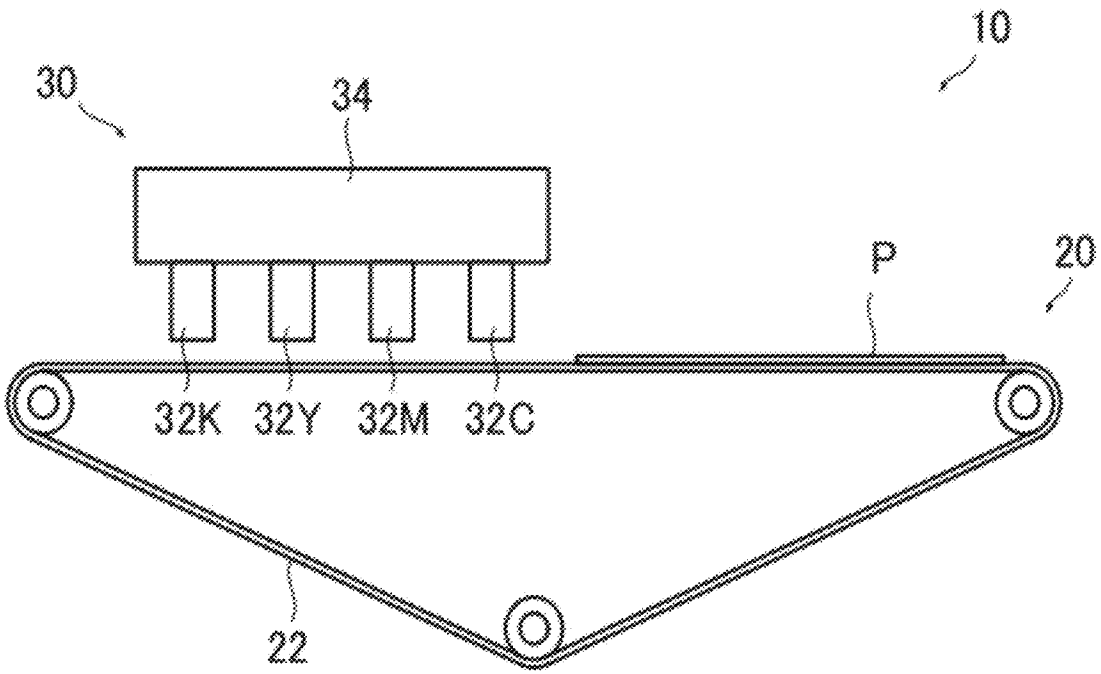
FIG. 3 is a side view diagram showing the composition of the principal part of the inkjet recording apparatus.

FIGS. 1, 2 and 3 are respectively a front view diagram, a plan diagram and a side view diagram showing a composition of the principal part of an inkjet recording apparatus 10 according to a first embodiment of the present invention.

As shown in FIGS. 1 to 3, the inkjet recording apparatus 10 is a single-pass type of line printer and includes: a paper conveyance mechanism 20, which conveys paper (cut sheet paper) P serving as a recoding medium; a head unit 30, which ejects and deposits ink droplets of respective colors of cyan (C), magenta (M), yellow (Y) and black (K) onto paper P that is conveyed by the paper conveyance mechanism 20; a maintenance unit 40, which carries out maintenance of inkjet heads installed on the head unit 30; and a nozzle surface cleaning unit 50, which cleans the nozzle surfaces of the inkjet heads installed on the inkjet head unit 30.

The paper conveyance mechanism 20 is constituted of a belt conveyance mechanism, and horizontally conveys the paper P while holding the paper P on a traveling belt 22 by attraction.

The head unit 30 includes: the inkjet heads 32C, 32M, 32Y and 32K, which eject droplets of cyan ink, magenta ink, yellow ink and black ink, respectively; a head supporting frame 34, on which the inkjet heads 32C, 32M, 32Y and 32K are installed; and a head supporting frame movement mechanism (not shown), which moves the head supporting frame 34.

The inkjet heads 32C, 32M, 32Y and 32K are constituted of line heads corresponding to the maximum width of the paper P which is the object of printing. The inkjet heads 32C, 32M, 32Y and 32K have the same composition described below, and are hereinafter referred also to as the inkjet heads 32, unless a specific head is to be distinguished.

Each inkjet head 32 (32C, 32M, 32Y and 32K) is formed in a rectangular block shape. Nozzle surfaces 33C, 33M, 33Y and 33K (hereinafter referred also to as the nozzle surfaces 33) are formed in the bottom portions of the inkjet heads 32C, 32M, 32Y and 32K, respectively.

Figure 4:
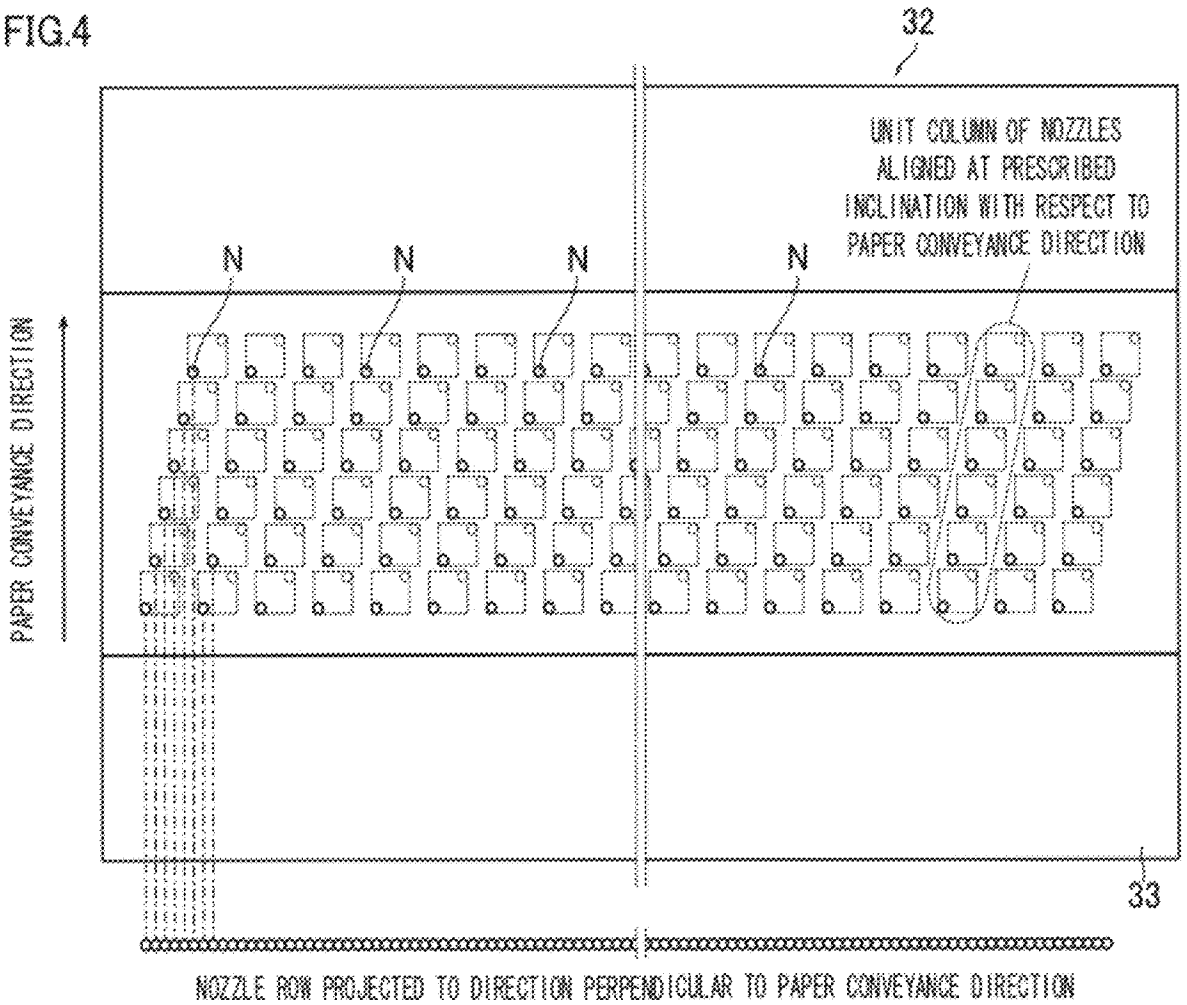
FIG. 4 is a plan view perspective diagram of a nozzle surface of an inkjet head in the inkjet recording apparatus.

FIG. 4 is a plan view perspective diagram of the nozzle surface 33 of the inkjet head 32.

The nozzle surface 33 is formed in a rectangular shape. Nozzle rows are arranged in the nozzle surface 33 along the lengthwise direction thereof. The inkjet head 32 in the present embodiment is constituted of a so-called matrix head, in which nozzles N are arranged in a two-dimensional matrix configuration. In the matrix head, it is possible to reduce the effective pitch of the nozzles N when projected in the lengthwise direction of the inkjet head 32, and a high-density arrangement of the nozzles N can be achieved.

The inkjet head 32 in the present embodiment ejects droplets of ink from the nozzles N by a so-called piezoelectric jet system. The nozzles N are connected respectively to pressure chambers, and a droplet of ink is ejected from each nozzle N by causing a wall of the pressure chamber to vibrate by a piezoelectric element. The ink ejection method is not limited to this and can also adopt a composition which performs ejection by a thermal jet method.

The head supporting frame 34 has a head installation section (not shown) for installing the inkjet heads 32. The inkjet heads 32 are installed detachably in this head installation section.

The inkjet heads 32 installed on the head supporting frame 34 are arranged perpendicularly to the direction of conveyance of the paper P. The inkjet heads 32 are arranged at a uniform interval apart in a prescribed order in the conveyance direction of the paper P (in the present embodiment, the inkjet heads 32 are arranged in the order of cyan, magenta, yellow and black).

The head installation section is arranged so as to be raisable and lowerable on the head supporting frame 34, and is raised and lowered by an elevator mechanism (not shown). The inkjet heads 32 which are installed on the head installation section are raised and lowered perpendicularly with respect to the conveyance face for the paper P.

The head supporting frame movement mechanism (not shown) causes the head supporting frame 34 to horizontally slide above the paper conveyance mechanism 20, in a direction perpendicular to the direction of conveyance of the paper P. The head supporting frame movement mechanism includes, for example: a ceiling frame, which is horizontally disposed over the paper conveyance mechanism 20; a guide rail, which is arranged on the ceiling frame; a traveling body, which slides on the guide rail; and a drive device (for example, a screw feed mechanism, or the like), which moves the traveling body along the guide rail. The head supporting frame 34 is arranged on the traveling body and is then horizontally slidable.

The head supporting frame 34 is driven by the head supporting frame movement mechanism, and is arranged movably between a prescribed "image recording position" and a prescribed "maintenance position".

When the head supporting frame 34 is situated at the image recording position, the head supporting frame 34 is disposed over the paper conveyance mechanism 20. In this state, it is possible to carry out printing onto the paper P that has been conveyed by the paper conveyance mechanism 20.

On the other hand, when the head supporting frame 34 is situated at the maintenance position, the head supporting frame 34 is disposed at the position where the maintenance unit 40 is arranged.

The maintenance unit 40 is provided with caps 42C, 42M, 42Y and 42K (hereinafter referred also to as the caps 42), which cover the nozzle surfaces 33C, 33M, 33Y and 33K of the inkjet heads 32C, 32M, 32Y and 32K, respectively. When the inkjet recording apparatus 10 is halted for a long period of time, for example, the inkjet heads 32 are moved to the maintenance position where the maintenance unit 40 is arranged, and the nozzle surfaces 33 are covered with the caps 42. Thus, ejection failure due to drying is prevented.

Each cap 42 is provided with a pressurizing and sucking mechanism (not shown) for pressurizing and sucking the interior of the nozzles N, and a cleaning liquid supply mechanism (not shown) for supplying cleaning liquid to the interior of the cap 42. The maintenance unit 40 is provided with a waste liquid tray 44 at a position below the caps 42. The cleaning liquid supplied to the caps 42 is discarded into the waste liquid tray 44, and is then recovered into the waste liquid tank 48 from the waste liquid tray 44 through a waste liquid recovery pipe 46.

The nozzle surface cleaning unit 50 is arranged between the paper conveyance mechanism 20 and the maintenance unit 40. The nozzle surface cleaning unit 50 cleans the nozzle surfaces 33 of the inkjet heads 32 while the head supporting frame 34 is moving from the maintenance position to the image recording position.

The nozzle surface cleaning unit 50 includes: a cleaning liquid deposition device 60, which deposits the cleaning liquid to the nozzle surfaces 33 of the inkjet heads 32 when the head supporting frame 34 is moved from the maintenance position toward the image recording position; and a wiping device 80, which wipes the nozzle surfaces 33 on which the cleaning liquid has been deposited, by means of wiping webs.

Figure 5:
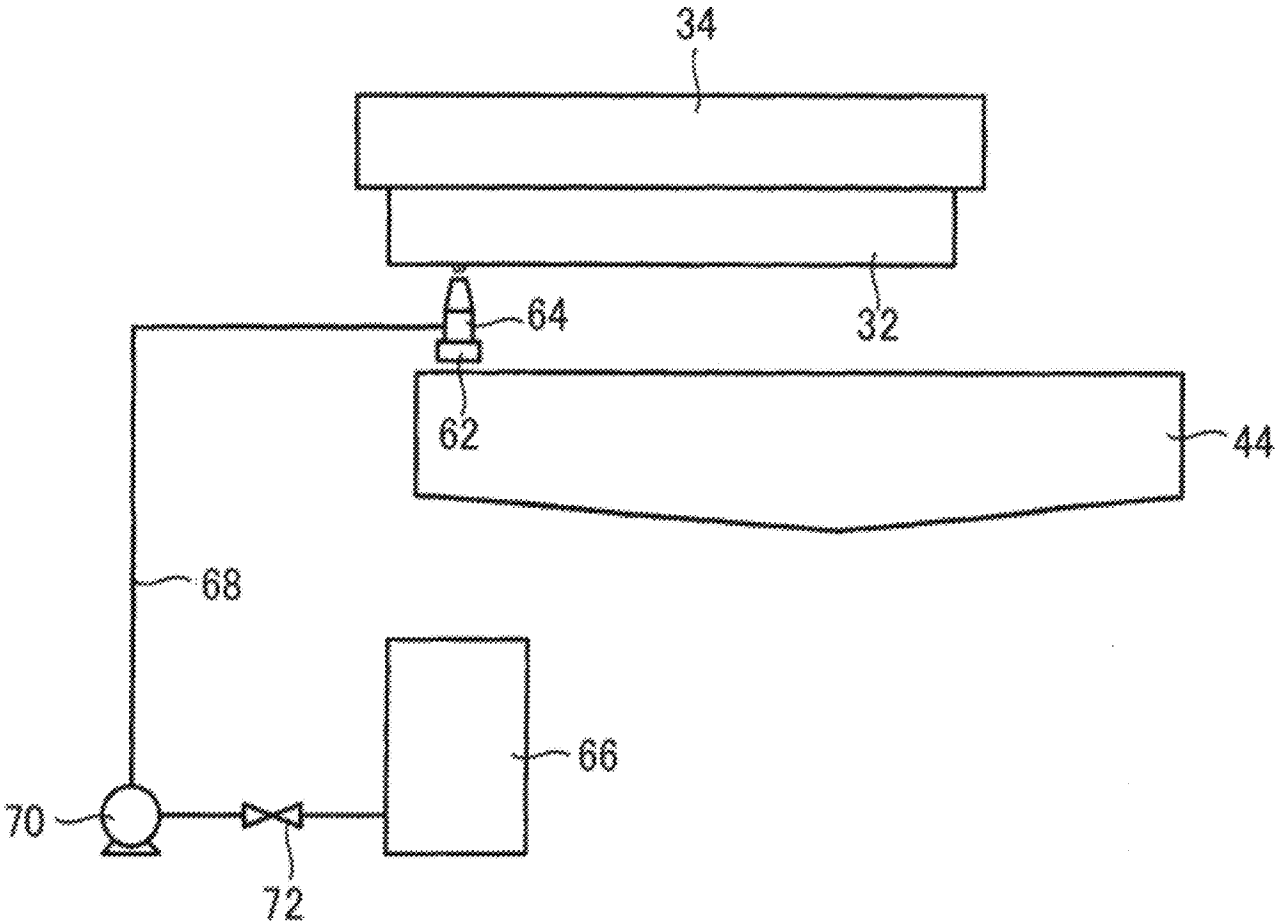
FIG. 5 is a front view diagram showing the general composition of a cleaning liquid deposition device in the inkjet recording apparatus.

FIG. 5 is a front view diagram showing an approximate composition of the cleaning liquid deposition device 60. As shown in FIG. 5, the cleaning liquid deposition device 60 includes: a cleaning liquid deposition device main frame 62; cleaning liquid nozzles 64C, 64M, 64Y and 64K, which are arranged on the cleaning liquid deposition device main frame 62; a cleaning liquid tank 66, in which the cleaning liquid is stored; a cleaning liquid pipe 68, which connects the cleaning liquid tank 66 and the cleaning liquid nozzles 64C, 64M, 64Y and 64K; a cleaning liquid pump 70, which sends the cleaning liquid from the cleaning liquid tank 66 to the cleaning liquid nozzles 64C, 64M, 64Y and 64K; and a cleaning liquid valve 72, which opens and closes the cleaning liquid pipe 68.

The cleaning liquid deposition device main body frame 62 is horizontally disposed over the waste liquid tray 44.

The cleaning liquid nozzles 64C, 64M, 64Y and 64K are arranged respectively for the inkjet heads 32C, 32M, 32Y and 32K, and are disposed on the cleaning liquid deposition device main body frame 62 in accordance with the installation pitch of the inkjet heads 32C, 32M, 32Y and 32K. The cleaning liquid nozzles 64C, 64M, 64Y and 64K have the same composition described below, and are hereinafter referred also to as the cleaning liquid nozzles 64, unless a specific cleaning liquid nozzle is to be distinguished.

Each cleaning liquid nozzle 64 has an ejection port of a width corresponding to the width of the nozzle surface 33, and sprays the cleaning liquid out from the ejection port. The cleaning liquid nozzles 64 are disposed on the cleaning liquid deposition device main body frame 62 so as to spray the cleaning liquid upward.

When the inkjet heads 32 pass over the cleaning liquid nozzles 64, the cleaning liquid sprayed out from the ejection ports strikes the nozzle surfaces 33, thereby the cleaning liquid is deposited onto the nozzle surfaces 33 to wet the nozzle surfaces 33.

The cleaning liquid nozzles 64 are connected to the cleaning liquid tank 66 through the cleaning liquid pipe 68. The cleaning liquid pump 70 is arranged at an intermediate point of the cleaning liquid pipe 68, and the cleaning liquid pump 70 sends the cleaning liquid stored in the cleaning liquid tank 66 to the cleaning liquid nozzles 64. The cleaning liquid valve 72 is arranged at an intermediate point of the cleaning liquid pipe 68, and is capable of opening and closing the channel of the cleaning liquid pipe 68.

It is possible to adopt a composition where a plurality of cleaning liquid pumps 70 are arranged respectively for the cleaning liquid nozzles 64, or a composition where a single cleaning liquid pump 70 is shared for all of the cleaning liquid nozzles 64. The same applies to the cleaning liquid valve 72.

The cleaning liquid deposition unit 60 has the composition described above. The operation of the cleaning liquid deposition device 60 is controlled by means of a controller (not shown) which controls the whole of the inkjet recording apparatus 10. The controller controls the deposition of the cleaning liquid by controlling driving of the cleaning liquid pump 70 and the cleaning liquid valve 72.

Figure 6:
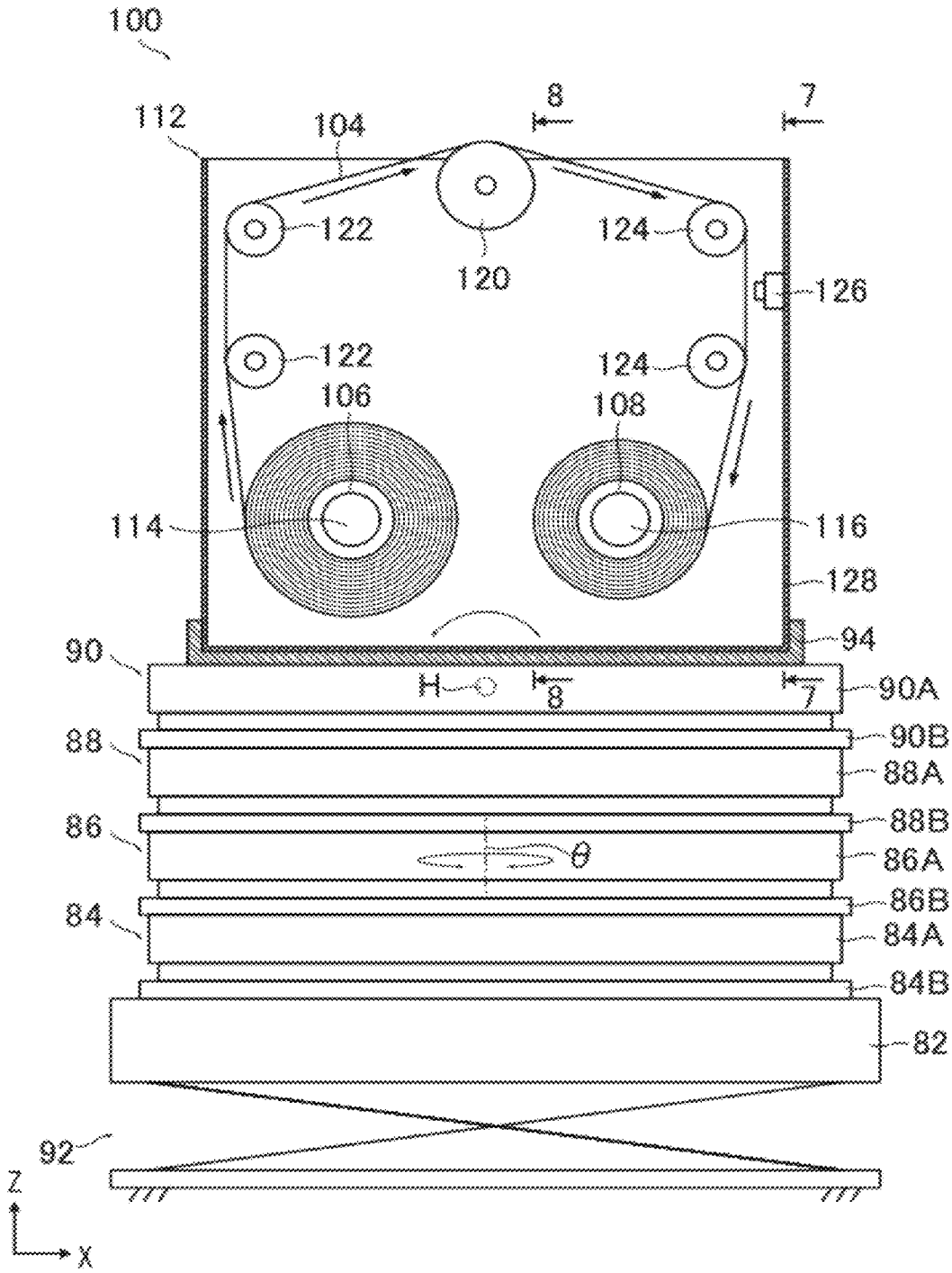
FIG. 6 is a front view diagram showing the general composition of a wiping device in the inkjet recording apparatus.
Figure 7:
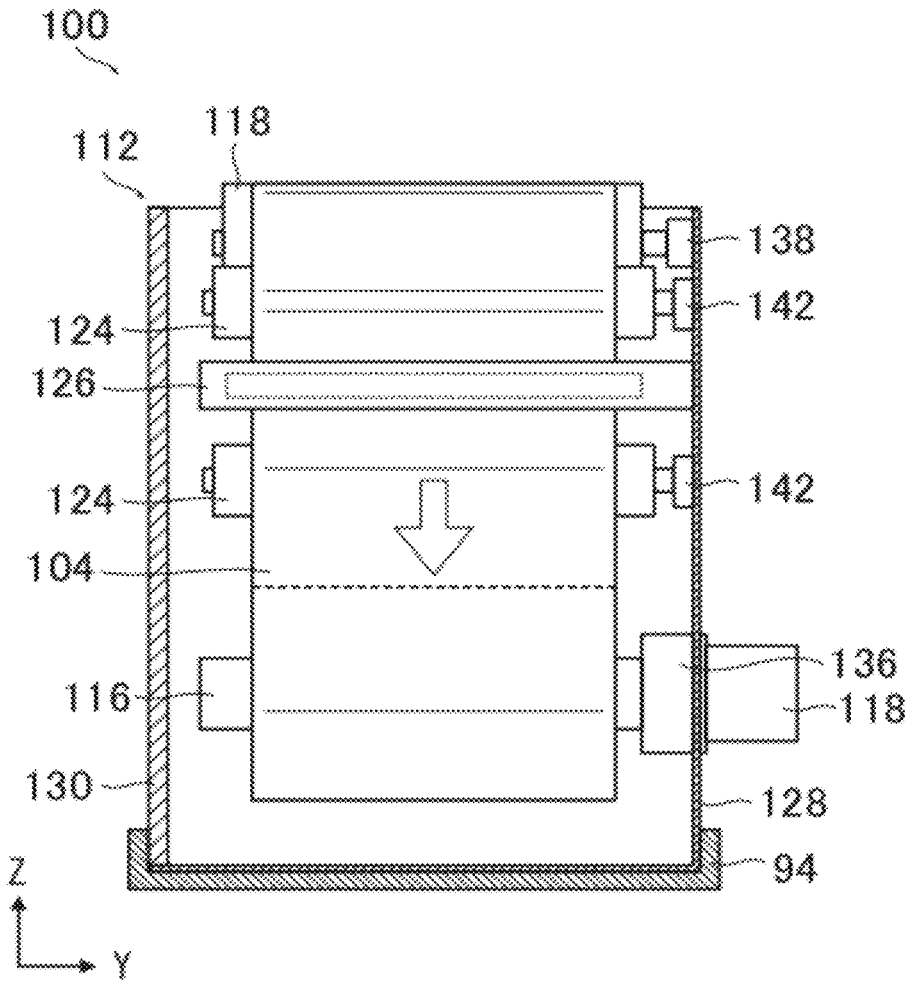
FIG. 7 is a cross-sectional view along line 7-7 in FIG. 6.
Figure 8:
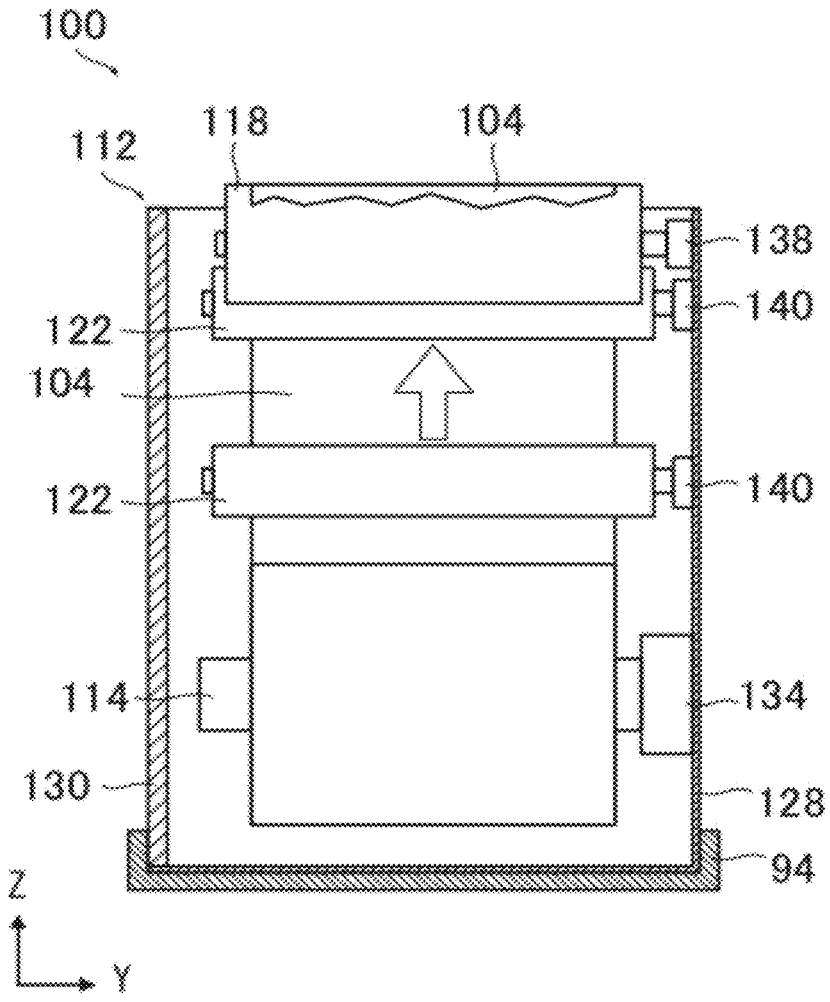
FIG. 8 is a cross-sectional view along line 8-8 in FIG. 6.

FIG. 6 is a front view diagram showing an approximate composition of the wiping device 80. FIGS. 7 and 8 are cross-sectional diagrams respectively along line 7-7 and line 8-8 in FIG. 6.

The wiping device 80 includes a wiping device main body frame 82, and wiping units 100C, 100M, 100Y and 100K, which are installed on the wiping device main body frame 82. The wiping units 100C, 100M, 100Y and 100K have the same composition described blow, and are hereinafter referred also to as the wiping units 100.

The wiping device 80 further includes: height adjustment mechanisms 84, each of which adjusts the height of each wiping unit 100 installed on the wiping device main body frame 82; horizontal rotation adjustment mechanisms 86, each of which adjusts the rotational angle within the horizontal plane of each wiping unit 100 installed on the wiping device main body frame 82; horizontal position adjustment mechanisms 88, each of which adjusts the position within the horizontal plane of each wiping unit 100 installed on the wiping device main body frame 82; inclination adjustment mechanisms 90, each of which adjusts the inclination with respect to the horizontal plane of each wiping unit 100 installed on the wiping device main body frame 82; and a wiping device main body elevator mechanism 92, which raises and lowers the wiping device main body frame 82.

Each wiping unit 100 can press a wiping web 104 formed in a band shape against the nozzle surface 33 of the inkjet head 32 while causing the wiping web 104 to travel, thereby wiping the nozzle surface 33. The wiping units 100C, 100M, 100Y and 100K are arranged respectively for the inkjet heads 32C, 32M, 32Y and 32K, and are disposed on the wiping device main body frame 82 in accordance with the installation pitch of the inkjet heads 32C, 32M, 32Y and 32K.

As shown in FIGS. 6 to 8, each wiping unit 100 includes: a casing 112; a pay-out spindle 114, which pays out the wiping web 104; a take-up spindle 116, which takes up the wiping web 104; a take-up motor 118, which drives the take-up spindle 116 to rotate; a set of pay-out guides 122, which guide the wiping web 104 having been paid out from the pay-out spindle 114 so as to be wrapped about a pressing roller 120; a set of take-up guides 124, which guide the wiping web 104 having been wrapped about the pressing roller 120 so as to be taken up onto the take-up spindle 116; and a line scanner 126, which observes the state of the wiping web 104 having been used in the wiping operation.

The wiping web 104 uses, for example, a knitted or woven sheet made of ultra-fine fibers of PET (polyethylene terephthalate), PE (polyethylene), NY (nylon), or the like, and is formed in a flexible band shape having a width corresponding to the width of the nozzle surface 33 of the inkjet head 32 being wiped. The wiping web 104 is supplied in a state where the wiping web 104 is wound in the form of a roll about the pay-out core 106 and the leading end of the wiping web 104 is fixed to the take-up core 108.

The casing 112 is constituted of a casing main body 128 and a lid 130. The casing main body 128 is formed in a rectangular box shape, in which the upper face portion and the front face portion thereof are open. The lid 130 is attached to the front face portion of the casing main body 128 thorough a hinge (not shown). The front face portion of the casing main body 128 is opened and closed by means of the lid 130.

One end of the pay-out spindle 114 is supported on a pay-out spindle bearing section 134 arranged on the casing main body 128, and the pay-out spindle 114 is horizontally arranged inside the casing main body 128. The pay-out spindle 114 has a dual-tube structure, in which an outer tube is supported rotatably about the periphery of an inner tube. A reverse locking mechanism and a friction mechanism are arranged between the inner tube and the outer tube, and the outer tube rotates only in one direction (the pay-out direction of the wiping web 104) with a uniform resistance.

The pay-out core 106 of the wiping web 104 is fitted onto the pay-out spindle 114.

One end of the take-up spindle 116 is supported rotatably on a take-up spindle bearing section 136 arranged on the casing main body 128, and the take-up spindle 116 is horizontally arranged inside the casing main body 128. The take-up spindle 116 has a dual-tube structure, in which an outer tube is supported rotatably about the periphery of an inner tube. A torque limiter is arranged between the inner tube and the outer tube, and is composed in such a manner that when a load (torque) over a prescribed threshold is applied, the outer tube slides with respect to the inner tube.

The take-up core 108 of the wiping web 104 is fitted onto the take-up spindle 116.

The take-up motor 118 is disposed on the rear face of the casing main body 128. The take-up motor 118 is arranged coaxially with the take-up spindle 116 and is coupled to the take-up spindle 116. The take-up spindle 116 is driven by the take-up motor 118 and is rotated in one direction (the take-up direction of the wiping web 104). In this case, as described above, the take-up spindle 116 slides when a load over the prescribed threshold is applied. Thereby, it is possible to prevent the wiping web 104 from being applied with excessive tension.

One end of the pressing roller 120 is supported rotatably on a pressing roller bearing section 138 arranged on the casing main body 128, and the pressing roller 120 is horizontally arranged inside the casing main body 128. The pressing roller 120 is constituted of a rubber roller corresponding to the width of the wiping web 104. The pressing roller 120 is disposed so that a portion of the pressing roller 120 projects through the open portion of the upper face of the casing main body 128.

One end of the axle portion of each of the set of pay-out guides 122 is supported rotatably on pay-out guide supporting sections 140 arranged on the casing main body 128, and the pay-out guides 122 are horizontally arranged inside the casing main body 128. The set of pay-out guides 122 are arranged in parallel at a uniform interval apart in the vertical direction, and guide the wiping web 104 that has been paid out from the pay-out spindle 114, toward the pressing roller 120.

One end of the axle portion of each of the set of take-up guides 124 is supported rotatably on take-up guide supporting sections 142 arranged on the casing main body 128, and the take-up guides 124 are horizontally arranged inside the casing main body 128. The set of take-up guides 124 are arranged in parallel at a uniform interval apart in the vertical direction, and guide the wiping web 104 that has been wrapped about the pressing roller 120, toward the take-up spindle 116.

The pay-out guides 122 and the take-up guides 124 are disposed in lateral symmetry on either side of the pressing roller 120, and the pay-out spindle 114 and the take-up spindle 116 are also disposed in lateral symmetry on either side of the pressing roller 120.

The line scanner 126 is disposed so as to face the wiping web 104 traveling between the set of take-up guides 124, and is horizontally arranged on the inner face of the casing main body 128 (i.e., so as to be perpendicular to the direction of travel of the wiping web 104 between the set of take-up guides 124). The soiled state of a portion of the wiping web 104 that has wiped the nozzle surface 33 is observed through the line scanner 126 before the portion of the wiping web 104 is taken up onto the take-up spindle 116.

In the wiping unit 100 composed as described above, when the wiping web 104 is installed and the take-up motor 118 is driven, the wiping web 104 is paid out from the pay-out spindle 114 and taken up onto the take-up spindle 116. Thereby, the wiping web 104 is caused to travel. In this case, the friction is applied to the pay-out spindle 114 by the friction mechanism, and the take-up spindle 116 slides with the torque limiter when the load over the prescribed threshold is applied, thereby making it possible to apply a prescribed tension to the wiping web 104 while the wiping web 104 travels.

As described above, the wiping web 104 is prepared in the rolled state on the pay-out core 106, and can therefore be installed (replaced) on the wiping unit 100 in this state. More specifically, after the pay-out core 106 has been installed by fitting onto the pay-out spindle 114, the wiping web 104 is wrapped in order about the pay-out guide 122, the pressing roller 120 and the take-up guide 124, and the take-up core 108 is fitted onto the take-up spindle 116, thereby completing installation.

The height adjustment mechanisms 84 are arranged respectively for the wiping units 100C, 100M, 100Y and 100K. Each height adjustment mechanism 84 includes: a base 84B; an elevator stage 84A, which is arranged raisably and lowerably with respect to the base 84B (i.e., so as to be raisable and lowerable in the Z direction in FIG. 6); and an elevator drive device (not shown), which raises and lowers the elevator stage 84A. The height adjustment mechanisms 84 are disposed on the wiping device main body frame 82 in accordance with the arrangement pitch of the inkjet heads 32. In this case, the base 84B is disposed on the wiping device main body frame 82 in such a manner that the elevator stage 84A is horizontal (parallel to the nozzle surface 33).

The horizontal rotation adjustment mechanisms 86 are arranged respectively for the wiping units 100C, 100M, 100Y and 100K. Each horizontal rotation adjustment mechanism 86 includes: a base 86B; a rotatable stage 86A, which is arranged rotatably about an axis θ perpendicular to the base 86B; and a rotation drive device (not shown), which causes the rotatable stage 86A to rotate. The horizontal rotation adjustment mechanisms 86 are arranged on the elevator stages 84A of the height adjustment mechanisms 84 in accordance with the arrangement pitch of the inkjet heads 32. In this case, the base 86B is disposed on the elevator stage 84A in such a manner that the rotatable stage 86A is horizontal (parallel to the nozzle surface 33).

The horizontal position adjustment mechanisms 88 are arranged respectively for the wiping units 100C, 100M, 100Y and 100K. Each horizontal position adjustment mechanism 88 includes: a base 88B; a slidable stage 88A, which is arranged slidably in a plane parallel to the base 88B (the plane (XY plane) perpendicular to the Z axis in FIG. 6); and a slide drive device (not shown), which causes the slidable stage 88A to slide. The horizontal position adjustment mechanisms 88 are disposed on the rotatable stages 86A of the horizontal rotation adjustment mechanisms 86 in accordance with the arrangement pitch of the inkjet heads 32. In this case, the base 88B is disposed on the rotatable stage 86A in such a manner that the slidable stage 88A is horizontal (parallel to the nozzle surface 33).

The inclination adjustment mechanisms 90 are arranged respectively for the wiping units 100C, 100M, 100Y and 100K. Each inclination adjustment mechanism 90 includes: a base 90B; a swingable stage 90A, which is arranged swingably about an axis H parallel to the base 90B (i.e., so as to be swingable with respect to the horizontal plane); and a swinging drive device (not shown), which causes the swingable stage 90A to swing. The inclination adjustment mechanisms 90 are arranged on the slidable stages 88A of the horizontal position adjustment mechanisms 88 in accordance with the arrangement pitch of the inkjet heads 32. In this case, the base 90B is arranged on the slidable stage 88A in such a manner that the swingable stage 90A in the neutral state (the non-inclined state) is horizontal (parallel to the nozzle surface 33).

A wiping unit installation section 94 is arranged on the swingable stage 90A, and the wiping unit 100 is detachably installed on the wiping unit installation section 94.

The wiping unit 100 installed on the wiping unit installation section 94 is arranged in such a manner that the pressing roller 120 is perpendicular to the lengthwise direction of the inkjet head 32 (i.e., so as to be perpendicular to the movement direction of the inkjet head 32). Hence, when the winding motor 118 is driven, the wiping web 104 travels along the lengthwise direction of the inkjet head 32 (i.e., in parallel with the movement direction of the inkjet head 32).

The wiping device main body elevator mechanism 92 is arranged on the main body frame (not shown) of the inkjet recording apparatus 10, and is capable of raising and lowing the wiping device main body frame 82 in the vertical direction (the Z direction in FIG. 6). The wiping device main body frame 82 can be driven by the wiping device main body elevator mechanism 92 to be raised and lowered vertically so as to move between a prescribed operating position and a prescribed withdrawn position.

The wiping unit 100 installed on the wiping device main body frame 82 is moved to the wiping position when the wiping device main body frame 82 is moved to the operating position. This wiping position is set to a position where the wiping web 104 wrapped about the pressing roller 120 is pressed against the nozzle surface 33 of the inkjet head 32 while the head supporting frame 34 is moving from the maintenance position toward the image recording position.

The wiping unit 100 installed on the wiping device main body frame 82 is moved to a standby position when the wiping device main body frame 82 is moved to the withdrawn position. The standby position is set to a position where the wiping web 104 wrapped about the pressing roller 120 does not come into contact with the nozzle surface 33 of the inkjet head 32 even when the head supporting frame 34 is moved from the maintenance position to the image recording position.

Thus, when the wiping unit 100 is moved to the wiping position, the nozzle surface 33 can be wiped, and when the wiping unit 100 is moved to the standby position, the wiping can be halted.

The installation height in the vertical direction of the wiping unit 100 installed on the wiping device main body frame 82 can be precisely adjusted by the height adjustment mechanism 84. The rotational angle within the horizontal plane of the wiping unit 100 installed on the wiping device main body frame 82 can be precisely adjusted by the horizontal rotation adjustment mechanism 86. The installation position within the horizontal plane of the wiping unit 100 installed on the wiping device main body frame 82 can be precisely adjusted by the horizontal position adjustment mechanism 88. The inclination with respect to the horizontal plane of the wiping unit 100 installed on the wiping device main body frame 82 can be precisely adjusted by the inclination adjustment mechanism 90.

For example, if the wiping web 104 wrapped about the pressing roller 120 is pressed too strongly against the nozzle surface 33, then the installation height of the wiping unit 100 in the vertical direction is finely adjusted by the height adjustment mechanism 84 so as to correct the pressing force to appropriate pressing force.

Moreover, for example, if the direction of travel of the wiping web 104 wrapped about the pressing roller 120 is not parallel to the direction of movement of the inkjet head 32, then the rotational angle of the wiping unit 100 within the horizontal plane is finely adjusted by the horizontal rotation adjustment mechanism 86 so as to correct the direction of travel of the wiping web 104 to be parallel to the direction of movement of the inkjet head 32.

Further, the wiping web 104 is normally pressed against the nozzle surface 33 in such a manner that the widthwise center of the wiping web 104 is disposed at the widthwise center of the nozzle surface 33, but if there is divergence between the centers of the wiping web 104 and the nozzle surface 33 in the widthwise direction, the installation position of the wiping unit 100 within the horizontal plane is finely adjusted by the horizontal position adjustment mechanism 88 so as to correct the horizontal position in such a manner that the centers are aligned in the widthwise direction.

Furthermore, for example, if the pressing roller 120 is inclined with respect to the nozzle surface 33, then the inclination of the wiping unit 100 with respect to the horizontal plane is finely adjusted by the inclination adjustment mechanism 90 so as to adjust the inclination in such a manner that the pressing roller 120 is parallel to the nozzle surface 33.

The above-described corrections can be automatically carried out in the inkjet recording apparatus according to the present embodiment, by judging on the basis of the wiping results. This point is described in detail below.

The wiping device 80 has the composition described above. The operation of the wiping device 80 is controlled by means of the controller, which controls the whole of the inkjet recording apparatus 10. The controller executes a prescribed control program so as to control the wiping operation by controlling the driving of the wiping units 100, the height adjustment mechanisms 84, the horizontal rotation adjustment mechanisms 86, the horizontal position adjustment mechanisms 88, the inclination adjustment mechanisms 90, and the wiping device main body elevator mechanisms 92. Furthermore, settings are automatically corrected by executing a prescribed control program.

<Image Recording Method>

Next, an image recording method using the inkjet recording apparatus 10 according to the present embodiment is described.

Firstly, as a preparation prior to image recording, the head supporting frame 34 is moved to the image recording position. Thereby, the inkjet heads 32 are set over the paper conveyance mechanism 20, and image recording becomes possible.

The paper P is supplied to the paper conveyance mechanism 20 by a paper supply mechanism (not shown). According to requirements, a prescribed pre-treatment (for example, deposition of a prescribed treatment liquid, or the like) to the paper P can be carried out.

The paper conveyance mechanism 20 receives the paper P supplied by the paper supply mechanism and horizontally conveys the paper P.

The inkjet heads 32 form an image on the surface of the paper P by ejecting and depositing ink droplets onto the paper P that is conveyed by the paper conveyance mechanism 20.

The paper P on which the image has been formed is recovered by a recovery mechanism (not shown). According to requirements, processing such as drying, fixing, or the like, to the paper P can be carried out.

By continuously supplying paper P, an image recording process is continuously carried out.

<Nozzle Surface Cleaning Method>

Next, a method of cleaning the nozzle surface is described.

In the above-described inkjet recording apparatus according to the present embodiment, the nozzle surfaces 33 are cleaned by using the movement of the inkjet heads 32 while the head supporting frame 34 is moving from the maintenance position to the image recording position.

Firstly, the controller drives the wiping device main body elevator mechanisms 92 to move the wiping device main body frames 82, which are situated in the standby positions, to the operating positions. Thereby, the wiping units 100 are situated in the prescribed wiping positions.

Next, the controller causes the head supporting frame 34 that is situated in the maintenance position to move toward the image recording position at a uniform speed.

Thereupon, the controller opens the cleaning liquid valve 72 and also drives the cleaning liquid pump 70 in accordance with the timing at which the front ends of the inkjet heads 32 (here, the ends of the image recording position side) arrive at the cleaning liquid nozzles 64. Thereby, the cleaning liquid is sprayed from the cleaning liquid nozzles 64. When the inkjet heads 32 pass over the cleaning liquid nozzles 64 from which the cleaning liquid is being sprayed, the cleaning liquid sprayed from the cleaning liquid nozzles 64 makes contact with the nozzle surfaces 33 and the cleaning liquid is deposited onto the nozzle surfaces 33 (i.e., the nozzle surfaces 33 are wetted).

Furthermore, the controller drives the take-up motors 118 in accordance with the timing at which the front ends of the inkjet heads 32 arrive at the wiping units 100. Thereby, the wiping webs 104 are taken up respectively onto the take-up spindles 116 and travel at a uniform speed. In this case, the wiping webs 104 travel in the opposite direction to the direction of movement of the inkjet heads 32. As the inkjet heads 32 pass over the wiping units 100, the wiping webs 104 are pressed against the nozzle surfaces 33 and the nozzle surfaces 33 are wiped.

The controller then halts the driving of the cleaning liquid pump 70 and closes the cleaning liquid valve 72, in accordance with the timing at which the rear ends of the inkjet heads 32 (here, the ends of the maintenance position side) pass the cleaning liquid nozzles 64. Thereby, the spraying of the cleaning liquid is halted.

Furthermore, the controller halts the driving of the take-up motors 118 in accordance with the timing at which the rear ends of the inkjet heads 32 pass the wiping units 100. Thereby, the travel of the wiping webs 104 is halted.

Thereafter, the controller drives the wiping device main body elevator mechanism 92 to lower the wiping device main body frame 82 and move same to the withdrawn position.

By means of the foregoing, the cleaning of the nozzle surfaces is completed. After the cleaning liquid has been deposited on the nozzle surfaces 33 of the inkjet heads 32, the traveling wiping webs 104 are pressed against the nozzle surfaces 33 so as to wipe same, thereby removing dirt adhering to the nozzle surfaces 33.

<Method of Correcting Settings>

As described above, the wiping unit 100 is installed on the wiping unit installation section 94, which is arranged on the wiping device main body frame 82.

The wiping device main body frame 82 is provided with the respective adjustment mechanisms, namely, the height adjustment mechanism 84, the horizontal rotation adjustment mechanism 86, the horizontal position adjustment mechanism 88 and the inclination adjustment mechanism 90, whereby it is possible to carry out adjustment of the installation height in the vertical direction, adjustment of the rotational angle within the horizontal plane, adjustment of the position within the horizontal plane, and adjustment of the inclination with respect to the horizontal plane.

The adjustment mechanisms each have adjustment reference points (points of origin). In each of the adjustment mechanisms in the standard state, the stage is situated at the adjustment reference point (point of origin). For example, the elevator stage 84A of the height adjustment mechanism 84 in the standard state is situated at the point of origin of the elevator stage that is a prescribed height position from the base 84B. The rotatable stage 86A of the horizontal rotation adjustment mechanism 86 in the standard state is situated at the point of origin of the rotatable stage that is a prescribed rotational position with respect to the base 86B, where a prescribed rotation indicator set on the rotatable stage 86A is situated at a rotation reference point set on the base 86B. The slidable stage 88A of the horizontal position adjustment mechanism 88 in the standard state is situated at the point of origin of the slidable stage that is a prescribed position with respect to the base 88B, where a prescribed slide movement indicator set on the slidable stage 88A (e.g., the center of the slidable stage 88A) is situated at a slide movement reference point set on the base 86B (e.g., the center of the base 88B). The swingable stage 90A of the inclination adjustment mechanism 90 in the standard state is situated at the point of origin of the swingable stage, where the swingable stage 90A is horizontal.

When the wiping unit 100 is installed on the wiping unit installation section 94 with the respective adjustment mechanisms set to the standard state, the wiping unit 100 is in principle installed so as to be able to adequately wipe the nozzle surface 33 of the inkjet head 32. More specifically, the wiping unit 100 is installed in such a manner that, when the wiping device main body frame 82 is moved to the operating position, the wiping web 104 wrapped about the pressing roller 120 is pressed against the nozzle surface 33 of the inkjet head 32. Furthermore, the wiping unit 100 is installed in such a manner that when the wiping web 104 is caused to travel, the wiping web 104 travels in parallel with the direction of travel of the inkjet head 32. Consequently, if the wiping operation is carried out in this state, then in principle, it is possible to adequately perform the wiping.

However, if the wiping unit 100 has not been correctly installed, if the wiping web 104 has not been accurately installed, or if there is error in the actual manufacture of the wiping unit 100 or the wiping device 80, or the like, then it is not possible to adequately perform the wiping.

Therefore, in the inkjet recording apparatus 10 according to the present embodiment, it is judged whether or not the settings of the wiping unit 100 are appropriate by observing the state of the wiping web 104 that has been used in the wiping operation of the nozzle surface 33.

The judgment of the appropriateness of the settings is made by determining the standard state of soiling (the standard state of ink permeation) of the wiping web 104 when the settings are correctly made in advance, and then comparing the observed state of soiling of the wiping web 104 having been used in the wiping operation with the standard state of soiling. More specifically, if any of the settings is inappropriate, the soiled state of the wiping web 104 changes, and therefore the appropriateness of the settings (including the success or failure of wiping) can be judged by comparing the observed soiled state of the wiping web 104 with the standard soiled state of the wiping web 104 when the settings are appropriate.

A method of judging the appropriateness of the settings of the wiping operation on the basis of the soiled state of the wiping web 104 having been used in the wiping operation, and a method of correcting the settings of the wiping operation, are described below.

Figure 9:
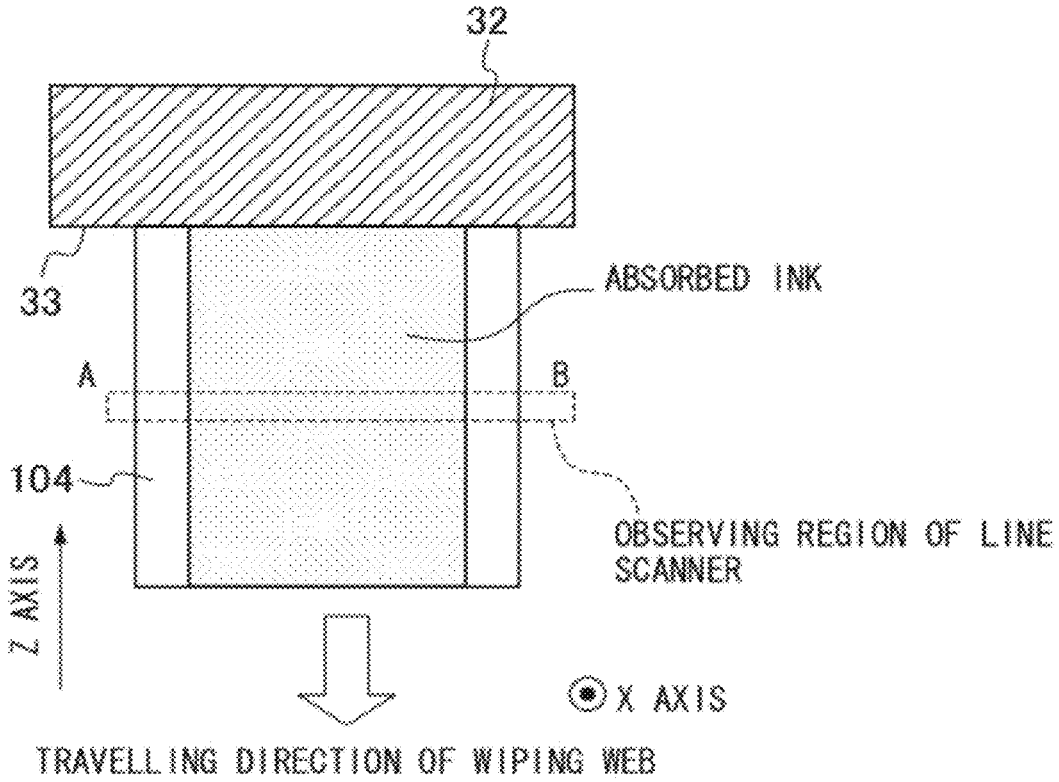
FIG. 9 is a schematic view of a soiled state of a wiping web having been used in a wiping operation in a case where the settings of the wiping operation are appropriate.

FIG. 9 is a schematic view of the state of soiling (the state of ink permeation) of the wiping web 104 having been used in the wiping operation of which the settings are appropriate. As shown in FIG. 9, when the settings of the wiping operation are appropriate, the wiping web 104 is pressed against the nozzle surface 33 at a correct position (i.e., the widthwise center of the wiping web 104 abuts the widthwise center of the portion where the nozzle rows are formed in the nozzle surface) with an appropriate pressing force. In this case, the wiping web 104 having been used in the wiping operation is soiled (permeated with the ink) with a prescribed density distribution substantially symmetric in the widthwise direction of the wiping web 104.

In the inkjet recording apparatus 10 according to the present embodiment, the soiled state of the wiping web 104 having been used in the wiping operation can be observed by means of the line scanner 126. More specifically, the reflectance of the wiping web 104 can be obtained on the basis of the image of the wiping web 104 captured through the line scanner 126, and the obtained reflectance of the wiping web 104 can be regarded as reciprocally representing the density of soiling on the wiping web 104. Then, the image information of the wiping web 104 captured through the line scanner 126 is output to the controller, and the controller processes the obtained image information and generates information about the soiled density distribution on the wiping web 104. In other words, in the present embodiment, the soiled density distribution on the wiping web 104 is observed as the soiled state of the wiping web 104, and the appropriateness of the settings is judged on the basis of the observed soiled density distribution on the wiping web 104.

Figure 10:
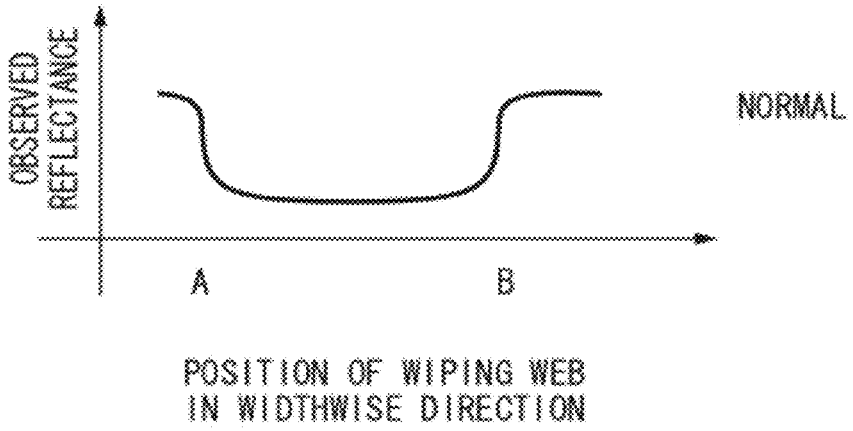
FIG. 10 is a graph showing an example of a reflectance distribution on the wiping web having been used in the wiping operation in the case where the settings of the wiping operation are appropriate.

FIG. 10 is a graph showing an example of the reflectance distribution on the wiping web 104, which is observed through the line scanner 126 and regarded as reciprocally representing the soiled density distribution on the wiping web 104, in a case where the settings of the wiping operation are appropriate. When the settings of the wiping operation are appropriate, the soiled density distribution appears in substantial symmetry in the widthwise direction of the wiping web 104, with a prescribed density difference.

The controller holds the information about the soiled density distribution when the settings of the wiping operation are appropriate, as the standard information, and thereafter judges the appropriateness of the settings in each wiping operation by comparing the observed density distribution with the standard information.

Figure 11:
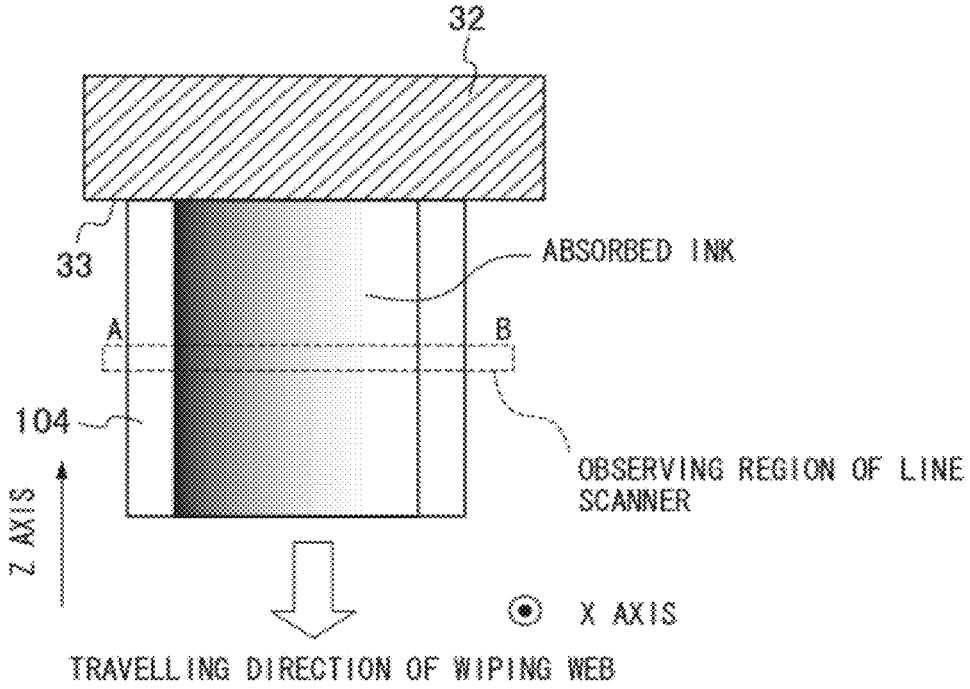
FIG. 11 is a schematic view of a soiled state of a wiping web having been used in a wiping operation in a case where a pressing roller is inclined with respect to a nozzle surface.
Figure 12:
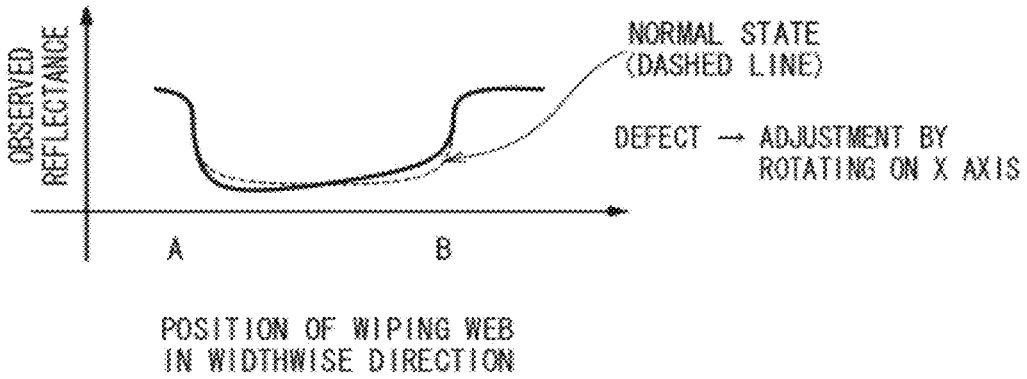
FIG. 12 is a graph showing an example of a reflectance distribution on the wiping web having been used in the wiping operation in the case where the pressing roller is inclined with respect to the nozzle surface.

FIG. 11 is a schematic view of a soiled state of the wiping web 104 when the pressing roller 120 is not parallel to the nozzle surface 33, and FIG. 12 is a graph showing an example of the reflectance distribution on the wiping web 104, which is observed through the line scanner 126 and regarded as reciprocally representing the soiled density distribution on the wiping web 104, in this case. As shown in FIGS. 11 and 12, when the pressing roller 120 is not parallel to the nozzle surface 33, the wiping web 104 is pressed against the nozzle surface 33 with a pressure gradient along the widthwise direction, and thereby the wiping web 104 used in the wiping operation is soiled with a density gradient along the widthwise direction.

The controller generates information about the density distribution on the wiping web 104 having been used in the wiping operation observed through the line scanner 126, and then compares the observed density distribution with the standard density distribution so as to detect a density gradient exceeding a prescribed threshold (i.e., to judge whether the pressing roller 120 is parallel to the nozzle surface 33). If it is judged that there is the density gradient exceeding the prescribed threshold, then it is judged that the pressing roller 120 has been pressed against the nozzle surface 33 in an inclined fashion (i.e., the pressing roller 120 has not been parallel to the nozzle surface 33).

In this case, the controller corrects the attitude of the pressing roller 120 so as to correct the inclination, in accordance with the amount of divergence from the standard state. More specifically, the amount of inclination of the wiping unit 100 with respect to the horizontal plane is adjusted and the attitude of the pressing roller 120 is corrected by means of the inclination adjustment mechanism 90.

Figure 13:
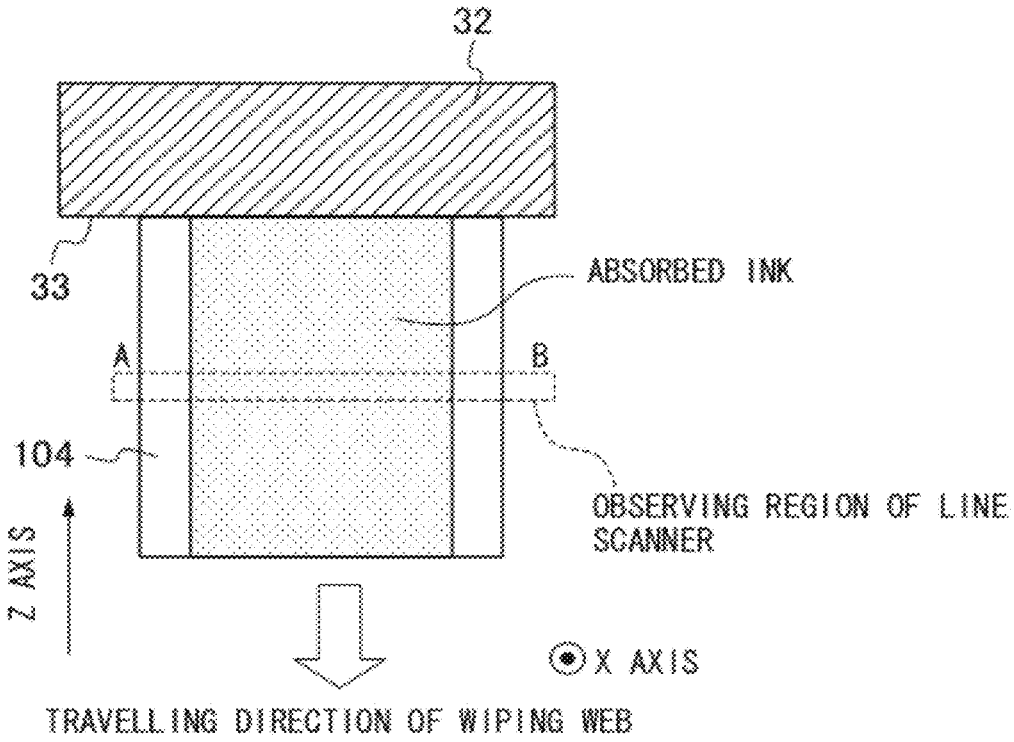
FIG. 13 is a schematic view of a soiled state of a wiping web having been used in a wiping operation in a case where a pressing force of the wiping web is insufficient.
Figure 14:
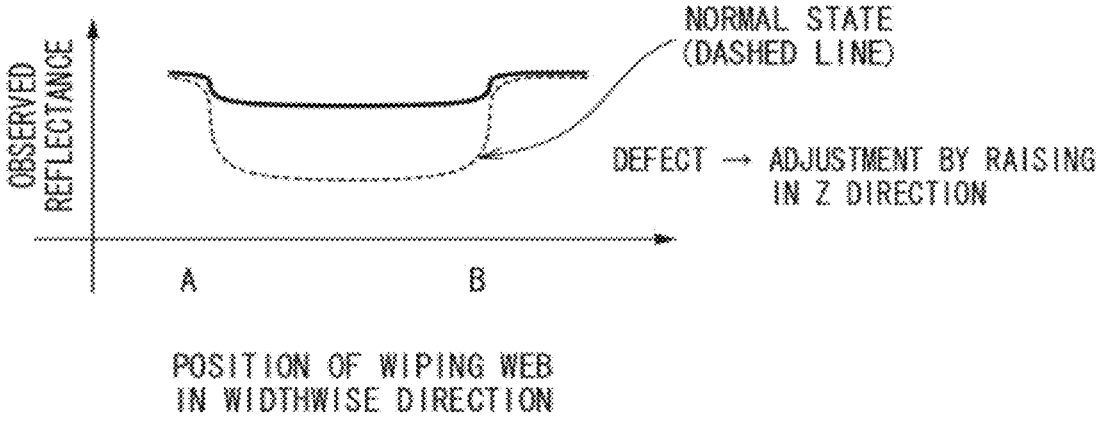
FIG. 14 is a graph showing an example of a reflectance distribution on the wiping web having been used in the wiping operation in the case where the pressing force of the wiping web is insufficient.

FIG. 13 is a schematic view of a soiled state of the wiping web 104 when the wiping web 104 is pressed against the nozzle surface 33 with insufficient pressing force, and FIG. 14 is a graph showing an example of the reflectance distribution on the wiping web 104 in this case. As shown in FIGS. 13 and 14, when the pressing force of the wiping web 104 is insufficient, the wiping web 104 used in the wiping operation is soiled with the small density difference between the central portion and each end portion in the widthwise direction.

The controller generates information about the density distribution on the wiping web 104 having been used in the wiping operation obtained through the line scanner 126, and determines the difference between the density of the central portion and the density of each of the end portions in the widthwise direction. The observed density difference is then compared with the density difference in the standard density distribution, and if the observed density difference is smaller than the standard density difference, then it is judged that the pressing force of the wiping web 104 has been insufficient.

In this case, the controller corrects the pressing force of the pressing roller 120 so as to correct the insufficient pressing force in accordance with the differential with respect to the density difference of the standard density distribution. More specifically, the height position of the wiping unit 100 is adjusted (in this case, raised) by means of the height adjustment mechanism 84, thereby correcting the pressing force of the pressing roller 120. In this case, it is also possible to perform correction by adjusting the height position of the inkjet head.

Figure 15:
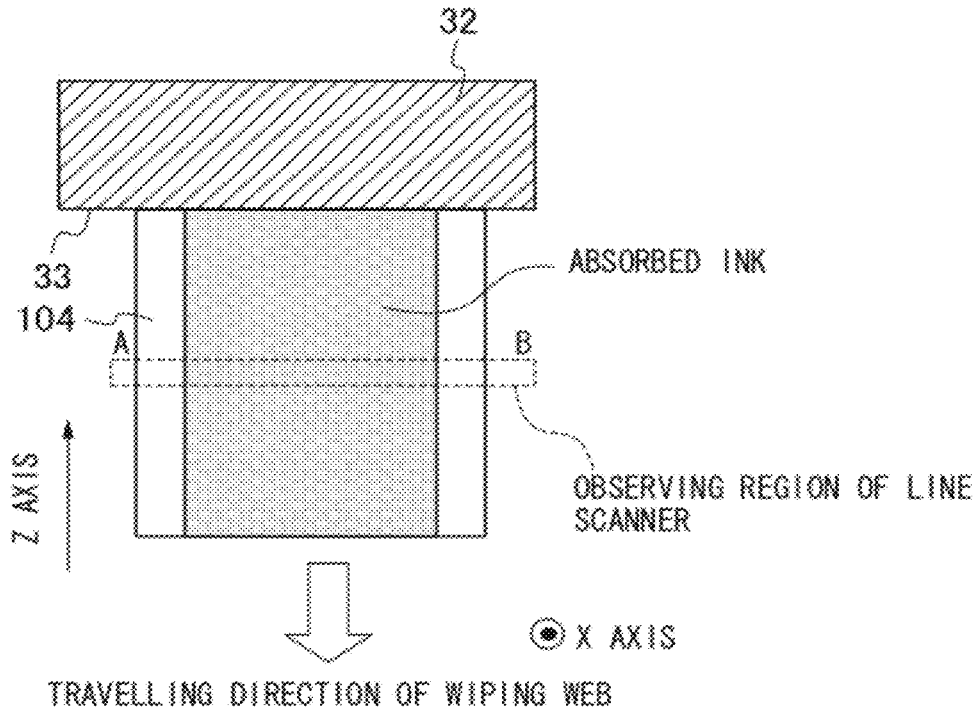
FIG. 15 is a schematic view of a soiled state of a wiping web having been used in a wiping operation in a case where a pressing force of the wiping web is excessive.
Figure 16:
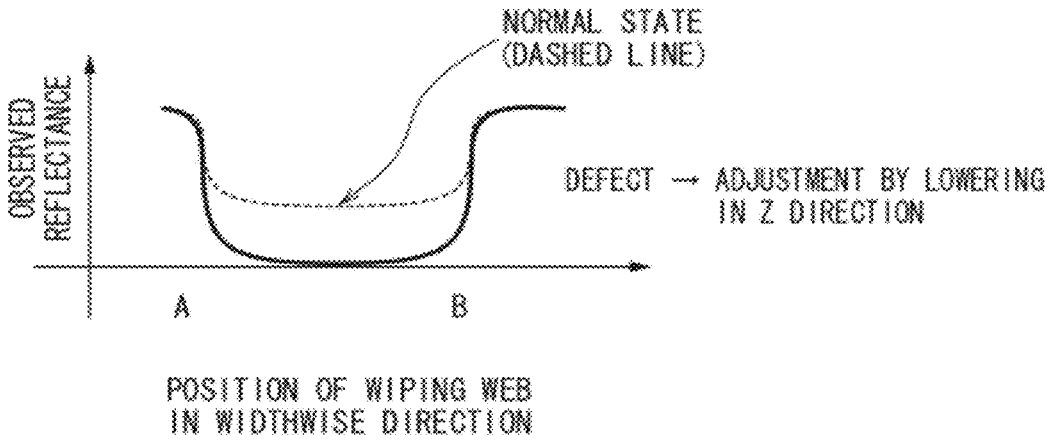
FIG. 16 is a graph showing an example of a reflectance distribution on the wiping web having been used in the wiping operation in the case where the pressing force of the wiping web is excessive.

FIG. 15 is a schematic view of a soiled state of the wiping web 104 when the wiping web 104 is pressed against the nozzle surface 33 with excessive pressing force, and FIG. 16 is a graph showing an example of the reflectance distribution on the wiping web 104 in this case. As shown in FIGS. 15 and 16, when the pressing force on the wiping web 104 is excessive, the wiping web 104 used in the wiping operation is soiled with the large density difference between the central portion and each end portion in the widthwise direction.

The controller generates information about the density distribution on the wiping web 104 having been used in the wiping operation obtained through the line scanner 126, and determines the difference between the density of the central portion and the density of each of the end portions in the widthwise direction. The observed density difference is then compared with the density difference in the standard density distribution, and if the observed density difference is larger than the standard density difference, then it is judged that the pressing force of the wiping web 104 has been excessive.

In this case, the controller corrects the pressing force of the pressing roller 120 so as to correct the excessive pressing force in accordance with the differential with respect to the density difference of the standard density distribution. More specifically, the height position of the wiping unit 100 is adjusted (in this case, lowered) by means of the height adjustment mechanism 84, thereby correcting the pressing force of the pressing roller 120. In this case, it is also possible to perform correction by adjusting the height position of the inkjet head.

Figure 17:
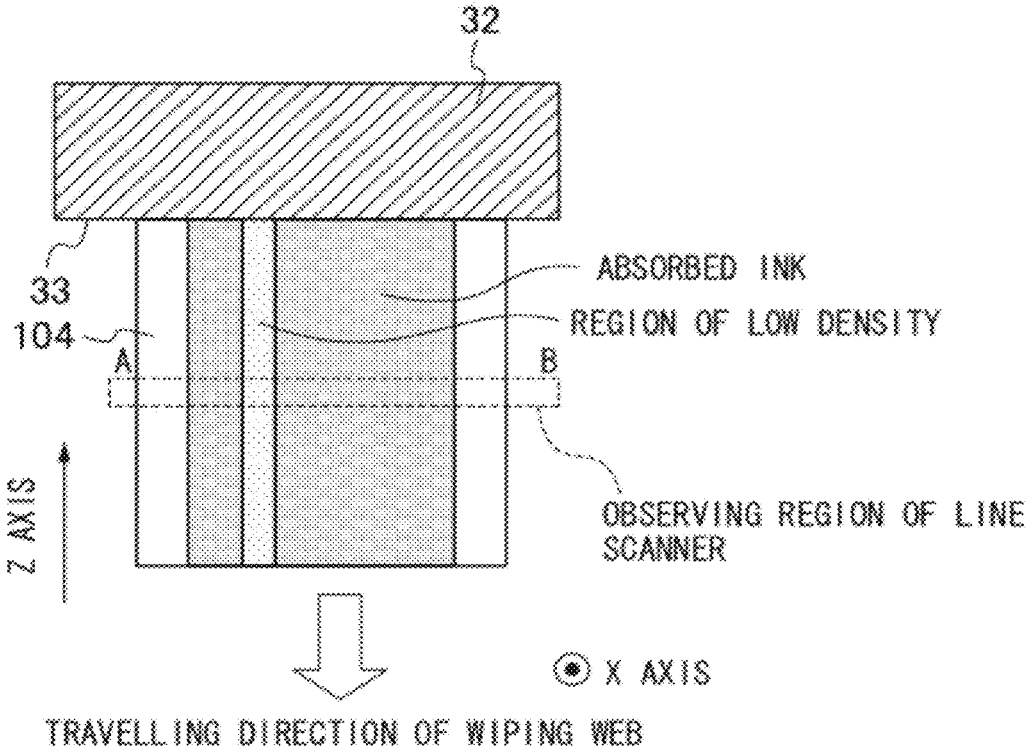
FIG. 17 is a schematic view of a soiled state of a wiping web having been used in a wiping operation in a case where a kink has occurred in the wiping web.
Figure 18:
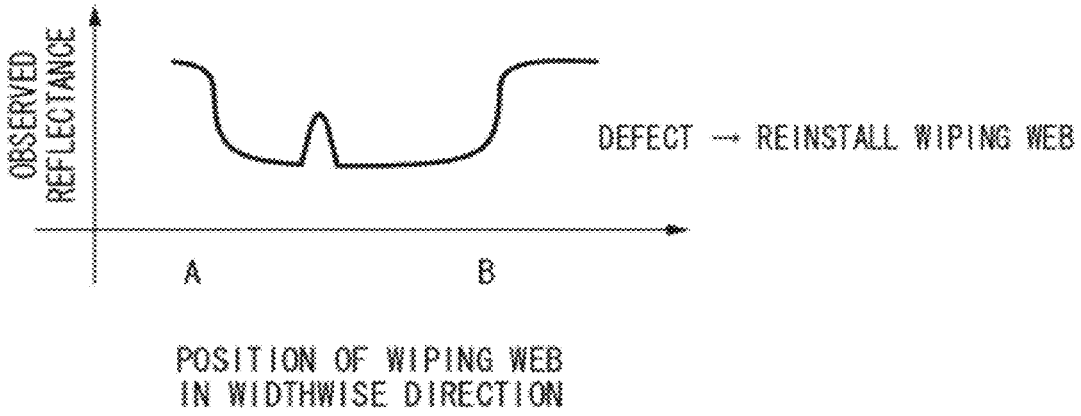
FIG. 18 is a graph showing an example of a reflectance distribution on the wiping web having been used in the wiping operation in the case where the kink has occurred in the wiping web.

FIG. 17 is a schematic view of a soiled state of the wiping web 104 when a kink occurs in the wiping web 104, and FIG. 18 is a graph showing an example of the reflectance distribution on the wiping web 104 in this case. As shown in FIGS. 17 and 18, when the kink occurs in the wiping web 104, the wiping web 104 used in the wiping operation is soiled with the density distribution having a density dropping region at which the density is lower than either side in the widthwise direction.

The controller generates information about the density distribution on the wiping web 104 having been used in the wiping operation obtained through the line scanner 126, and determines whether there is a density dropping region. If it is judged that there is the density dropping region in the density distribution, then it is judged that a kink has occurred in the wiping web 104.

In this case, the controller issues an alarm or prompts rewinding of the wiping web 104, or the like, for example. Alternatively, the tension (stretching force) of the wiping web 104 is adjusted.

Figure 19:
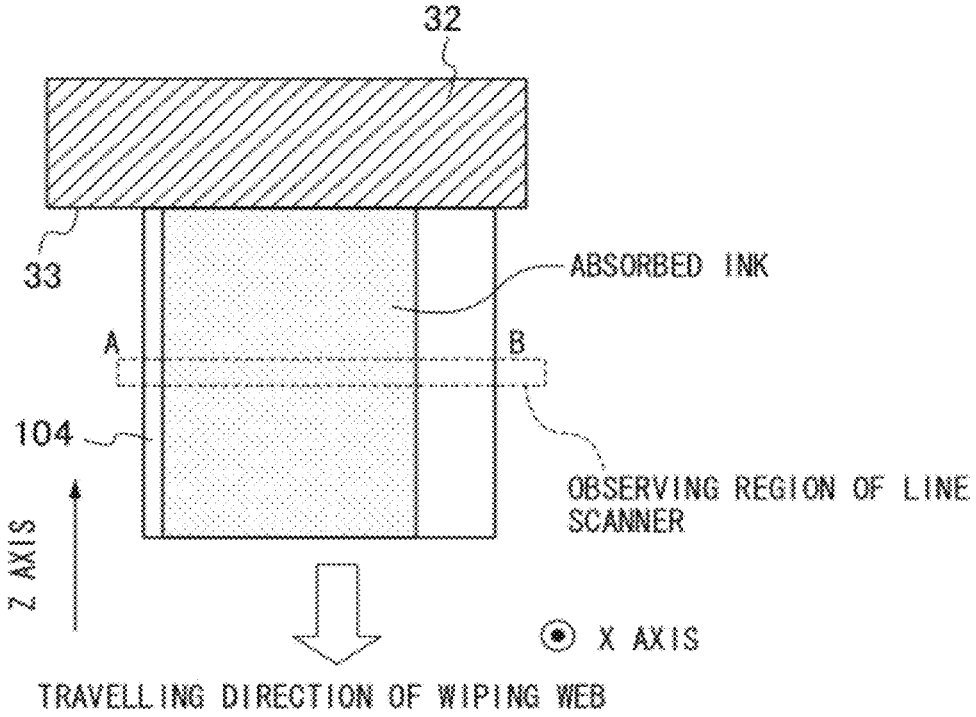
FIG. 19 is a schematic view of a soiled state of a wiping web having been used in a wiping operation in a case where an abutment position of the wiping web is displaced.
Figure 20:
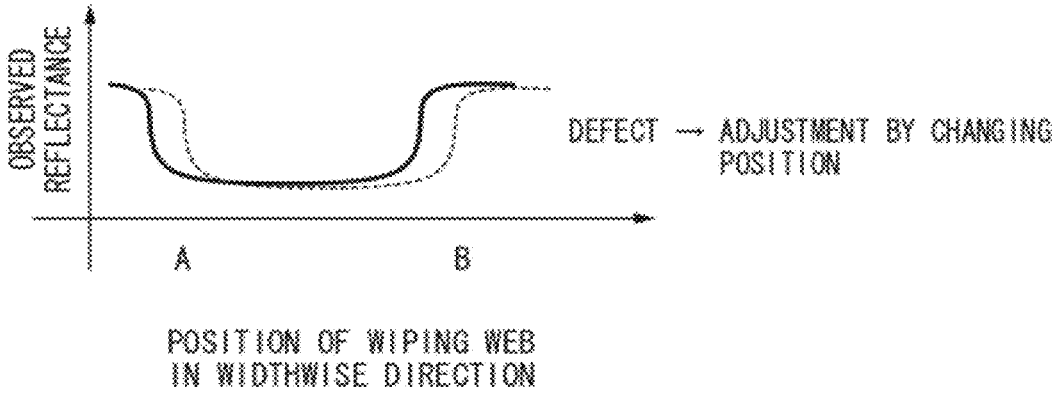
FIG. 20 is a graph showing an example of a reflectance distribution on the wiping web having been used in the wiping operation in the case where the abutment position of the wiping web is displaced.

FIG. 19 is a schematic view of a soiled state of the wiping web 104 having been used in the wiping operation when the abutment position of the wiping web 104 is displaced, and FIG. 20 is a graph showing an example of the reflectance distribution on the wiping web 104 in this case. As shown in FIGS. 19 and 20, when the center of the wiping web 104 does not coincide with the center of the nozzle surface 33, then a lateral displacement in the density distribution appears.

The controller generates information about the density distribution on the wiping web 104 having been used in the wiping operation obtained through the line scanner 126, and then compares the observed density distribution with the standard density distribution so as to detect a positional displacement (i.e., to judge whether there is a displacement in the position where the density distribution appears). If the positional displacement is detected, then it is judged that a displacement has occurred in the abutment position of the wiping web 104.

In this case, the controller corrects the abutment position of the wiping web 104 so as to correct the displacement, in accordance with the amount of detected displacement. More specifically, the position within the horizontal plane of the wiping unit 100 is adjusted by means of the horizontal position adjustment mechanism 88, thereby correcting the abutting position of the wiping web 104 with respect to the nozzle surface 33.

Thus, by observing the soiled state of the wiping web 104 having been used in the wiping operation, it is possible to judge the appropriateness of the settings of the wiping operation, and it is also possible to identify each inappropriate setting upon occurrence. By this means, it is possible to readily correct the settings of the wiping operation.

The settings of which the appropriateness can be judged on the basis of the soiled state of the wiping web 104 having been used in the wiping operation are not limited to the foregoing, and the appropriateness of other settings of the wiping operation can also be investigated.

Figure 21:
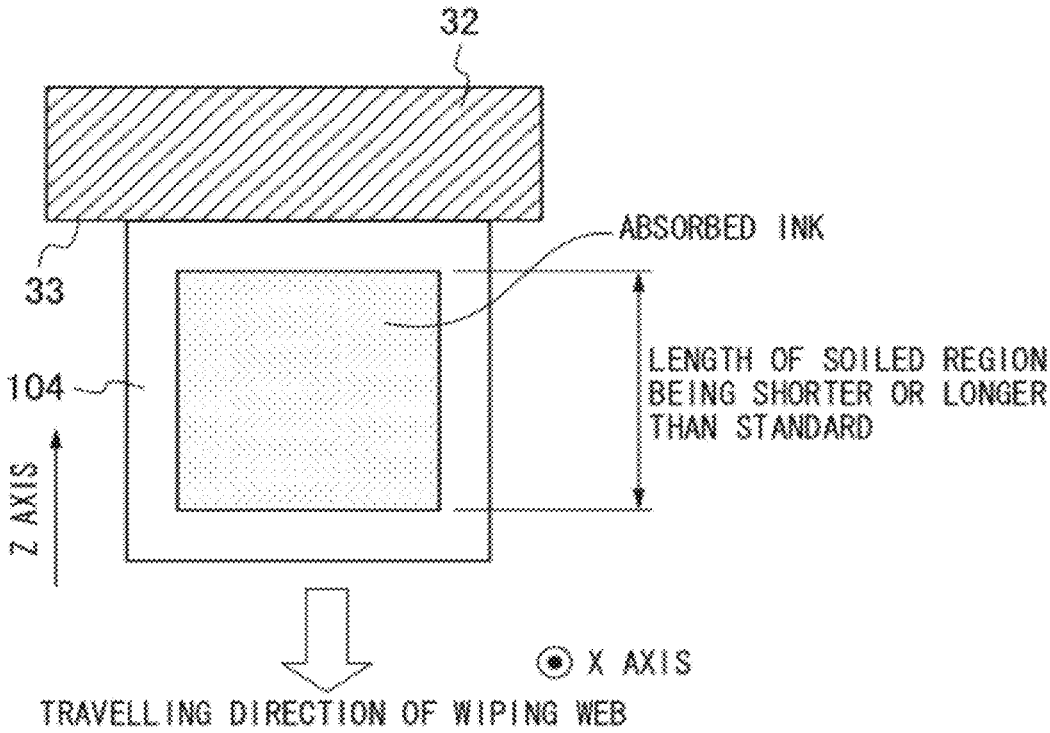
FIG. 21 is a schematic view of a soiled state of a wiping web having been used in a wiping operation in a case where a speed of travel of the wiping web is inappropriate.

For example, as shown in FIG. 21, by observing the length of the soiling region in the traveling direction of the wiping web 104 and comparing with a standard state, it is possible to judge the appropriateness of the traveling speed (conveyance amount) of the wiping web 104 in the wiping operation. More specifically, if the traveling speed of the wiping web 104 is inappropriate, then the length of the soiling region is longer or shorter than the standard state, and therefore it is possible to judge the appropriateness of the traveling speed of the wiping web 104 by observing the length of the soiling region in the wiping web 104.

If it is judged that the traveling speed of the wiping web 104 has been inappropriate, then the traveling speed of the wiping web 104 is corrected (for example, the rotational speed of the take-up motor 118 is corrected) in accordance with the amount of deviation from the standard state. Since the traveling speed of the wiping web 104 is taken relatively with respect to the nozzle surface 33, then it is also possible to perform correction of the traveling speed of the wiping web 104 by adjusting the movement speed of the inkjet head 32.

Further, when the wiping web 104 wipes the nozzle surface 33 of the inkjet nozzle 32 in which the nozzle meniscus position is inappropriately set, the wiping web 104 used in the wiping operation is soiled with a smaller or larger density difference, in comparison with the standard state, between the central portion and each end portion in the widthwise direction. Hence, it is possible to judge the appropriateness of the nozzle meniscus position in the wiping operation by determining this density difference. If it is judged that the nozzle meniscus position has been inappropriate, then the nozzle meniscus position is adjusted on the inkjet head 33 (for example, the back pressure is adjusted, or the like).

Furthermore, if the nozzle surface 33 is wetted before the wiping operation, as in the inkjet recording apparatus 10 in the present embodiment, when the amount of wetting is insufficient or excessive, the wiping web 104 used in the wiping operation is soiled with the density distribution where the density at the end portions in the widthwise direction is different than the standard state. Hence, it is possible to judge the appropriateness of the amount of wetting of the nozzle surface 33 in the wiping operation by observing the soiled density of the end portions of the wiping member 104 in the widthwise direction thereof. If the amount of wetting is insufficient or excessive, then this is corrected by raising or lowering the amount of wetting. In the present embodiment, this correction is made by raising or lowering the amount of cleaning liquid sprayed.

Thus, an image of the wiping web 104 having been used in the wiping operation is captured, and by analyzing the captured image, it is possible to judge the appropriateness of the respective settings of the wiping operation. Then, the settings of the wiping operation can be corrected on the basis of the judgment results.

It is possible to carry out the judgment and correction in real time (constantly during wiping) or after a cleaning operation has been completed.

Figure 22:
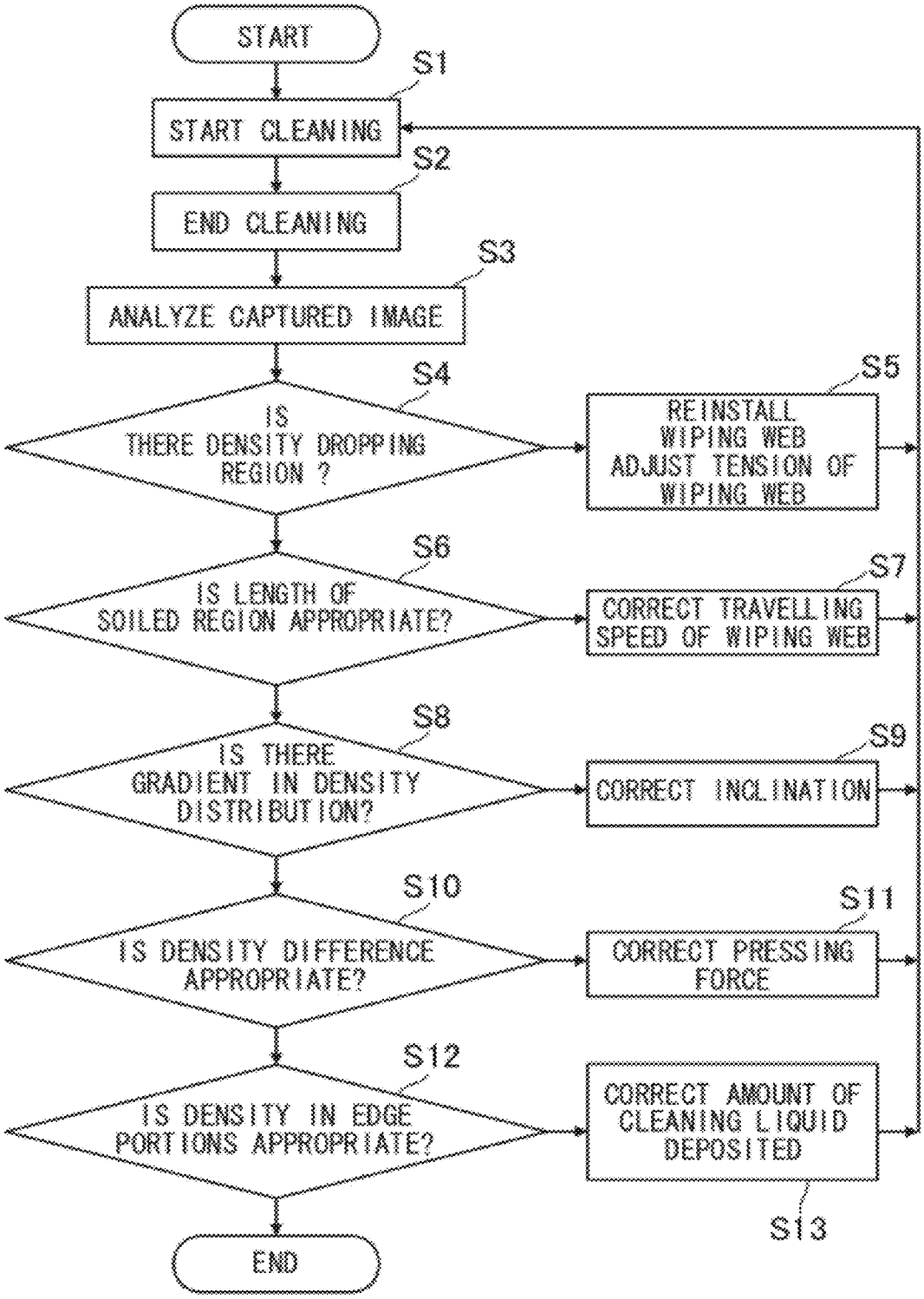
FIG. 22 is a flowchart showing a procedure for judging and correcting the appropriateness of settings of the wiping operation after the cleaning has been completed.

FIG. 22 is a flowchart showing a procedure for judging and correcting the appropriateness of settings of the wiping operation after a cleaning operation has been completed.

When the cleaning operation is started (step S1) and then ended (step S2), the image of the wiping web 104 captured through the line scanner 126 is analyzed (step S3) so as to judge whether or not the settings are appropriate.

Firstly, it is judged whether or not there is a density dropping region or a region of lower density in the obtained density distribution (step S4). If the density dropping region is detected in the density distribution, it is inferable that there is a kink in the wiping web 104, and then the wiping web 104 is reinstalled or the tension of the wiping web 104 is corrected, for instance (step S5). Thereafter, the cleaning operation is carried out again.

If it is judged in step S4 that there is no density dropping region in the density distribution, then it is judged whether the length of the soiling region in the wiping web 104 is appropriate (step S6). If the length of the soiling region is longer or shorter than the standard state, it is inferable that the travelling speed of the wiping web 104 is inappropriate, and then the travelling speed of the wiping web 104 is corrected (step S7). Thereafter, the cleaning operation is carried out again.

If it is judged in step S6 that the length of the soling region is appropriate, then it is judged whether there is a density gradient in the density distribution (step S8). If there is a density gradient in the density distribution, it is inferable that there is a pressure gradient in the wiping web 104 since the pressing roller 120 is inclined with respect to the nozzle surface 33, and then the attitude of the pressing roller 120 is corrected (step S9). Thereafter, the cleaning operation is carried out again.

If it is judged in step S8 that there is no gradient in the density distribution, then it is judged whether the density difference in the density distribution is appropriate (step S10). If the density difference is larger or smaller than the standard state, it is inferable that the pressing force of the wiping web 104 with respect to the nozzle surface 33 is insufficient or excessive, and then the pressing force is corrected (step S11). Thereafter, the cleaning operation is carried out again.

If it is judged in step S10 that the density difference in the density distribution is appropriate, then it is judged whether the density at the end portions in the widthwise direction of the wiping web 104 is appropriate (step S12). If the density of the end portions is inappropriate, it is inferable that the amount of the cleaning liquid deposited on the nozzle surface 33 is excessive or insufficient, and then the deposited amount of the cleaning liquid is adjusted (step S13). Thereafter, the cleaning operation is carried out again.

If it is judged in step S12 that the density at the end portions is appropriate, then it is regarded that the cleaning operation has been carried out under the appropriate settings, and the processing is terminated.

Thus, by observing the state of the wiping web 104 having been used in the wiping operation and judging the appropriateness of the settings of the wiping operation, the cleaning operation is carried out after performing appropriate correction. Therefore, it is possible to appropriately clean the nozzle surface 33.

The procedure described above is an example, and the items carried out, and their order of implementation, and the like, can be altered as appropriate. However, it is desirable to first judge whether the wiping web 104 has a kink, since the kink induces wiping traces and the like.

The correction based on the observed results can be automatically performed while automatically determining the amount of correction, or can be manually performed by an operator. Since the correction of each item (apart from when the wiping web 104 is to be reinstalled) can be automatically carried out, then it is possible to automatically carry out the judgment and correction (in the case of a kink, an alarm, or the like, is issued, for example).

As described above, the judgment on the appropriateness of the settings is made by comparison with the standard state (the soiled state of the wiping web when the settings are appropriate). In order to achieve more accurate judgment, it is desirable to change the judgment standards in accordance with the use duration of the inkjet head 32 and the number of printing processes carried out by means of the inkjet head 32, since the mode of soiling of the nozzle surface 33 changes with the use duration of the inkjet head 32 and the number of printing processes carried out, and the soiled state of the wiping web 104 having been used in the wiping operation also accordingly changes.

For example, the tolerable range in which each setting is regarded as appropriate is changed in accordance with the use duration of the inkjet head 32 and the number of print sheets which have been printed by means of the inkjet head 32. Thereby, it is possible to judge the appropriateness of the settings even more accurately.

Moreover, since the soiled state of the wiping web 104 can vary with the color or type of ink, then in this case, it is desirable that the judgment standards are set for each type of ink ejected by the inkjet head.

Figure 23:
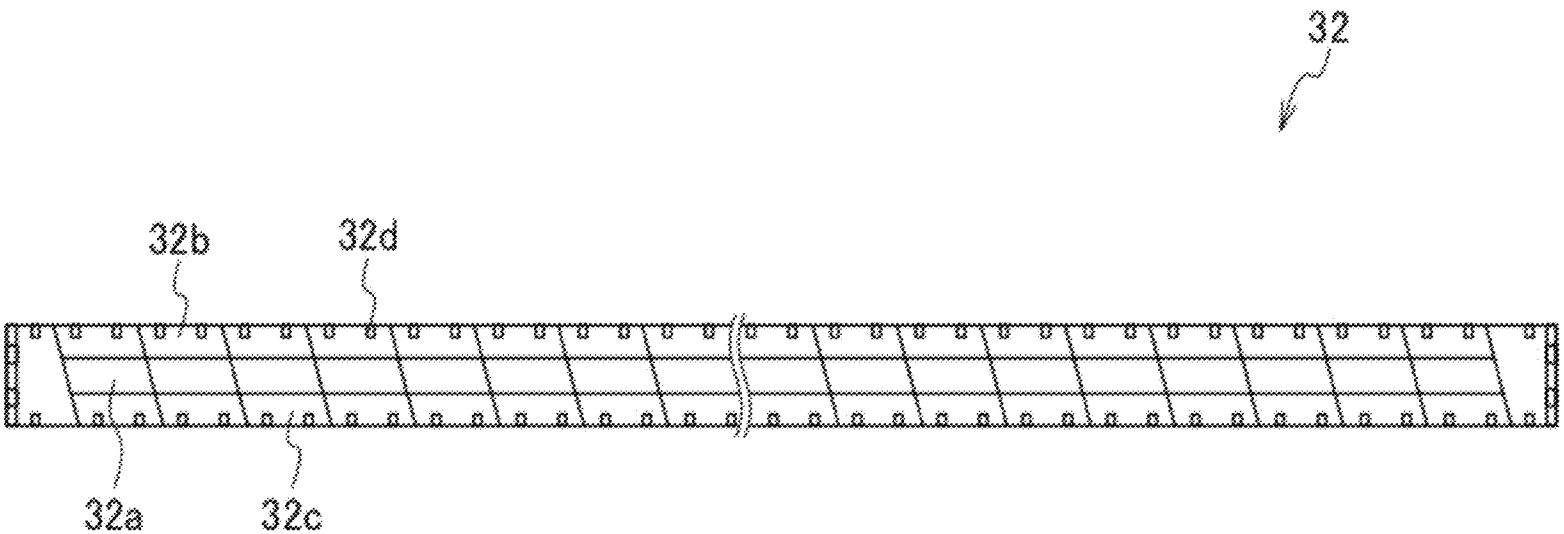
FIG. 23 is a diagram showing a bottom face of an inkjet head constituted of a plurality of head modules.
Figure 24:
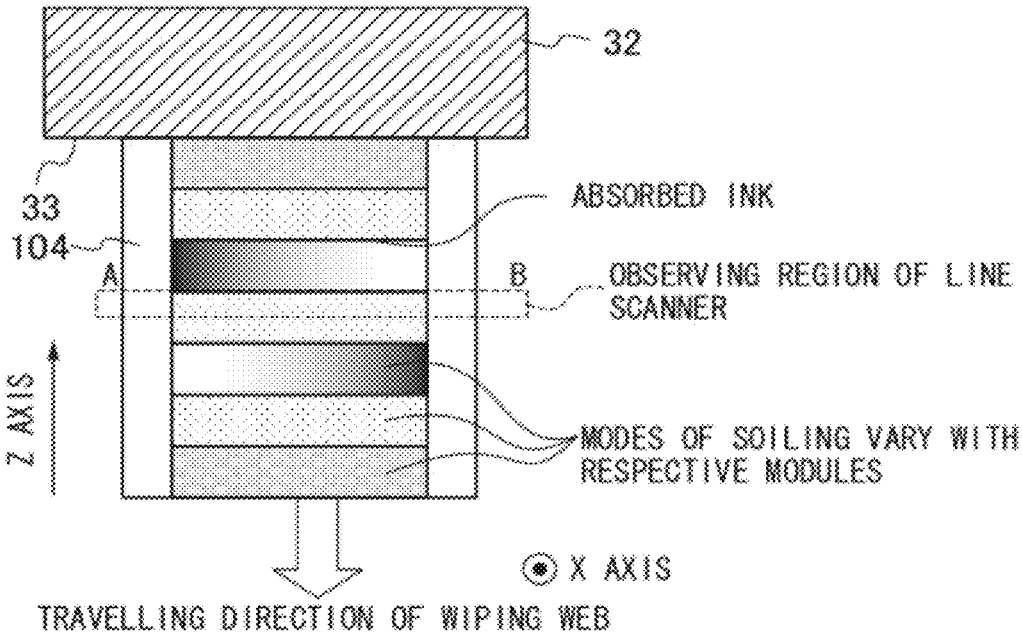
FIG. 24 is a schematic view of a soiled state of a wiping web having been used in a wiping operation in a case where the inkjet head is constituted of the plurality of head modules and the setting of the wiping operation is inappropriate.

Furthermore, in a case where the inkjet head 32 is constituted of a plurality of head modules 32*a*, 32*b*, 32*c*, 32*d*, . . . , which are joined together as shown in FIG. 23, for example, the mode of soiling of the wiping web 104 can change for the respective head modules as shown in FIG. 24.

When wiping the inkjet head 32 that is thus composed by joining together the head modules 32*a*, 32*b*, 32*c*, 32*d*, . . . , it is desirable that the settings of the wiping operation are corrected by judging the appropriateness of the settings for each head module, from the soiled state of the wiping web 104 having been used in the wiping operation. For example, the position, height, inclination, and so on, of the wiping unit 100 are adjusted so as to correct the settings, each time the head module being wiped is switched.

Figure 25:
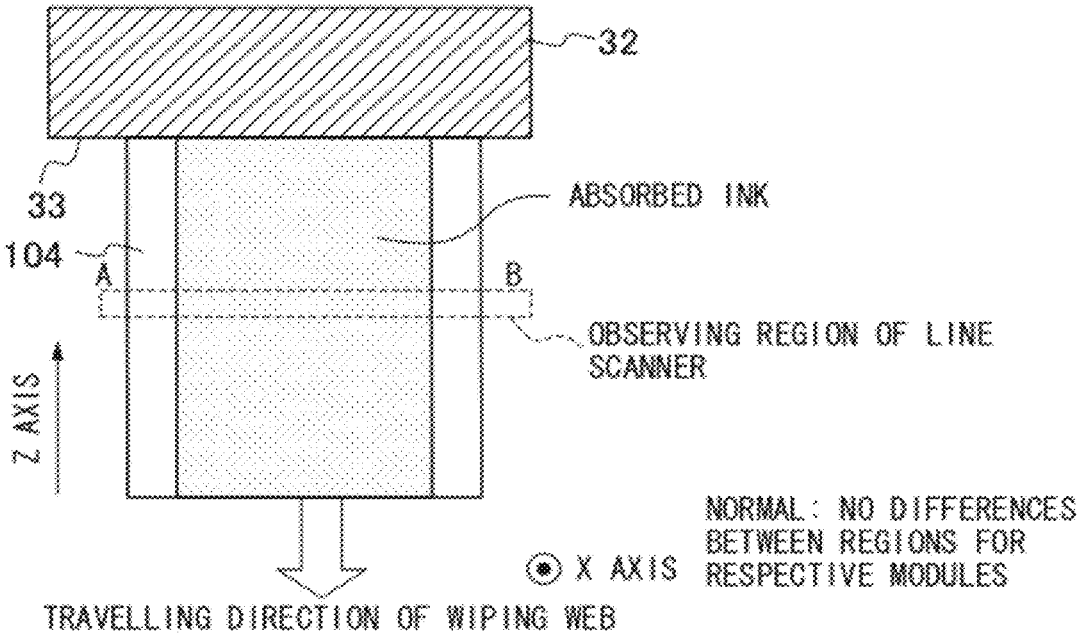
FIG. 25 is a schematic view of a soiled state of a wiping web having been used in a wiping operation in a case where the inkjet head is constituted of the plurality of head modules and the setting of the wiping operation is appropriate.

When the adjustment has been performed for each head module, the soiled state of the wiping web 104 is obtained in which the switching of the head modules is virtually indistinguishable (a virtually uniform soiled state of the wiping web 104 in the lengthwise direction) as shown in FIG. 25, for example.

In the present embodiment, the nozzle surface 33 is wiped by pressing the wiping web 104 against the nozzle surface 33 of the moving inkjet head 32, while causing the wiping web 104 to travel; however, it is also possible to wipe the nozzle surface 33 by pressing the wiping web 104 against the moving inkjet head 32 with the wiping web 104 in a stationary state. In this case also, if the settings of the wiping operation are inappropriate, then the soiled state of the wiping web 104 used in the wiping operation is different to that obtained when the settings are appropriate, and therefore it is possible to judge the appropriateness of the settings of the wiping operation by observing the soiled state of the wiping web 104 having been used in the wiping operation.

Moreover, in the present embodiment, the composition is adopted in which the nozzle surface 33 is wiped with the wiping web 104 formed in the shape of the band; however, the wiping member that wipes the nozzle surface 33 is not limited to this, and can have any composition that absorbs soiling (ink, and the like). For instance, the wiping member can have a composition that wipes the nozzle surface 33 with a sponge or a porous roller, or the like. Even with wiping members having these compositions, it is possible to judge the appropriateness of settings of the wiping operation on the basis of the state of absorption of the soiling on the wiping members having been used in the wiping operation.

Second Embodiment

Figure 26:
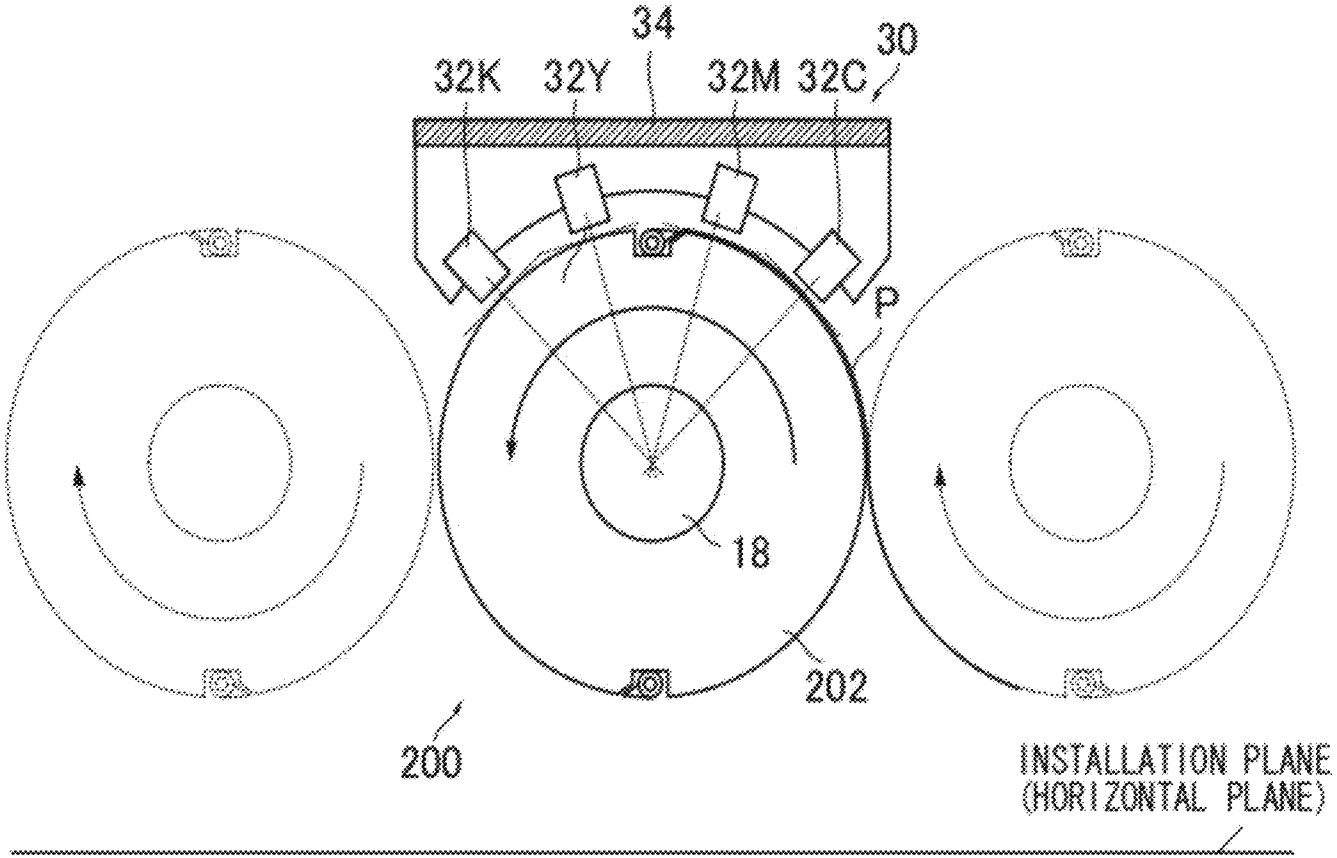
FIG. 26 is a side view diagram showing the general composition of an inkjet recording apparatus according to a second embodiment of the present invention.

FIG. 26 is a side view diagram showing a composition of the principal part of an inkjet recording apparatus according to a second embodiment of the present invention.

As shown in FIG. 26, in the inkjet recording apparatus in the present embodiment, a paper conveyance mechanism 200 is constituted of a drum conveyance mechanism. In the drum conveyance mechanism, the paper P is held by suction onto a circumferential surface of a drum 202, and the paper P is conveyed by causing the drum 202 to rotate.

In this case, the inkjet heads 32C, 32M, 32Y and 32K are arranged radially about the periphery of the drum 202. Then, the inkjet heads 32C, 32M, 32Y and 32K are arranged so that the nozzle surfaces 33C, 33M, 33Y and 33K are inclined from the horizontal plane.

Figure 27:
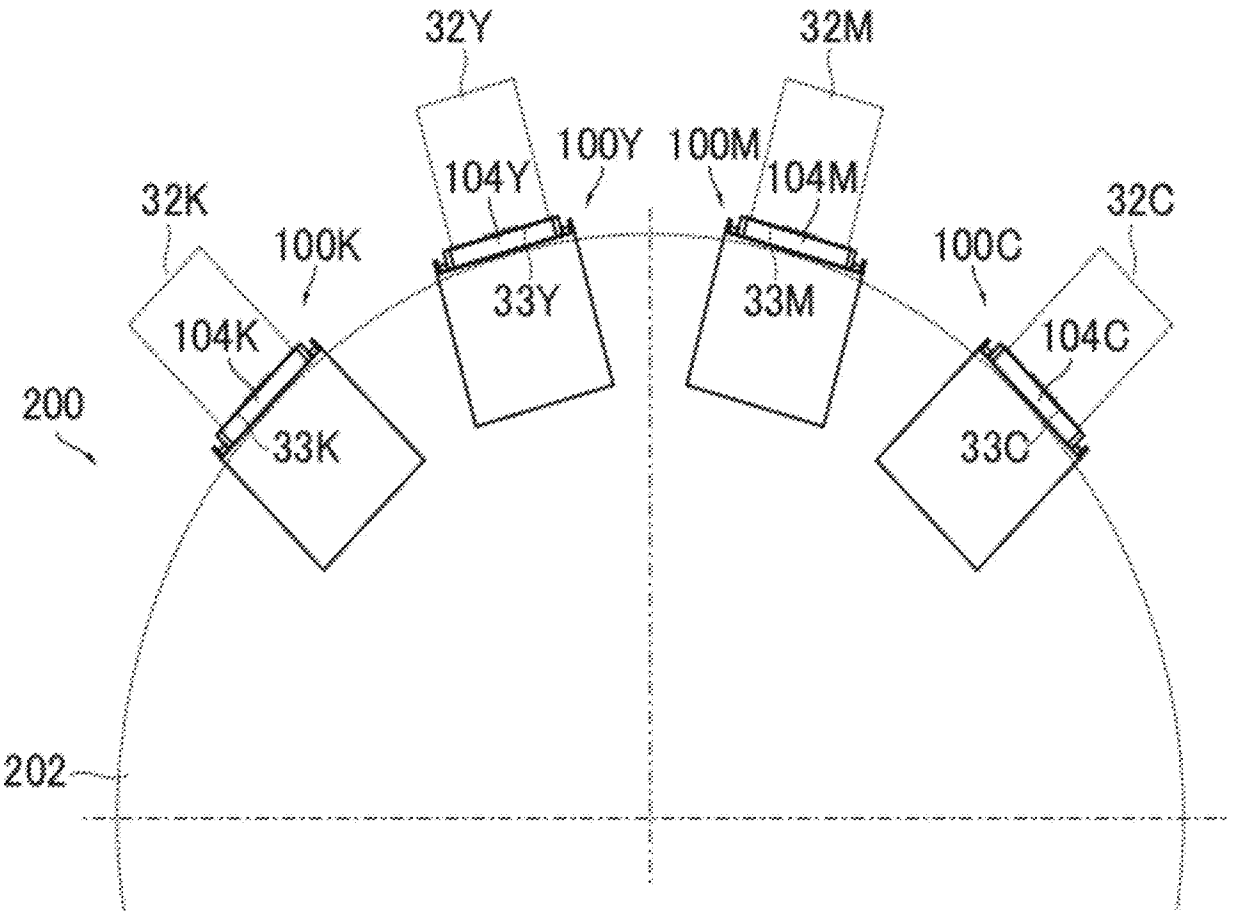
FIG. 27 is a side view diagram showing a schematic view of the composition of a wiping device.

Corresponding to the nozzle surfaces 33C, 33M, 33Y and 33K being arranged with the inclinations, the wiping units 100C, 100M, 100Y and 100K are also arranged with inclinations as shown in FIG. 27, and wipe the nozzle surfaces 33C, 33M, 33Y and 33K in the inclined state. Apart from the inclined arrangement of the wiping units 100, the basic composition of the wiping device is the same as the above-describe composition of the wiping device 80 in the first embodiment.

In the case where the nozzle surfaces 33 are arranged with the inclinations, the cleaning liquid deposited on each nozzle surface flows down in the direction of inclination, and when wiping is performed, the wiping web 104 shows a different mode of soiling for each inkjet head (a different mode of soiling depending on the amount of inclination).

Figure 28:
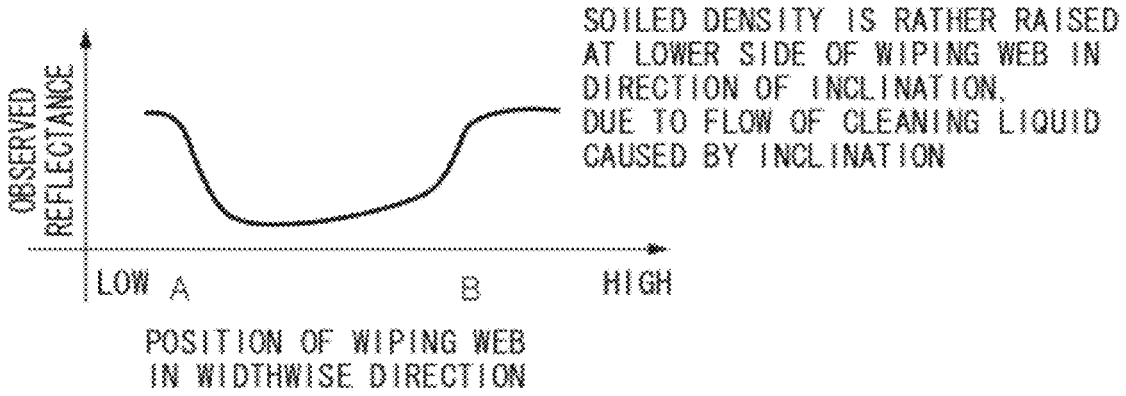
FIG. 28 is a graph showing a reflectance distribution on a wiping web having been used in a wiping operation of an inclined nozzle surface.

For example, as shown in FIG. 28, the observed reflectance of the wiping web 104 having been used in the wiping operation becomes lower toward the side A of the lower height, which means that the density of soling on the wiping web 104 becomes higher toward the side A, i.e., the wiping web 104 is soiled with a density distribution which is gradient to the side of lower height.

In this case, misjudgment would occur if the appropriateness of the settings of the wiping operation is judged on the basis of the same judgment standards as the horizontally arranged nozzle surfaces. Therefore, in the case of the inkjet recording apparatus in which the nozzle surfaces 33 are arranged with the inclinations, the judgment standards for the appropriateness of settings of the wiping operation are established for each inkjet head and the appropriateness of the settings is judged individually for each inkjet head.

Thus, it is possible to judge the appropriateness of the settings of the wiping operation more accurately, and cleaning can be carried out by setting the nozzle surface cleaning unit to an optimum state for each inkjet head.

Other Embodiments of the Wiping Device

In the case where the inkjet heads are arranged in the inclined state as described above, the wiping units which wipe the nozzle surfaces are also inclined. However, if the whole wiping devices are arranged with the inclinations, then there is a problem in that the required installation space is large and the apparatus becomes large in size. Hence, it is desirable that each wiping unit has a composition in which only the pressing roller is inclined.

Figure 29:
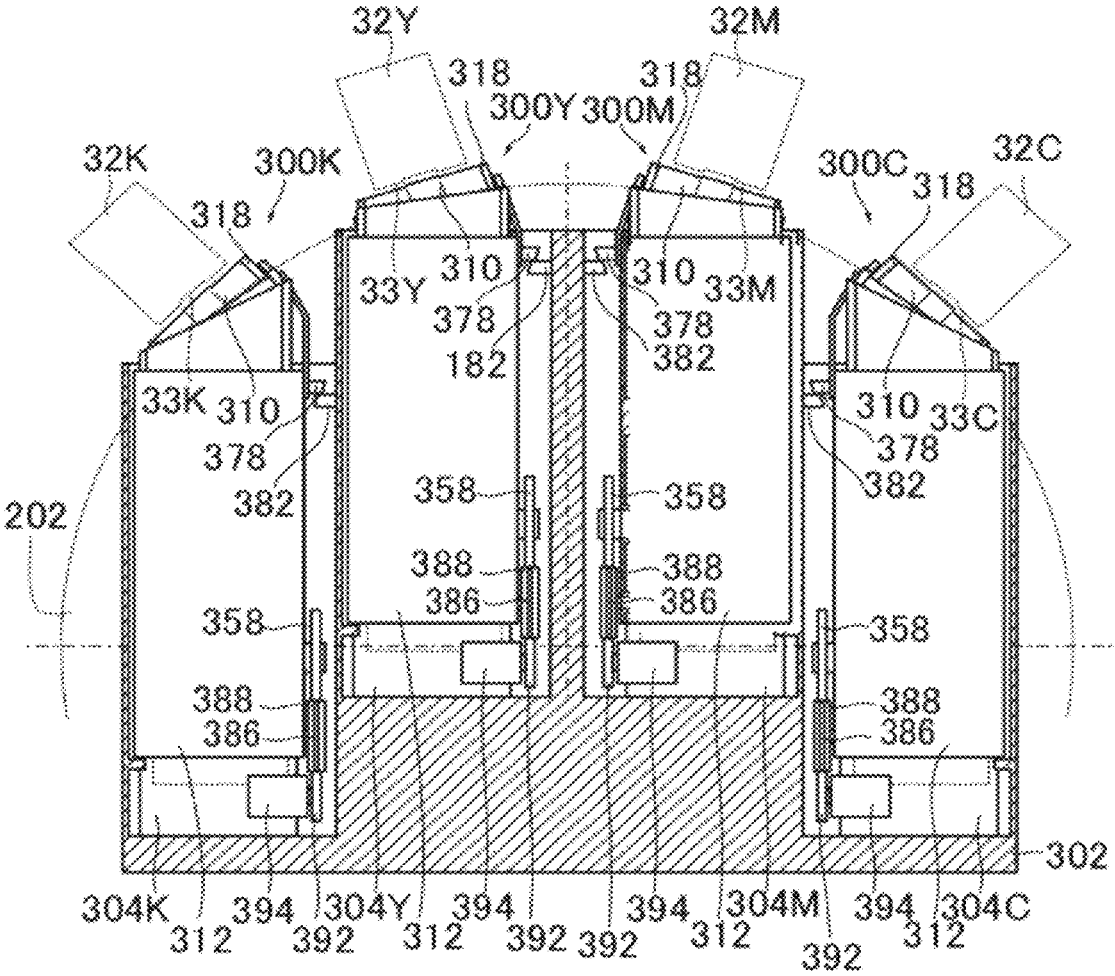
FIG. 29 is a side view diagram showing another mode of the wiping device.

FIG. 29 is a side view diagram showing a composition of a wiping device in which only a pressing roller of each wiping unit is inclined, viewed from the maintenance position side. As shown in FIG. 29, this wiping device includes: wiping units 300C, 300M, 300Y and 300K, which are arranged correspondingly to the respective inkjet heads 32C, 32M, 32Y and 32K; and a wiping device main body frame 302, in which the wiping units 300C, 300M, 300Y and 300K are set.

<Composition of Wiping Device Main Body Frame>

The wiping device main body frame 302 is horizontally disposed and is arranged so as to be raisable and lowerable by an elevator device (not shown). The wiping device main body frame 302 is formed in a box shape having an open upper end portion, and wiping unit installation sections 304C, 304M, 304Y and 304K for installing the wiping units 300C, 300M, 300Y and 300K are arranged inside the wiping device main body frame 302.

The wiping unit installation sections 304C, 304M, 304Y and 304K are respectively formed as spaces which can accommodate the wiping units 300C, 300M, 300Y and 300K, and the upper portions thereof are open. The wiping units 300C, 300M, 300Y and 300K are set in the respective wiping unit installation sections 304C, 304M, 304Y and 304K by being inserted vertically downward through the upper openings of the wiping unit installation sections 304C, 304M, 304Y and 304K.

A lock mechanism (not shown) is arranged on each of the wiping unit installation sections 304C, 304M, 304Y and 304K, in such a manner that the installed wiping units 300C, 300M, 300Y and 300K can be locked. The lock mechanisms are, for example, composed so as to automatically operate when the wiping units 300C, 300M, 300Y and 300K are inserted into the wiping unit installation sections 304C, 304M, 304Y and 304K.

<Composition of Wiping Unit>

The composition of the wiping units 300C, 300M, 300Y and 300K is described here.

The wiping units 300C, 300M, 300Y and 300K have the same basic composition described below, and are hereinafter referred also to as the wiping units 300. The wiping unit installation sections 304C, 304M, 304Y and 304K also have the same basic composition described below, and are hereinafter referred also to as the wiping unit installation sections 304.

Figure 30:
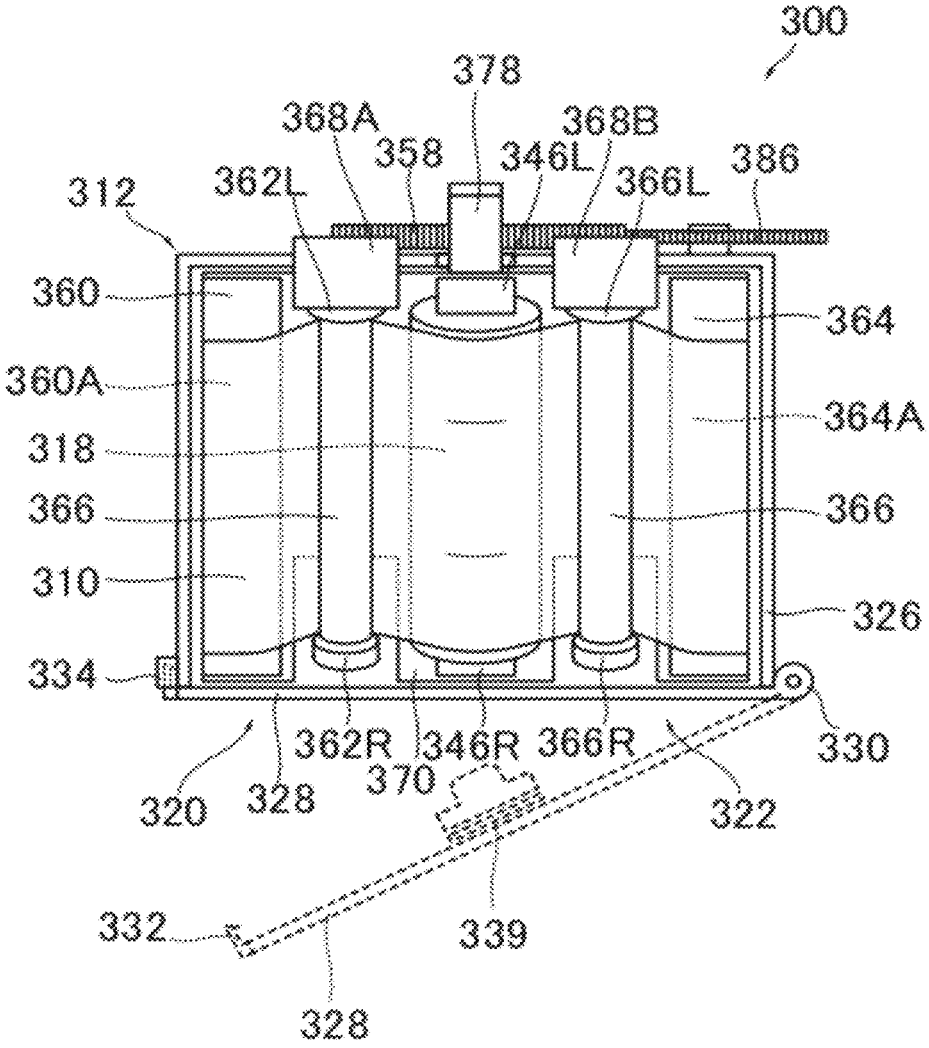
FIG. 30 is a plan view diagram of a wiping unit.
Figure 31:
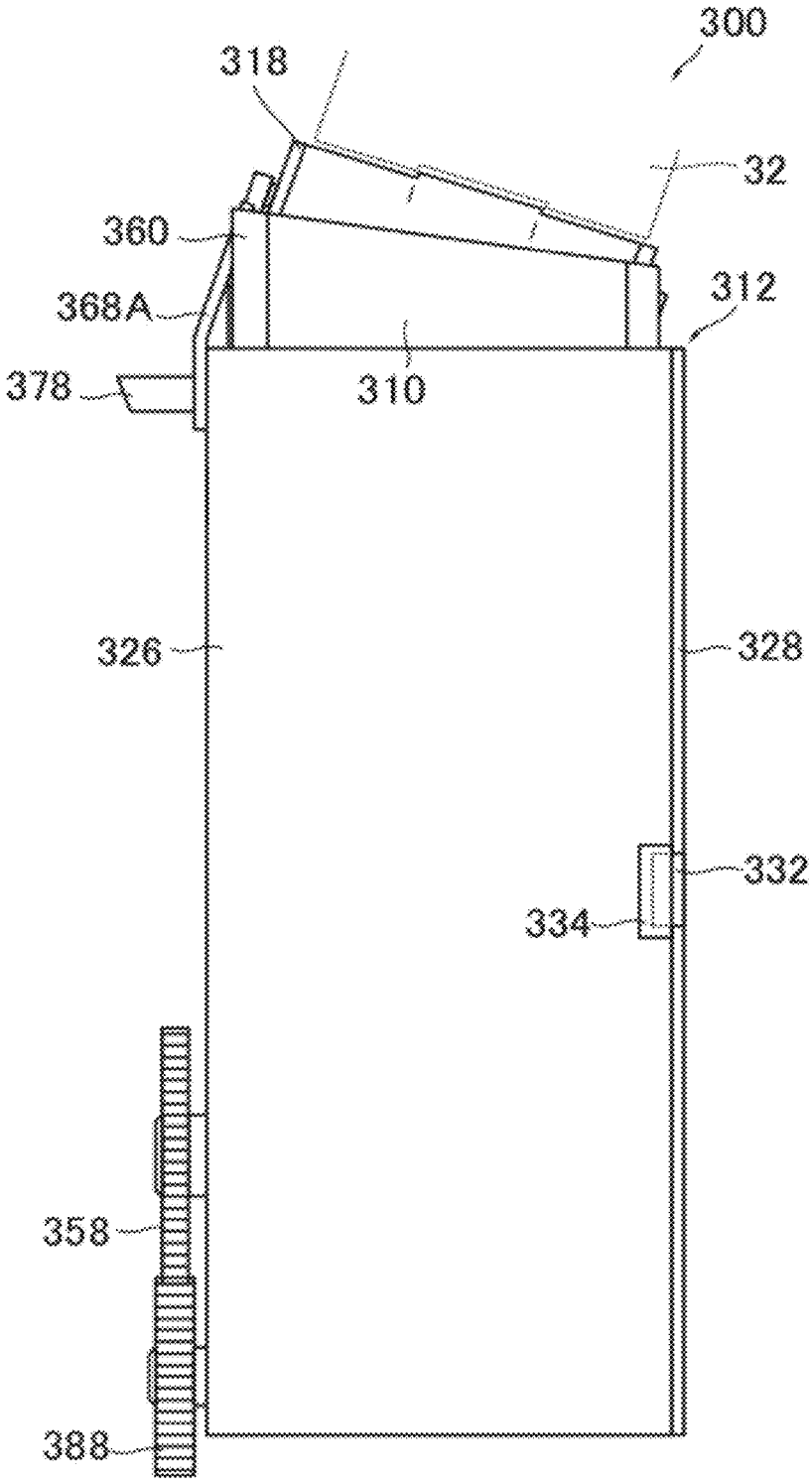
FIG. 31 is a side view diagram showing the wiping unit viewed from the image recording position side.
Figure 32:
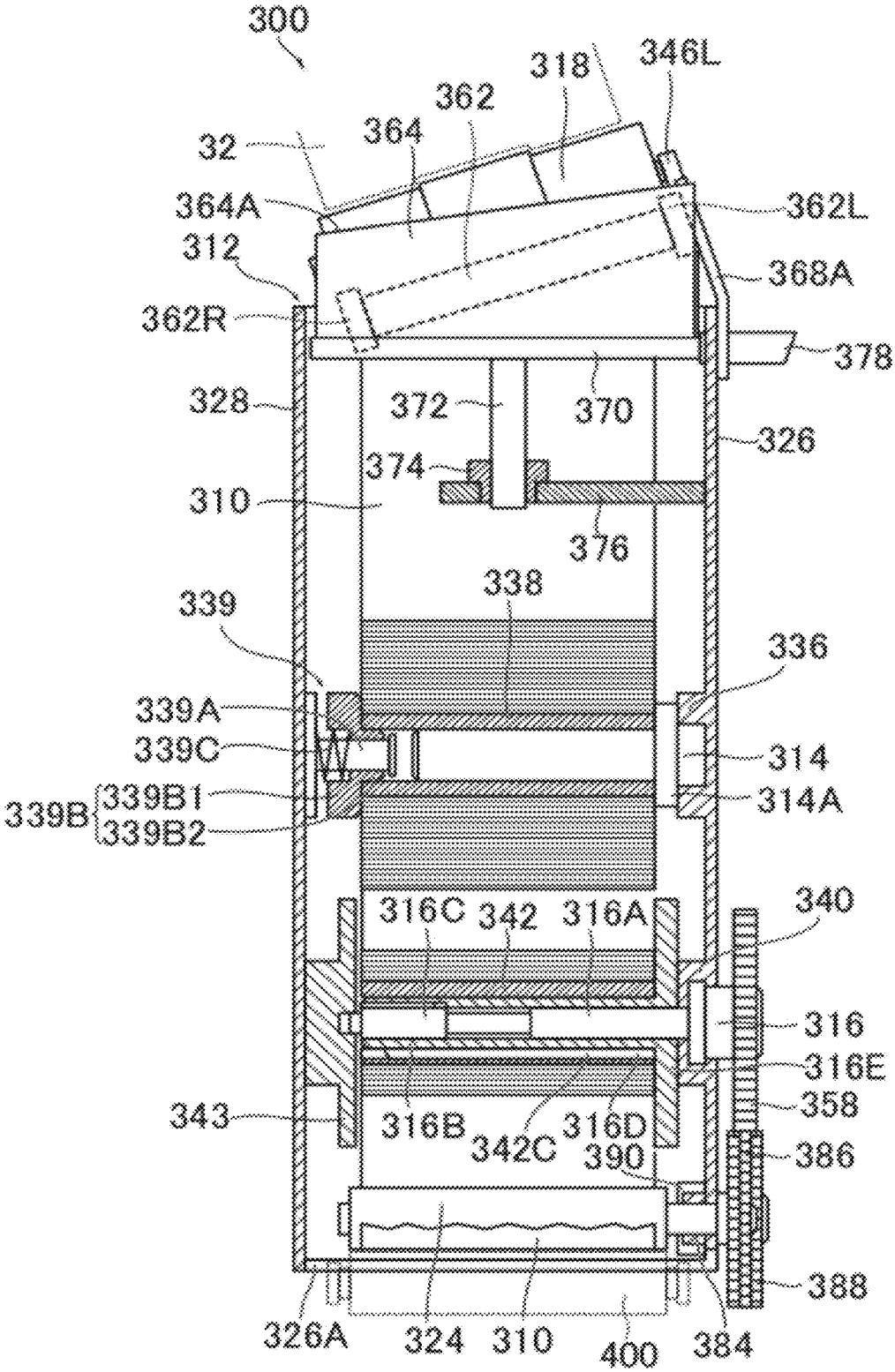
FIG. 32 is a partial cross-sectional side view diagram of the wiping unit.
Figure 33:
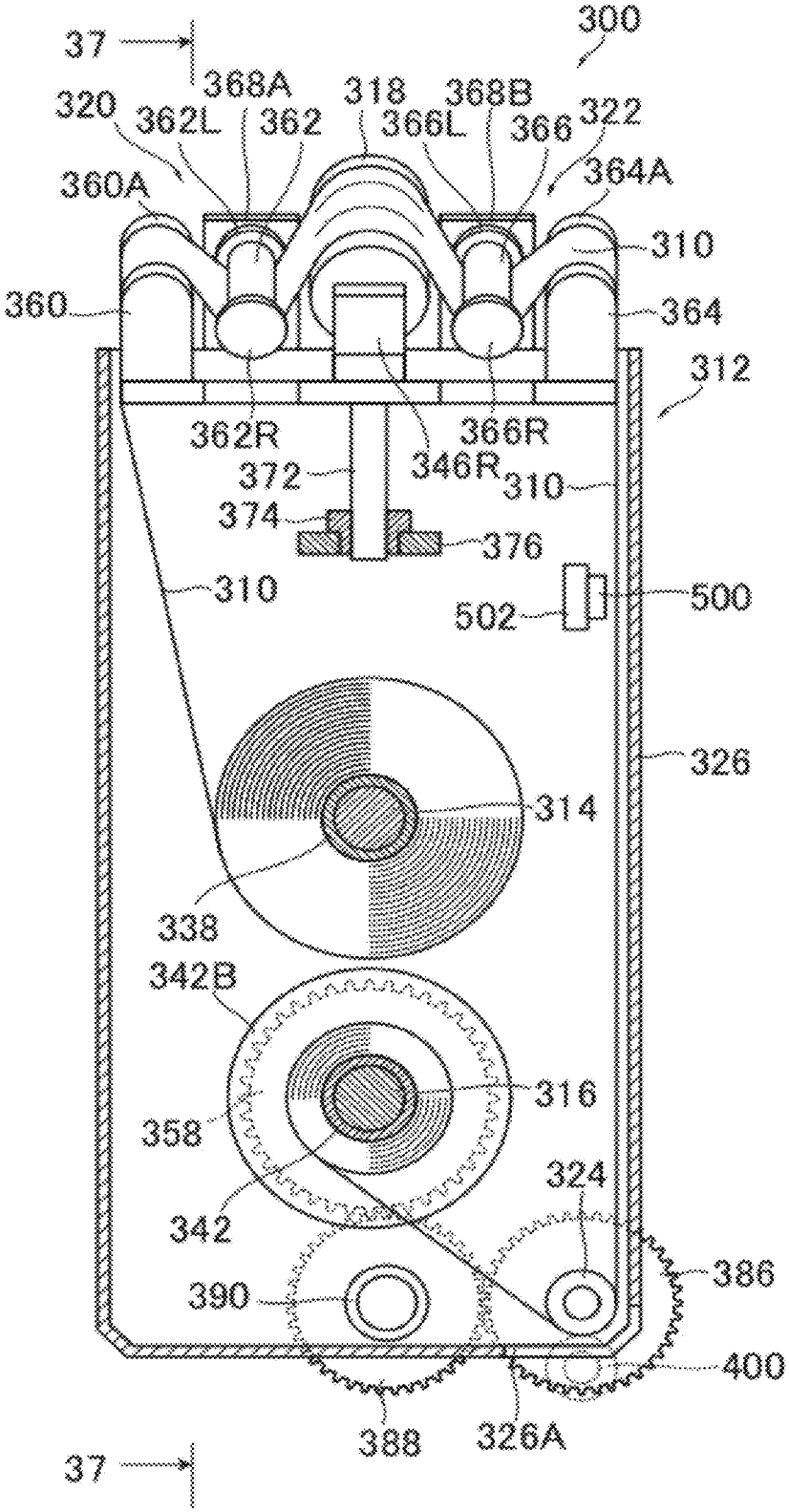
FIG. 33 is a partial cross-sectional front view diagram of the wiping unit.
Figure 34:
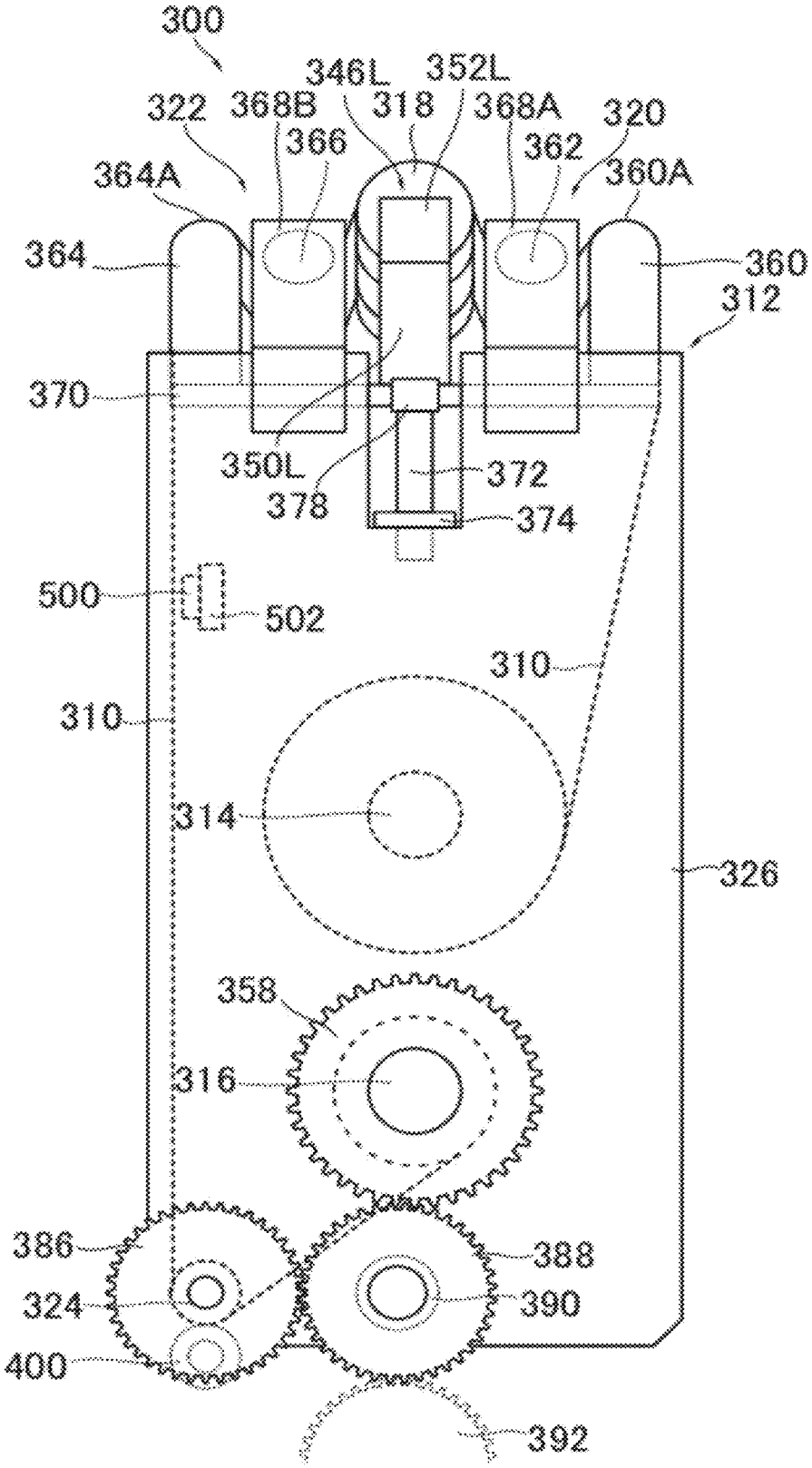
FIG. 34 is a rear view diagram of the wiping unit.

FIG. 30 is a plan diagram of each wiping unit 300, FIG. 31 is a side view diagram of the wiping unit 300 viewed from the image recording position side, FIG. 32 is a partial cross-sectional side view of the wiping unit 300, FIG. 33 is a partial cross-sectional front view of the wiping unit 300, and FIG. 34 is a rear view of the wiping unit 300.

As shown in FIGS. 30 to 34, the wiping unit 300 has a wiping web 310 formed in a band shape, which is wrapped about a pressing roller 318 obliquely disposed, and the wiping unit 300 wipes and cleans the nozzle surface of the inkjet head by pressing the wiping web 310 wrapped about the pressing roller 318, against the nozzle surface of the inkjet head.

The wiping unit 300 includes: a casing 312; a pay-out spindle 314, which pays out the wiping web 310 formed in the band shape; a take-up spindle 316, which takes up the wiping web 310; a front-stage guide 320, which guides the wiping web 310 having been paid out from the pay-out spindle 314 so as to be wrapped about the pressing roller 318; a rear-stage guide 322, which guides the wiping web 310 having been wrapped about the pressing roller 318 so as to be taken up onto the take-up spindle 316; a grid roller (drive roller) 324, which conveys the wiping web 310; and a line scanner 500, which observes the state of the wiping web 310 having been used in the wiping operation.

The casing 312 is constituted of a casing main body 326 and a lid 328. The casing main body 326 is formed in a box shape, which is long in the vertical direction, and the upper end portion and the front face portion thereof are open. The lid 328 is attached to the front face portion of the casing main body 326 through a hinge 330. The front face portion of the casing main body 326 is opened and closed by means of the lid 328.

The lid 328 is provided with an elastically deformable locking hook 332, and the lid 328 is fixed to the casing main body 326 by means of the locking hook 332, which elastically deforms and engages with a hook receiving section 334 formed in the casing main body 326.

The pay-out spindle 314 has a cylindrical shape, and the base end portion thereof is fixed (supported in cantilever fashion) on a spindle bearing section 336 arranged on the casing main body 326, with the pay-out spindle 314 installed horizontally inside the casing main body 326. A pay-out core 338 is detachably installed on the pay-out spindle 314. The pay-out spindle 314 is formed to be slightly shorter than the length of the pay-out core 338. Therefore, when the pay-out core 338 is installed, the pay-out spindle 314 recedes in the inner circumference portion of the pay-out core 338.

The pay-out core 338 has a cylindrical shape. The wiping web 310 formed in the band shape is wound in the form of a roll about the pay-out core 338.

The pay-out core 338 is installed on the pay-out spindle 314 by inserting the pay-out spindle 314 into the inner circumferential portion of the pay-out core 338 and thereby fitting the pay-out core 338 onto the pay-out spindle 314. The pay-out core 338 that has been installed on the pay-out spindle 314 rotates about the pay-out spindle 314 and is rotatably supported.

Here, as shown in FIG. 32, a pay-out core pressing block 339 is arranged in the lid 328 of the casing 312 so as to correspond to the installation position of the pay-out spindle 314. When the lid 328 is closed, the pay-out core pressing block 339 presses the end face of the pay-out core 338 installed on the pay-out spindle 314, in the axial direction thereof, thereby applying friction to the pay-out core 338.

The pay-out core pressing block 339 includes: an axle section 339A; a pressing section 339B, which is slidably arranged on the axle section 339A; and a spring 339C, which impels the pressing section 339B in the axial direction.

The axle section 339A has a round bar shape, and is installed perpendicularly on the inner surface of the lid 328. The axle section 339A is arranged so as to be positioned coaxially with the pay-out spindle 314 when the lid 328 is closed.

The pressing section 339B includes a boss 339B1 and a flange section 339B2. The boss 339B1 has a cylindrical shape, and the outer circumference thereof is formed to have substantially the same diameter as the inner diameter of the pay-out core 338 and so as to be insertable in the inner circumference portion of the pay-out core 338. Furthermore, the inner diameter of the boss 339B1 is formed to have substantially the same diameter as the outer diameter of the axle section 339A, and is slidable along the axle section 339A. The flange section 339B2 is formed integrally with the base end portion of the boss 339B1 and is formed so as to extend in the outer radial direction. The base end portion of the flange section 339B2 is formed with an enlarged inner diameter, and the spring 339C is accommodated in the inner circumference portion of the enlarged flange 339B2. The pressing section 339B is impelled toward the front end direction of the axle section 339A by the spring 339C.

A flange section is formed in the front end of the axle section 339A and detachment of the pressing section 339B is prevented by this flange section.

In the pay-out core pressing block 339, which is composed in this way, when the lid 328 of the casing 312 is closed, the boss 339B1 of the pressing section 339B fits into the inner circumference portion of the pay-out core 338, and furthermore the flange section 339B2 abuts against the end face of the pay-out core 338 and presses the pay-out core 338 in the axial direction by the force of the spring 339C. Thereby, the pay-out core 338 is disposed and pressed between the pay-out core pressing block 339 and the flange 314A, and friction is applied when the core 338 rotates.

The wiping web 310 uses, for example, a knitted or woven sheet made of ultra-fine fibers of PET (polyethylene terephthalate), PE (polyethylene), NY (nylon), or the like, and is formed in a flexible band shape having a width corresponding to the width of the nozzle surface of the inkjet head being wiped.

The take-up spindle 316 is disposed so that the axis thereof is horizontal, at a position below the pay-out spindle 314. More specifically, the take-up spindle 316 is arranged below and parallel with the pay-out spindle 314.

As shown in FIG. 32, the take-up spindle 316 includes: a main shaft 316A; a slipping shaft 316B, which is arranged rotatably in a circumferential direction about the main shaft 316A; and a torque limiter 316C, which couples the main shaft 316A and the slipping shaft 316B, and is composed in such a manner that the slide shaft 316B slides with respect to the main shaft 316A if a load (torque) over a threshold is applied.

The main shaft 316A has a round rod shape, and the vicinity of the base end portion thereof is rotatably supported on a bearing section 340, which is arranged in the casing main body 326.

The slipping shaft 316B has a cylindrical shape, and is arranged rotatably in the circumferential direction about the outer circumference portion of the main shaft 316A.

The torque limiter 316C is arranged in the inner circumference portion of the front end of the slipping shaft 316B, and couples together the main shaft 316A and the slipping shaft 316B. The torque limiter 316C includes an input side rotating body (not shown) and an output side rotating body (not shown) arranged coaxially with the input side rotating body, and when a load (torque) over the threshold is applied to the output side rotating body with respect to the input side rotating body, the torque limiter 316C slides between the input side rotating body and the output side rotating body. The input side rotating body of the torque limiter 316C is connected to the main shaft 316A (for example, through a key and key groove, or a boss and boss hole, or by fixing in an integrated fashion so as to transmit rotation), and the output side rotating body is connected to the slipping shaft 316B (for example, through a key and key groove, or a boss and boss hole, or by fixing in an integrated fashion so as to transmit rotation), whereby the main shaft 316A and the slipping shaft 316B are coupled so as to enable transmission of rotation therebetween. Thus, a function is achieved whereby the slipping shaft 316B slides with respect to the main shaft 316A, when a load or torque over the threshold is applied to the slipping shaft 316B.

In the take-up spindle 316 having the composition described above, if a load (torque) applied to the slipping shaft 316B is within a prescribed range, then no slipping occurs and the slipping shaft 316B rotates in unison with the main spindle 316A. On the other hand, if a load (torque) applied to the slipping shaft 316B exceeds the prescribed range, then slipping occurs between the slipping shaft 316B and the main shaft 316A, and it is possible to prevent an undue load being applied to the main shaft 316A.

A take-up core 342 which takes up the wiping web 310 paid out by the pay-out core 338 is installed on the take-up spindle 316.

The composition of the take-up core 342 is substantially the same as the composition of the pay-out core 338. More specifically, the take-up core 342 has a cylindrical shape. The leading end of the wiping web 310 wound up on the pay-out core 338 is fixed to the take-up core 342.

The take-up core 342 is installed on the take-up spindle 316 by fitting the take-up spindle 316 into the inner circumference portion of the take-up core 342.

Here, as shown in FIG. 32, the take-up core 342 has a key groove 342C formed in the inner circumference portion thereof. On the other hand, a key 316D which engages with the key groove 342C is formed in the outer circumference of the take-up spindle 316 (the outer circumference of the slipping shaft 316B). When installing the take-up core 342, the key 316D formed on the take-up spindle 316 is fitted into the key groove 342C formed in the take-up core 342. Thereby, the take-up core 342 is installed in such a manner that the rotation of the take-up spindle 316 can be transmitted to the take-up core 342.

Furthermore, as shown in FIG. 32, a guide plate 343 is arranged on the inner side of the lid 328 of the casing 312 so as to correspond to the installation position of the take-up spindle 316. The guide plate 343 has a circular disk shape of a diameter corresponding to the take-up diameter of the wiping web 310, and is arranged at the front end of the take-up spindle 316 when the lid 328 is closed.

Furthermore, as shown in FIG. 32, a flange 316E of substantially the same diameter as the guide plate 343 is formed on the base end portion of the take-up spindle 316. The take-up core 342 is installed on the take-up spindle 316 and is disposed between the flange 316E and the guide plate 343 when the lid 328 of the casing 312 is closed. The wiping web 310 taken up onto the take-up core 342 is wound about the take-up core 342 while both edges of the wiping web 310 are guided by the flange 316E and the guide plate 343.

The main shaft 316A of the take-up spindle 316 is arranged in such a manner that the base end portion thereof projects the outer side of the casing main body 326, and a take-up spindle drive gear 358 is fixed on this projecting base end portion. The take-up spindle 316 (main shaft 316A) is rotated by driving and rotating the take-up spindle drive gear 358. The drive mechanism of the take-up spindle 316 is as described below.

The pressing roller 318 is disposed above the pay-out spindle 314 (in the present embodiment, the pressing roller 318, the pay-out spindle 314 and the take-up spindle 316 are disposed on the same straight line), and is arranged at a prescribed angular inclination with respect to the horizontal plane. In other words, the pressing roller 318 is obliquely disposed in accordance with the angular inclination of the nozzle surface 33 of the inkjet head 32 that is to be wiped (i.e., the axis of the pressing roller 318 is parallel with the nozzle surface 33) in order to press the wiping web 310 against the nozzle surface 33 of the inkjet head 32.

The pressing roller 318 is formed so as to follow the shape of the nozzle surface 33 of the inkjet head 32 that is to be wiped. In the inkjet head 32 in the present embodiment, the central portion of the nozzle surface 33 is formed so as to be withdrawn in a recessed shape (the nozzles are formed in this recessed section in order to protect the nozzles; in other words, sections on both sides of the recessed section are relatively projected and function as protecting sections). In this case, the central portion of the pressing roller 318 is formed so as to project (having a larger diameter than other portions) in accordance with the recessed shape in the nozzle surface 33.

The pressing roller 318 is provided with axle portions 318L and 318R, which project on either end portion thereof, and the axle portions 318L and 318R are supported by a pair of axle supporting sections 346L and 346R in a rotatable and swingable fashion.

Figure 35:
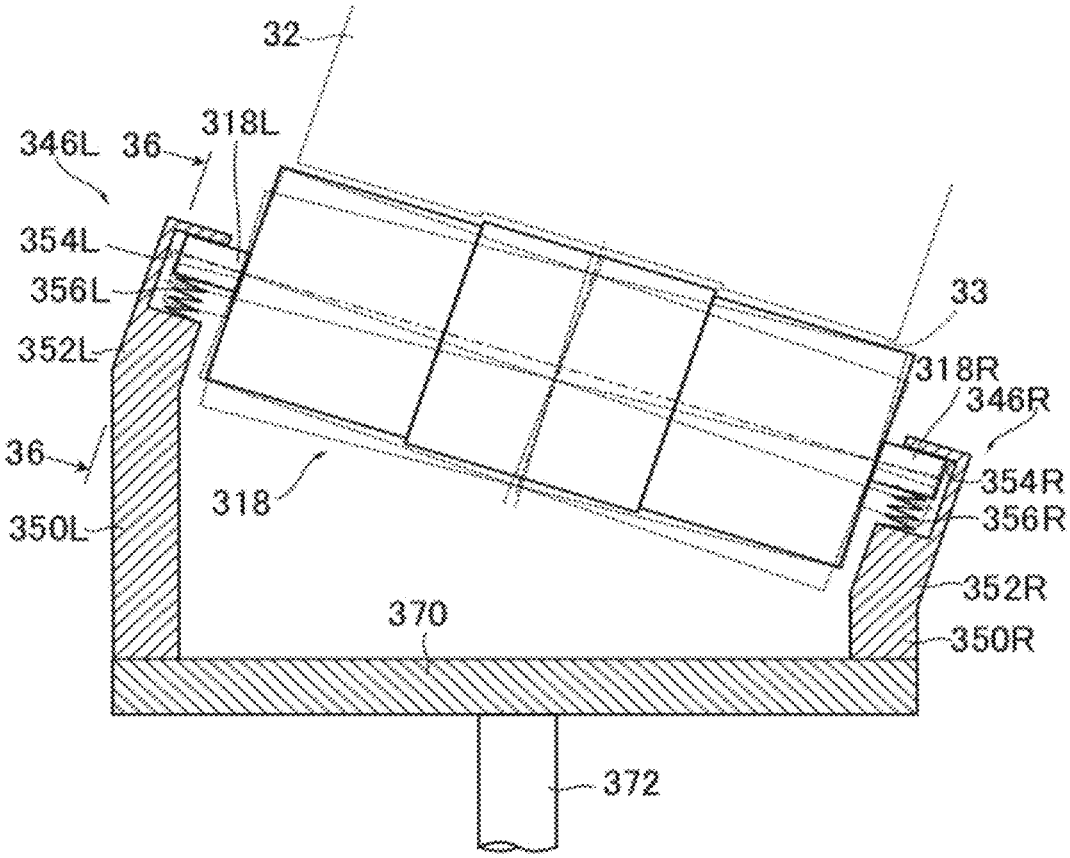
FIG. 35 is a partial cross-sectional front view diagram showing the composition of a bearing section which supports an axle section of a pressing roller.
Figure 36:
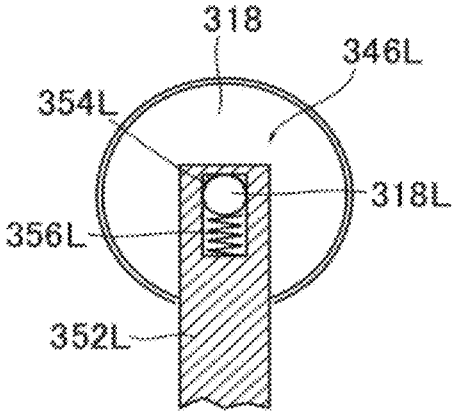
FIG. 36 is a cross-sectional view along line 36-36 in FIG. 35.

FIG. 35 is a partial cross-sectional front view diagram showing the composition of the axle supporting sections which support the axle sections 318L and 318R of the pressing roller 318, and FIG. 36 is a cross-sectional diagram along line 36-36 in FIG. 35.

As shown in FIG. 35, the axle supporting sections 346L and 346R are arranged on an elevator stage 370, which is horizontally disposed. The axle supporting sections 346L and 346R are constituted of pillar sections 350L and 350R, which are vertically erected on the elevator stage 370, and supporting sections 352L and 352R, which are arranged in a bent fashion at the top ends of the pillar sections 350L and 350R.

The supporting sections 352L and 152R are arranged perpendicularly to the axle of the pressing roller 318, and recess sections 354L and 354R are formed in the inner sides thereof. Each of the recess sections 354L and 354R is formed in a rectangular shape, which has a breadth substantially equal to the diameter of each of the axle sections 318L and 318R of the pressing roller 318, and the lengthwise direction thereof is perpendicular to the nozzle surface of the inkjet head that is to be cleaned (see FIG. 36). The axle sections 318L and 318R on either end of the pressing roller 318 are fitted freely into the recess sections 354L and 354R of the supporting sections 352L and 352R. Thus, the pressing roller 318 is supported swingably within the plane perpendicular to the nozzle surface of the inkjet head that is to be cleaned.

Springs 356L and 356R are accommodated inside the recess sections 354L and 354R, and the axle sections 318L and 318R of the pressing roller 318 which are fitted freely inside the recess sections 354L and 354R are pressed upward by these springs 356L and 356R. By this means, it is possible to cause the circumferential surface of the pressing roller 318 to make close contact with the nozzle surface, by following the nozzle surface of the inkjet head that is to be cleaned.

The front-stage guide 320 is constituted of a first front-stage guide 360 and a second front-stage guide 362, and the wiping web 310 which has been paid out from the pay-out spindle 314 is guided so as to wrap about the pressing roller 318, which is obliquely disposed.

On the other hand, the rear-stage guide 322 is constituted of a first rear-stage guide 364 and a second rear-stage guide 366, and the wiping web 310 which has been wrapped about the pressing roller 318 obliquely disposed is guided so as to be taken up onto the horizontally disposed take-up spindle 316.

The front-stage guide 320 and the rear-stage guide 322 are disposed symmetrically about the pressing roller 318. More specifically, the first front-stage guide 360 and the first rear-stage guide 364 are disposed symmetrically about the pressing roller 318, and furthermore the second front-stage guide 362 and the second rear-stage guide 366 are disposed symmetrically about the pressing roller 318.

The first front-stage guide 360 is formed in a plate shape having a prescribed width and is vertically erected on the elevator stage 370. The upper edge portion 360A of the first front-stage guide 360 is formed as a supporting section for the wiping web 310, and the surface thereof is formed in a circular arc shape. Furthermore, the upper edge portion 360A is formed at a prescribed angular inclination with respect to the horizontal plane, whereby the travel direction of the wiping web 310 is changed.

The first rear-stage guide 364 has the same composition as the first front-stage guide 360. More specifically, the first rear-stage guide 364 is formed in a plate shape having a prescribed width and is vertically erected on the elevator stage 370. The upper edge portion 370A is formed as a supporting section for the wiping web 310 and is formed in a circular arc shape. Furthermore, the upper edge portion 370A is formed at a prescribed angular inclination with respect to the horizontal plane.

The first front-stage guide 360 and the first rear-stage guide 364 are disposed symmetrically about the pressing roller 318. The travel direction of the wiping web 310 which has been paid out from the pay-out spindle 314 is changed to a direction substantially perpendicular to the axis of the pressing roller 318 from the direction perpendicular to the axis of the pay-out spindle 314, by wrapping the wiping web 310 about the first front-stage guide 360. The travel direction of the wiping web 310 having been wrapped about the second rear-stage guide 366 described below is changed to a direction perpendicular to the axis of the take-up spindle 316 by wrapping the wiping web 310 about the first rear-stage guide 364.

The second front-stage guide 362 is formed as a guide roller having flanges 362L and 362R on the respective end portions thereof. The second front-stage guide 362 is disposed between the first front-stage guide 360 and the pressing roller 318, and guides the wiping web 310 which has wrapped about the first front-stage guide 360 so as to be wrapped about the pressing roller 318. More specifically, the travel direction of the wiping web 310 which has been changed to the direction substantially perpendicular to the axis of the pressing roller 318 by the first front-stage guide 360 is slightly adjusted so that the wiping web 310 travels in the direction just perpendicular to the axis of the pressing roller 318. Furthermore, skewed travel of the wiping web 310 is prevented by the flange sections 362L and 362R on the respective ends of the first front-stage guide 360.

Figure 37:
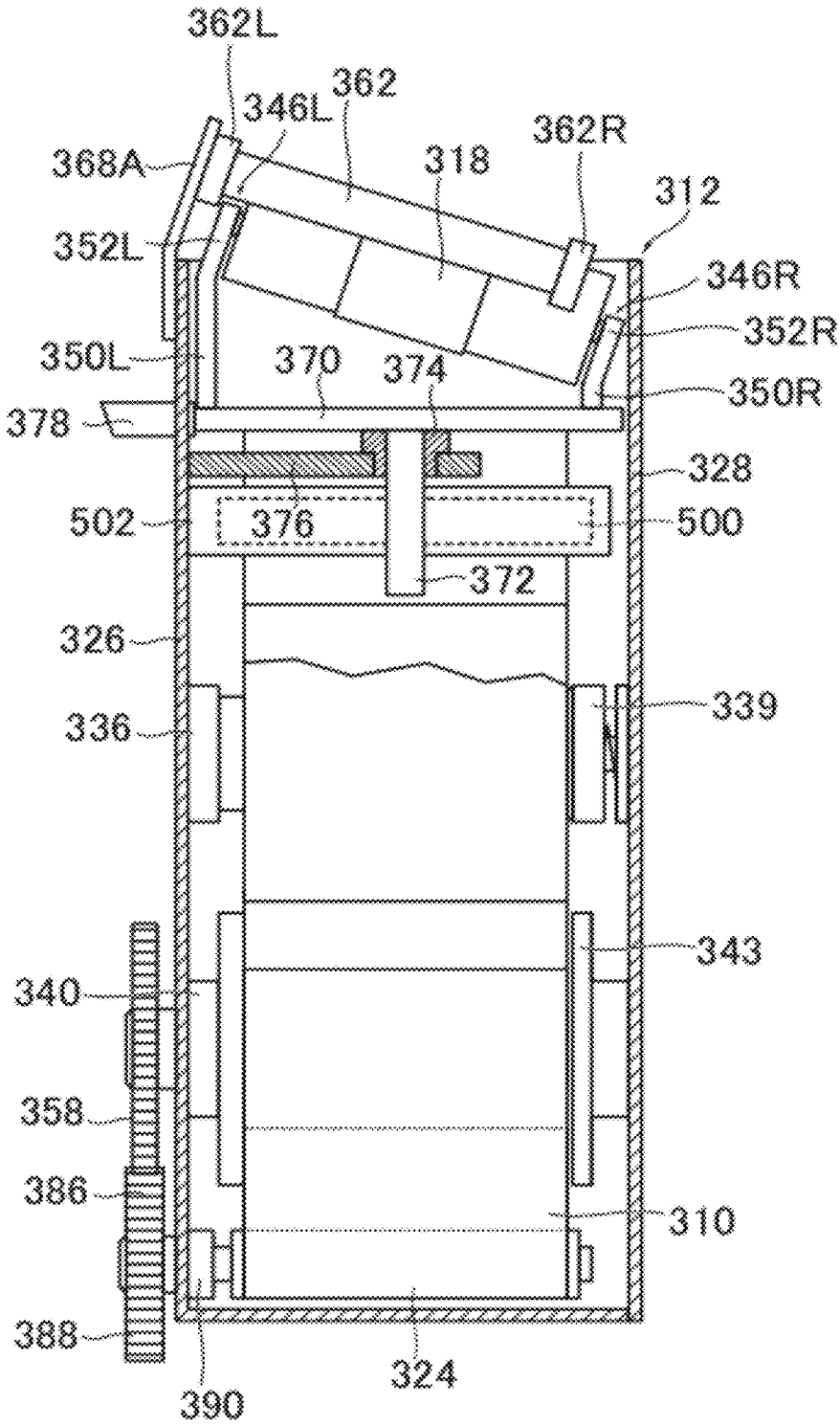
FIG. 37 is a cross-sectional view along line 37-37 in FIG. 33.

The second front-stage guide 362 is supported at only one end thereof on a bracket 368A, and the second front-stage guide 362 is disposed at a prescribed angular inclination. As shown in FIGS. 34 and 37, the bracket 368A is formed in a plate shape with a bent top end, and the base end portion of the bracket 368A is fixed to the upper end portion of the rear face of the casing main body 326. The bracket 368A is arranged so as to project perpendicularly upward from the upper end portion of the casing main body 326. The second front-stage guide 362 is rotatably supported at only one end thereof on the bent portion of the top end of the bracket 368A.

The second rear-stage guide 366 has the same composition as the second front-stage guide 362. More specifically, the second rear-stage guide 366 is formed as a guide roller having flanges 366L and 366R on either end portion thereof, and the second rear-stage guide 366 is supported at only one end thereof on a bracket 368B. The second rear-stage guide 366 is arranged at a prescribed angular inclination. The bracket 368B is formed in a plate shape with a bent top end, and the base end portion of the bracket 368B is fixed to the upper end portion of the rear face of the casing main body 326. The second rear-stage guide 366 is rotatably supported at only one end thereof on the bent portion of the top end of the bracket 368B.

The second rear-stage guide 366 is disposed between the pressing roller 318 and the first rear-stage guide 364, and guides the wiping web 310 which has wrapped about the pressing roller 318 so as to be wrapped about the first rear-stage guide 364.

The second front-stage guide 362 and the second rear-stage guide 366 are disposed symmetrically about the pressing roller 318. The wiping web 310 of which the travel direction has been changed to the direction substantially perpendicular to the axis of the pressing roller 318 by the first front-stage guide 360 is wrapped about the second front-stage guide 362, whereby the travel direction of the wiping web 310 is slightly adjusted so that the wiping web 310 travels in the direction just perpendicular to the axis of the pressing roller 318. Furthermore, the travel direction of the wiping web 310 having been wrapped about the pressing roller 318 is slightly adjusted by the second rear-stage guide 366 so that the wiping web 310 can be wrapped about the first rear-stage guide 364. By wrapping the wiping web 310 about the first rear-stage guide 364, the travel direction of the wiping web 310 is changed to the direction perpendicular to the axis of the take-up spindle 316.

Thus, the front-stage guide 320 and the rear-stage guide 322 guide the wiping web 310 by gradually changing the travel direction of the wiping web 310, so that the wiping web 310 can be wrapped about the pressing roller 318 readily.

Consequently, the angle of inclination of the second front-stage guide 362 is closer to the angle of inclination of the pressing roller 318 than the angle of inclination of the first front-stage guide 360, and similarly, the angle of inclination of the second rear-stage guide 366 is closer to the angle of inclination of the pressing roller 318 than the angle of inclination of the first rear-stage guide 364.

As described above, the first front-stage guide 360, the pressing roller 318 and the first rear-stage guide 364 are arranged on the elevator stage 370. The elevator stage 370 can be raised and lowered in the direction vertical to the horizontal plane.

As shown in FIG. 32, a guide shaft 372 is connected integrally with the elevator stage 370. The guide shaft 372 vertically extends downward from the lower face of the elevator stage 370 and is fitted into a guide bush 374 disposed inside the casing main body 326. The guide bush 374 is fixed to the inner wall face of the casing main body 326 through a supporting member 376, and guides the guide shaft 372 vertically.

Figure 38A:
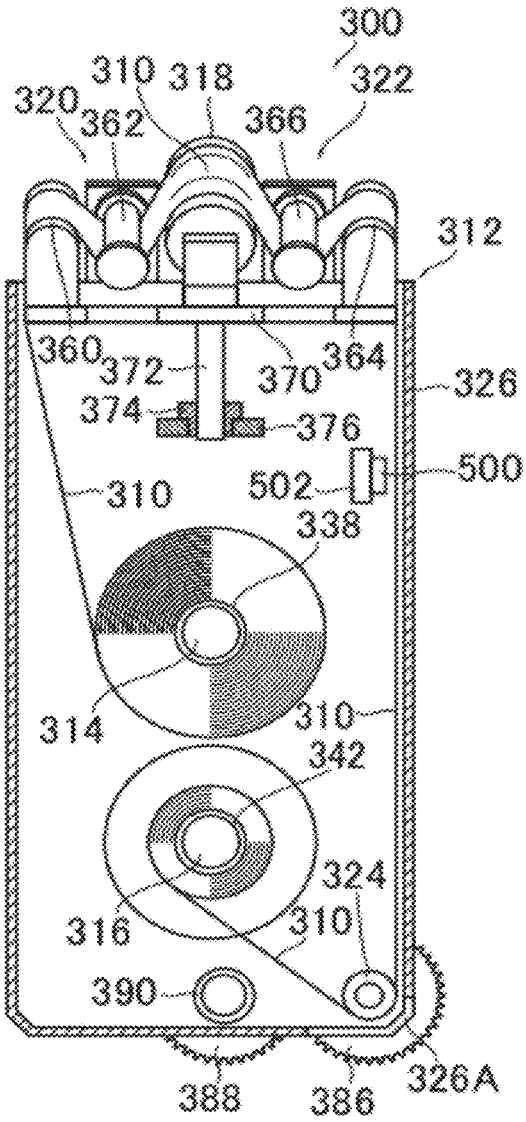
FIG. 38A is an illustrative diagram showing a state of a wiping web in the wiping unit during use.
Figure 38B:
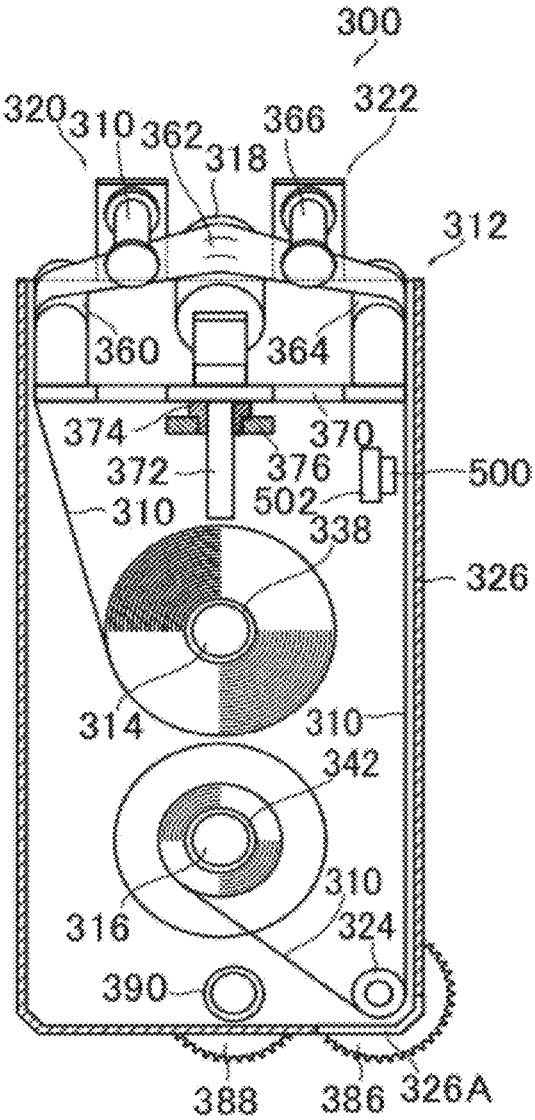
FIG. 38B is an illustrative diagram showing a state of the wiping web during replacement.

In this way, the elevator stage 370 on which the first front-stage guide 360, the pressing roller 318 and the first rear-stage guide 364 are disposed is arranged raisably and lowerably in the direction vertical to the horizontal plane. Therefore, as shown in FIGS. 38A and 38B, by raising and lowering the elevator stage 370, it is possible to cause the first front-stage guide 360, the pressing roller 318 and the first rear-stage guide 364 to advance and retreat with respect to the second front-stage guide 362 and the second rear-stage guide 366, which are fixedly arranged. By this means, it is possible to simply replace the wiping web 310.

More specifically, by lowering the elevator stage 370, as shown in FIG. 38B, the first front-side guide 360, the pressing roller 318 and the first rear-stage guide 364 can be retracted downward with respect to the second front-stage guide 362 and the second rear-stage guide 366, and therefore a large space between same can be ensured. Thereby, it is possible to simply carry out the task of wrapping the wiping web 310 about the respective sections. Furthermore, the wiping web 310 can be simply wrapped about the respective sections by wrapping the wiping web 310 about the first front-stage guide 360, the pressing roller 318 and the first rear-stage guide 364, with the first front-stage guide 360, the pressing roller 318 and the first rear-stage guide 364 in the downwardly retracted state, and then raising the elevator stage 370. In other words, if the wiping web 310 is wrapped about the first front-stage guide 360, the pressing roller 318 and the first rear-stage guide 364, whereupon the elevator stage 370 is raised, as shown in FIG. 38A, then the wiping web 310 is automatically wrapped about the second front-stage guide 362 and the second rear-stage guide 366.

In this way, by making the first front-stage guide 360, the pressing roller 318 and the first rear-stage guide 364 capable of advancing and retracting with respect to the second front-stage guide 362 and the second rear-stage guide 366, it is possible to simply carry out the task of replacing the wiping web 310.

The first front-stage guide 360, the pressing roller 318 and the first rear-stage guide 364 need to be situated in the prescribed use position (the position in FIG. 38A) when being used, and the first front-stage guide 360, the pressing roller 318 and the first rear-stage guide 364 are moved to the use position in coordination with the installation of the wiping unit 300 on the wiping device main body frame 302.

This coordinated mechanism will now be described. As shown in FIGS. 32 and 34, an elevator lever (engagement section) 378 is arranged on the elevator stage 370, on which the first front-stage guide 360, the pressing roller 318 and the first rear-stage guide 364 are arranged. The elevator lever 378 is arranged so as to project from the rear face of the casing main body 326 through a cutaway portion 380 formed on the rear face of the casing main body 326. The elevator stage 370 is raised and lowered by sliding the elevator lever 378.

Figure 39A:
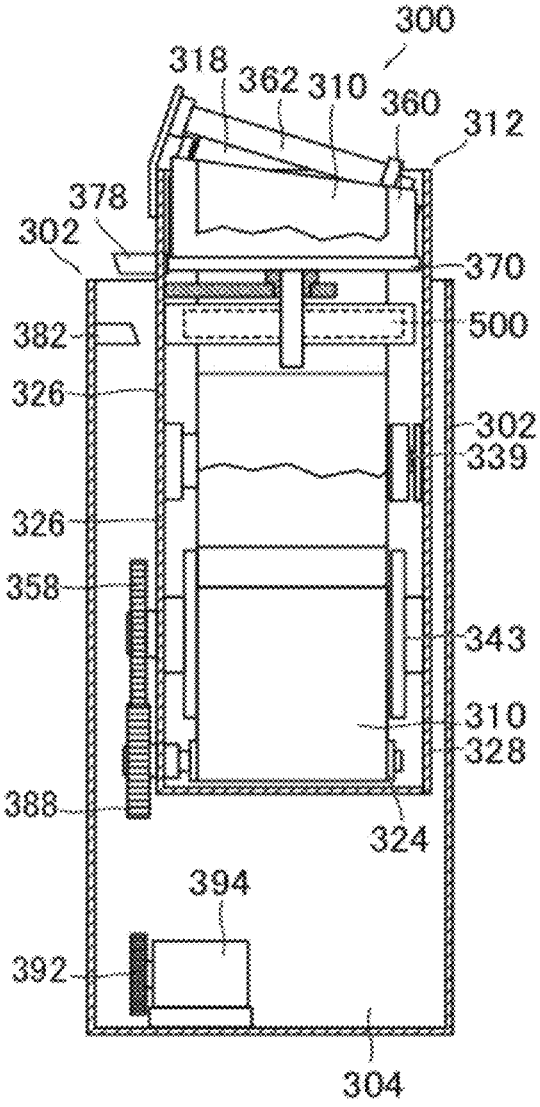
FIGS. 39A and 39B are illustrative diagrams of a coordination mechanism for raising and lowering an elevator table.
Figure 39B:
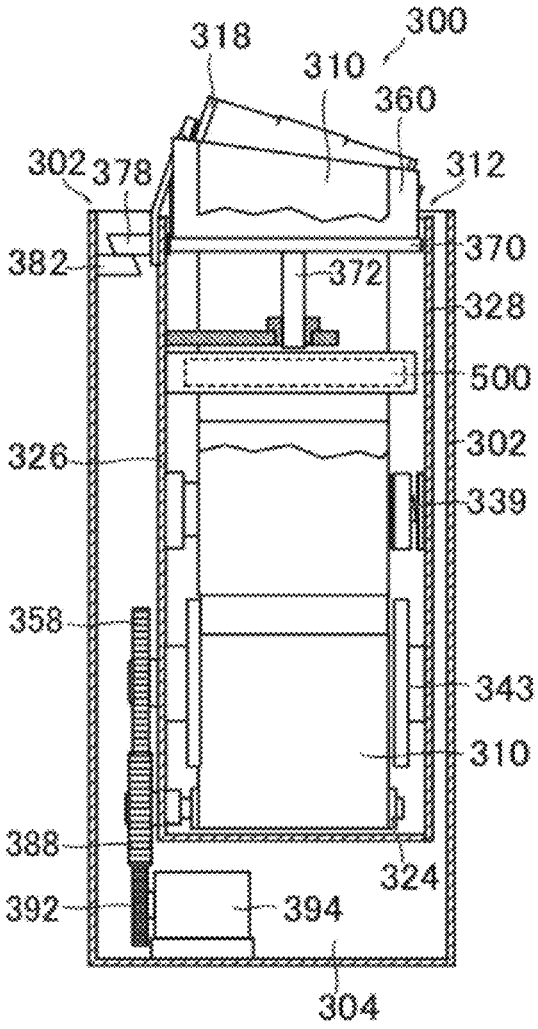

On the other hand, as shown in FIGS. 39A and 39B, a pin (engaged section) 382 is projectingly arranged on the inner side of the wiping unit installation section 304 of the wiping device main body frame 302 in which the wiping unit 300 is set. The pin 382 is arranged so as to engage with the elevator lever 378 arranged on the wiping unit 300 when the wiping unit 300 is installed on the wiping unit installation section 304.

According to the composition described above, as shown in FIGS. 39A and 39B, when the wiping unit 300 is inserted into the wiping unit installation section 304 of the wiping device main body frame 302, the elevator lever 378 engages with the pin 382 and is forcibly raised up to a prescribed position. Thereby, the first front-stage guide 360, the pressing roller 318 and the first rear-stage guide 364 are registered in the prescribed use position.

In this way, the first front-stage guide 360, the pressing roller 318 and the first rear-stage guide 364 are moved to the use position in coordination with the installation of the wiping unit 300 on the wiping device main body frame 302.

The grid roller 324 is disposed in the vicinity of the base face of the casing main body 326, in a position below the first rear-stage guide 364. The grid roller 324 drives and guides the wiping web 310 of which the travel direction has been changed to the direction perpendicular to the axis of the take-up spindle 316 by the first rear-stage guide 364, so that the wiping web 310 is taken up onto the take-up spindle 316.

The grid roller 324 is arranged in parallel with the take-up spindle 316 (namely in parallel with the horizontal plane), and the vicinity of the base end portion thereof is rotatably supported on a bearing section 384, which is arranged on the casing main body 326. Furthermore, the grid roller 324 is arranged in such a manner that the base end portion of the rotating shaft thereof projects to the outer side of the casing main body 326, and a grid roller drive gear 386 is fixed to this projecting base end portion of the rotating shaft. The grid roller 324 is rotated by driving the grid roller drive gear 386 to rotate.

Here, the drive mechanism of the wiping unit 300 including the grid roller 324 is described.

In the standard wiping unit 300 according to the present embodiment, by driving the take-up spindle 316 to rotate while also driving the grid roller 324 to rotate, the wiping web 310 is caused to travel from the pay-out spindle 314 toward the take-up spindle 316.

As described above, the take-up spindle drive gear 358 is fixed to the take-up spindle 316 (the main spindle 316A which constitutes the take-up spindle 316). On the other hand, the grid roller drive gear 386 is fixed to the grid roller 324. As shown in FIG. 34, the take-up spindle drive gear 358 and the grid roller drive gear 386 mesh with a rotation transmission gear 388.

The rotating shaft of the rotation transmission gear 388 is horizontally arranged and is rotatably supported on a bearing section 390 arranged on the casing main body 326. The take-up spindle drive gear 358 and the grid roller drive gear 386 are both caused to rotate in the same direction by driving the rotation transmission gear 388. Due to the rotation of the take-up spindle drive gear 358 and the grid roller drive gear 386, the take-up spindle 316 and the grid roller 324 rotate.

Here, in the wiping device according to the present embodiment, the gears of different diameters (the gears having different numbers of teeth) are used for the take-up spindle drive gear 358 and the grid roller drive gear 386, and the take-up spindle 316 and the grid roller 324 are set so as to rotate at different velocities. More specifically, in the wiping device according to present embodiment, in order to be able to convey the wiping web 310 without any slackness, the rotational velocity of the take-up spindle 316 and the rotational velocity of the grid roller 324 are set in such a manner that the velocity at which the wiping web 310 is taken up onto the take-up core 342 is faster than the velocity at which the wiping web 310 is conveyed by the grid roller 324. Thereby, it is possible to stably take up the wiping web 310 without any slackness.

More specifically, the rotational velocity of the take-up spindle 316 and the rotational velocity of the grid roller 324 are set in such a manner that the circumferential velocity V1 of the take-up core 342 installed on the take-up spindle 316 is greater than the circumferential velocity V2 of the grid roller 324 (V1>V2), and the gear ratio of the take-up spindle drive gear 358 and the grid roller drive gear 386 is set on the basis of these velocities.

The rotational velocities actually set are determined by finding optimum velocities through experimentation, and the like. More specifically, if there is a too large difference between these velocities, then this can cause abrasion, breakdown, or the like, and therefore the rotational velocities are set by finding optimum values on the basis of experimentation, or the like.

Even if there is a difference between the take-up speed and the conveyance speed in this way, since the slipping mechanism (based on the torque limiter 316C) is arranged in the take-up spindle 316 of the wiping device according to the present embodiment, then it is possible to drive the take-up spindle 316, the grid roller 324, the motor 394, and the like, without placing excessive load thereon.

The rotation transmission gear 388, which causes the take-up spindle drive gear 358 and the grid roller drive gear 386 to rotate, meshes with a drive gear 392 arranged inside the wiping unit installation section 304, when the wiping unit 300 is installed on the wiping unit installation section 304 of the wiping device main body frame 302.

The drive gear 392 is fixed to the output shaft of the motor 394 and when the wiping unit 300 is installed on the wiping unit installation section 304, the drive gear 392 is disposed in a position so as to mesh with the rotational transmission gear 388.

The motor 394 is constituted of a pulse motor, for example, and is installed on the base portion of the wiping unit installation section 304. The driving of the motor 394 is controlled by the controller (not shown).

The drive mechanism of the wiping unit 300 is composed as described above.

In this way, by installing the wiping unit 300 on the wiping unit installation section 304 of the wiping device main body frame 302, the rotation transmission gear 388 arranged in the casing 312 of the wiping unit 300 meshes with the drive gear 392 arranged in the wiping unit installation section 304 (see FIGS. 39A and 39B). When the motor 394 is driven in this state, the drive gear 392 rotates and this rotation is transmitted to the rotation transmission gear 388 and causes the rotation transmission gear 388 to rotate.

When the rotation transmission gear 388 rotates, this rotation of the rotation transmission gear 388 is transmitted to the take-up spindle drive gear 358 and the grid roller drive gear 386, and hence the take-up spindle drive gear 358 and the grid roller drive gear 386 rotate. Thereby, the take-up spindle 316 and the grid roller 324 rotate. Due to this rotation of the take-up spindle 316 and the grid roller 324, the wiping web 310 is paid out from the pay-out core 338 installed on the pay-out spindle 314 and is wound up onto the take-up core 342 installed on the take-up spindle 316 through a prescribed path of travel.

As described above, when the wiping unit 300 is installed on the wiping unit installation section 304, the rotation transmission gear 388 meshes with the drive gear 392, and the take-up spindle 316 and the grid roller 324 can be driven.

Figure 40:
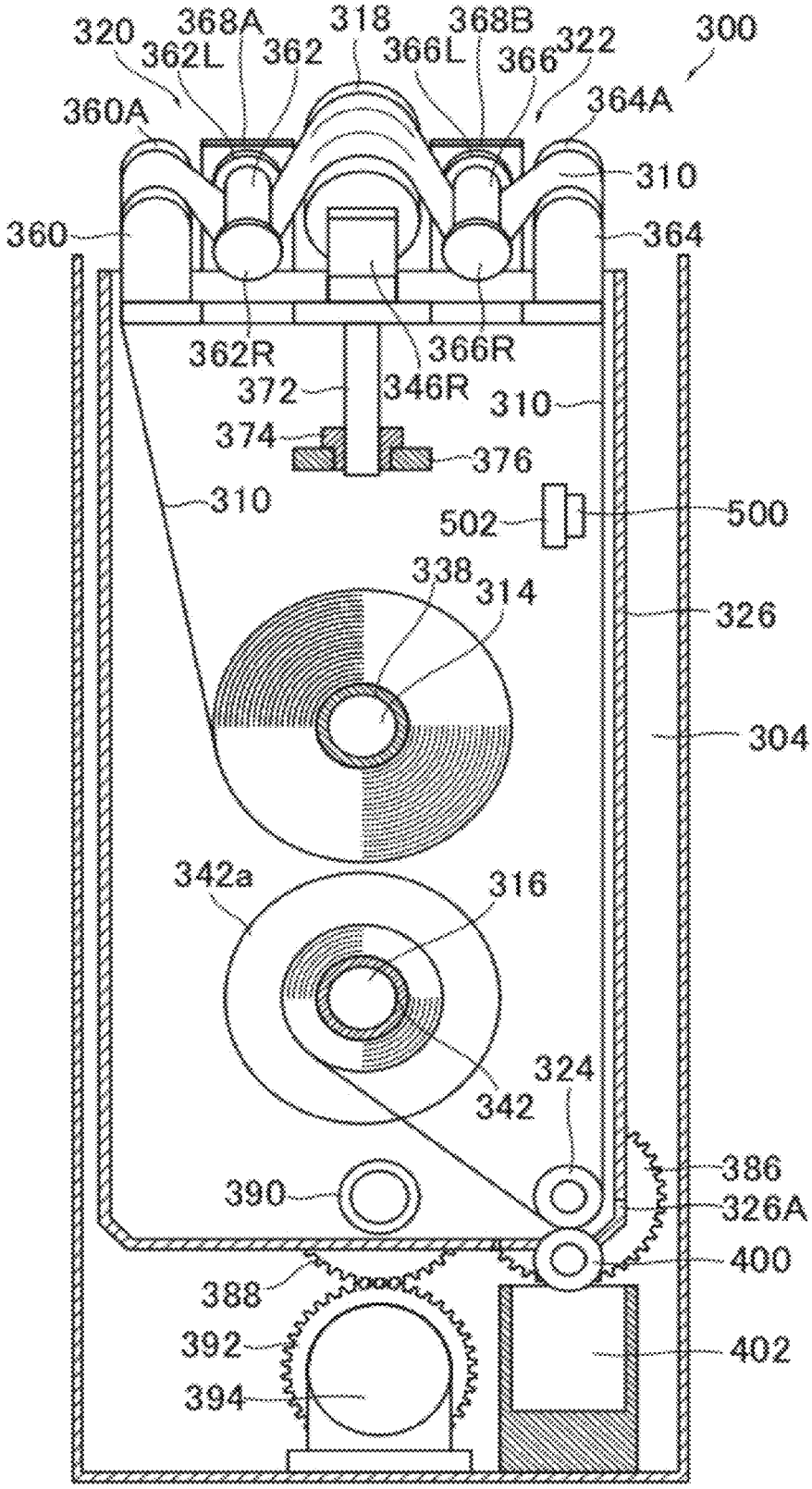
FIG. 40 is a partial cross-sectional front view diagram showing a state where the wiping unit has been installed in an installation section.
Figure 41:
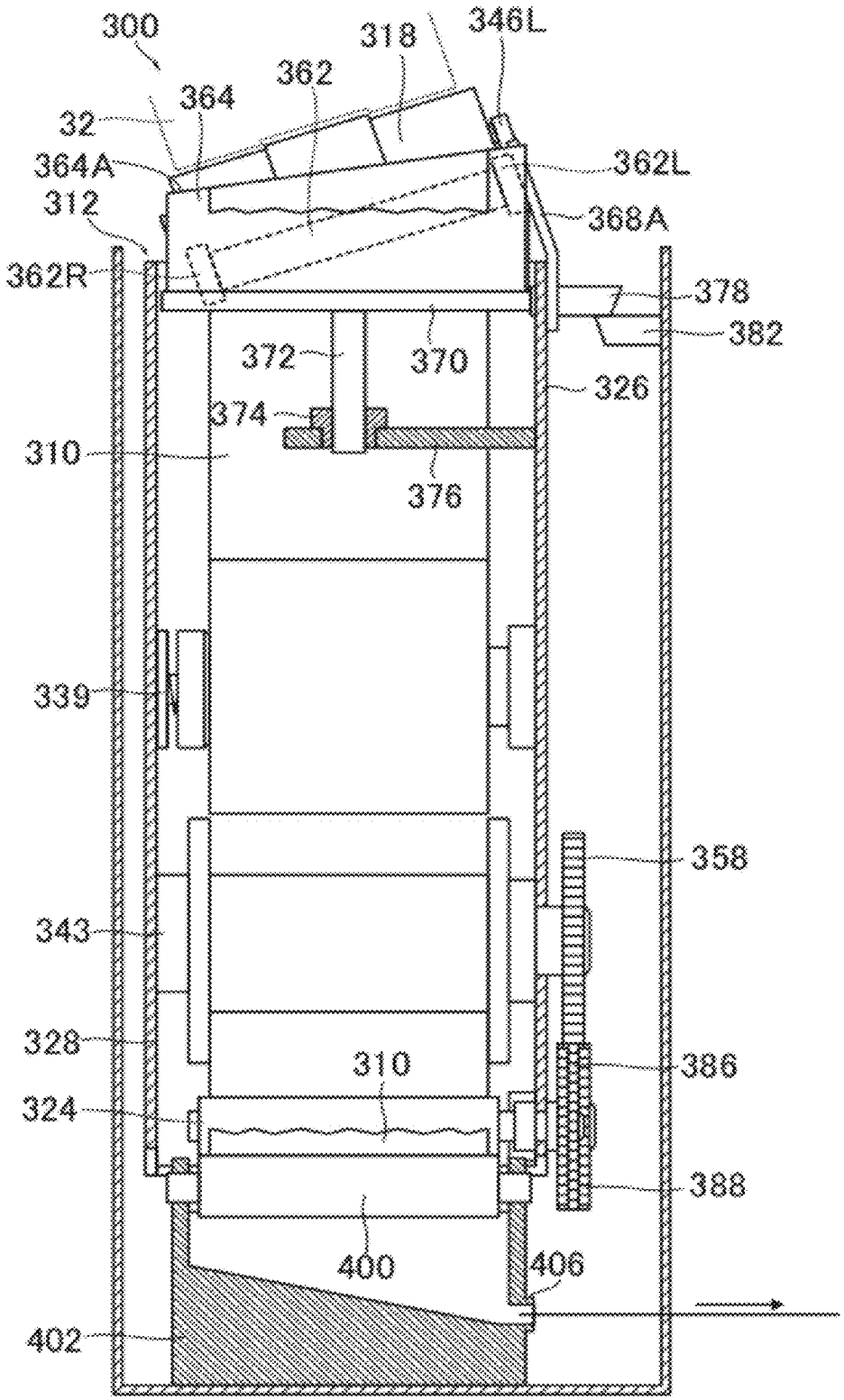
FIG. 41 is a partial cross-sectional side view diagram showing the state where the wiping unit has been installed in the installation section.

On the other hand, when the wiping unit 300 is installed on the wiping unit installation section 304, as shown in FIGS. 40 and 41, a nip roller 400 arranged in the wiping unit installation section 304 is pressed against the outer circumference portion of the grip roller 324 through an opening 326A formed in the bottom portion of the casing main body 326.

The nip roller 400 has substantially the same width as the grid roller 324 and the outer circumference portion of the nip roller 400 is covered with an elastic body made of rubber, or the like. The nip roller 400 is installed horizontally on a waste liquid receptacle 402, which is disposed in the wiping unit installation section 304.

The waste liquid receptacle 402 has a rectangular box shape of which the upper portion is open, and bearing sections (not shown) for supporting the nip roller 400 are arranged on the upper edge portions thereof. The nip roller 400 is supported by the bearing sections so as to be rotatable in the waste liquid receptacle 402.

The bottom face of the interior of the waste liquid receptacle 402 is formed with an inclination, and a waste liquid outlet 406 is formed in the lower end portion of the bottom face in the direction of inclination. The waste liquid outlet 406 is connected to a waste liquid tank (not shown) through a pipe (not shown).

When the wiping unit 300 on which the wiping web 310 has been installed is fitted into the wiping unit installation section 304, then the wiping web 310 wound about the grid roller 324 is nipped between the nip roller 400 and the grid roller 324. The wiping web 310 which is nipped between the nip roller 400 and the grid roller 324 is sent toward the take-up core 342 by driving the grid roller 324 to rotate in this state.

Here, the wiping web 310 nipped between the nip roller 400 and the grid roller 324 is the wiping web 310 that has been wiped the nozzle surface, and therefore this wiping web 310 has absorbed the cleaning liquid, and the like. The liquid absorbed by the wiping web 310 is removed from the wiping web 310 and recovered in the waste liquid receptacle 402 when the wiping web 310 passes between the grid roller 324 and the nip roller 400.

Thereby, the nip roller 400 and the grid roller 324 function as the conveyance device for the wiping web 310, and also function as the device for removing the liquid (waste liquid) that has been absorbed by the wiping web 310. Thus, it is possible to prevent the waste liquid from dripping down off the wiping web 310 that is taken up on the take-up core 342 and soiling the peripheral area or causing breakdown of the apparatus.

The line scanner 500 is attached to a bracket 502, which is arranged on the casing main body 326, and is thereby arranged on the inner side of the casing main body 326. In the present embodiment, the line scanner 500 is arranged between the first rear-stage guide 364 and the grid roller 324, and the wiping web 310 that is traveling between the first rear-stage guide 364 and the grid roller 324 is observed (i.e., an image thereof is captured) from the rear surface of the wiping web 310. More specifically, the line scanner 500 is arranged perpendicularly to the wiping web 310 that travels between the first rear-stage guide 364 and the grid roller 324, and the state of absorption of soiling on the traveling wiping web 310 is observed from the rear surface of the wiping web 310.

Since the wiping web 310 is constituted of the absorbing body, then even when the rear surface of the wiping web 310 (the surface opposite to the surface (front surface) that has touched the nozzle surface) is observed as in the present embodiment, it is possible to obtain similar results to a case where the front surface of the wiping web 310 is observed.

The wiping unit 300 is composed as described above.

The wiping device is composed by installing the wiping units 300 in the wiping unit installation sections 304 of the wiping device main frame 302.

<Action of Wiping Device>

Next, the action of the wiping device having the composition described above is explained.

<<Installation of Wiping Web>>

The method of installing the wiping web 310 on the wiping unit 300 is described.

The wiping web 310 is presented in a wound state in the form of a roll on the pay-out core 338, and the leading end of the wiping web 310 is fixed to the take-up core 342.

Firstly, the wiping unit 300 is taken out from the wiping device main body frame 302 and the lid 328 of the casing 312 is opened. When the lid 328 is opened, the pay-out spindle 314 and the take-up spindle 316 are exposed, and then the pay-out core 338 is installed on the pay-out spindle 314 and the take-up core 342 is installed on the take-up spindle 316.

At this time, the pay-out core 338 and the take-up core 342 are installed while wrapping the wiping web 310 about the first front-stage guide 360, the pressing roller 318, the first rear-stage guide 364, and the grid roller 324.

More specifically, firstly, the pay-out core 338 is installed on the pay-out spindle 314. The pay-out core 338 is installed by fitting the pay-out core 338 onto the pay-out spindle 314. Thereby, the pay-out core 338 is rotatably supported about the pay-out spindle 314.

Thereupon, the wiping web 310 is paid out by a prescribed amount from the pay-out core 338, passed below the second front-stage guide 362 and the second rear-stage guide 366, and the wiping web 310 is wrapped about the upper side of the first front-stage guide 360, the pressing roller 318 and the first rear-stage guide 364. At this time, the wiping web 310 is wrapped about the first front-stage guide 360, the pressing roller 318 and the first rear-stage guide 364 while the elevator stage 370 is in the lowered state, in other words, while the first front-stage guide 360, the pressing roller 318 and the first rear-stage guide 364 are in the downwardly retracted state. Thereby, it is possible to ensure sufficient space with respect to the second front-stage guide 362 and the second front-stage guide 366, and the wiping web 310 can be readily wrapped about the first front-stage guide 360, the pressing roller 318 and the first rear-stage guide 364 by passing below the second front-stage guide 362 and the second rear-stage guide 366.

The wiping web 310 wrapped around the first front-stage guide 360, the pressing roller 318 and the first rear-stage guide 364 is further wrapped around the grid roller 324, and finally the take-up core 342 is installed on the take-up spindle 316.

The take-up core 342 is installed by fitting the take-up core 342 onto the take-up spindle 316. In this case, the key groove 342C formed in the inner circumference of the take-up core 342 is fitted onto the key 316D formed on the outer circumference of the take-up spindle 316. Thereby, the take-up core 342 is installed on the take-up spindle 316 in a state where the rotation in the circumferential direction is restricted. Accordingly, the rotation of the take-up spindle 316 can be transmitted to the take-up core 342, and the take-up core 342 can be rotated together with the take-up spindle 316.

As described above, since the torque limiter 316C is arranged on the take-up spindle 316, then slipping occurs if a load over the prescribed threshold is applied, and therefore it is possible to wind up the wiping web 310 while avoiding undue load.

By means of the foregoing steps, the installation of the wiping web 310 is completed. Thereupon, the lid 328 of the casing 312 is closed.

Here, when the lid 328 is closed, the pay-out core pressing block 339 arranged inside the lid 328 abuts against the end face of the pay-out core 338 installed on the pay-out spindle 314, and presses the pay-out core 338 in the axial direction thereof. Thus, the pay-out core 338 is disposed between the pay-out core pressing block 339 and the flange 314A of the pay-out spindle 314, and thereby receives friction. Due to friction being applied to the pay-out core 338 in this way, the wiping web 310 can be caused to stably travel without slackness, even if there is a sudden change in the tension.

Furthermore, when the lid 328 is closed, the guide plate 343 arranged on the inside of the lid 328 is disposed on the front end of the take-up spindle 316. Thus, it is possible to take the wiping web 310 up onto the take-up core 342 while aligning the side end of the wiping web 310.

<<Setting in Wiping Device Main Body Frame>>

Thereupon, the wiping unit 300 in which the wiping web 310 has been installed is set in the wiping device main body frame 302.

The wiping unit 300 is set in the wiping device main body frame 302 by vertically inserting the wiping unit 300 into the wiping unit installation section 304 formed in the wiping device main body frame 302.

When the wiping unit 300 has been set in the wiping unit installation section 304, as shown in FIG. 39B, the rotation transmission gear 388 of the wiping unit 300 meshes with the drive gear 392 arranged in the wiping unit installation section 304. Thereby, the take-up spindle 316 and the grid roller 324 become drivable.

Furthermore, when the wiping unit 300 is set in the wiping unit installation section 304, the elevator lever 378 arranged on the elevator stage 370 engages with the pin 382 arranged on the wiping unit installation section 304, and the elevator stage 370 is forcibly raised up to the prescribed position. Thereby, the first front-stage guide 360, the pressing roller 318 and the first rear-stage guide 364 are registered in the prescribed use position. By registering the first front-stage guide 360, the pressing roller 318 and the first rear-stage guide 364 in the prescribed use position, the wiping web 310 becomes wrapped about the second front-stage guide 362, which is disposed between the first front-stage guide 360 and the pressing roller 318, and furthermore the wiping web 310 also becomes wrapped about the second rear-stage guide 366, which is disposed between the pressing roller 318 and the first rear-stage guide 364. Thus, the wiping web 310 is tautly wrapped about the circumferential surface of the pressing roller 318.

Moreover, when the wiping unit 300 is set in the wiping unit installation section 304, as shown in FIGS. 40 and 41, the nip roller 400 arranged on the wiping unit installation section 304 is pressed against the grid roller 324. Thereby, the wiping web 310 wrapped around the grid roller 324 is nipped between the nip roller 400 and the grid roller 324.

By means of the foregoing, the setting of the wiping unit 300 in the wiping device main body frame 302 is completed.

In the thus set wiping unit 300 in the wiping device main body frame 302, by driving the motor 394, the wiping web 310 is paid out from the pay-out spindle 314 and taken up onto the take-up spindle 316 after passing along the prescribed path of travel.

Furthermore, as shown in FIG. 29, the pressing rollers 318 of the wiping units 300C, 300M, 300Y and 300K, which correspond respectively to the nozzle surfaces 33C, 33M, 33Y and 33K of the inkjet heads 32C, 32M, 32Y and 32K disposed with their nozzle surfaces 33C, 33M, 33Y and 33K at the inclinations with respect to the horizontal plane, are disposed in parallel with the nozzle surfaces 33C, 33M, 33Y and 33K, respectively. Thus, it is possible to cause the wiping webs 310 wrapped about the respective pressing rollers 318 to make tight contact with the corresponding nozzle surfaces 33C, 33M, 33Y and 33K.

<<Wiping Operation>>

As described above, the wiping device wipes and cleans the nozzle surfaces 33 of the inkjet heads 32 while the inkjet heads 32 move from the maintenance position to the image recording position. More specifically, the nozzle surfaces 33 are wiped as follows.

The whole of the wiping device is arranged raisably and lowerably. The wiping device is disposed in the prescribed standby position, when not performing cleaning, and is raised by the prescribed amount from the standby position and moved to the prescribed operating position when performing cleaning.

When the wiping device is moved to the operating position, the nozzle surfaces 33 of the inkjet heads 32 can be wiped by the wiping units 300. More specifically, when the inkjet heads 32 pass the respective wiping units 300, it is possible for the wiping webs 310 wound about the pressing rollers 318 to be pressed against the nozzle surfaces 33.

When the inkjet heads 32 in which the cleaning liquid has been deposited on the nozzle surfaces 33 by the cleaning liquid deposition device are moved past the wiping units 300, the wiping webs 310 wrapped around the pressing rollers 318 are respectively pressed against the nozzle surfaces 33. Thereby, the nozzle surfaces 33 are wiped.

The controller drives the motors 394 and causes the wiping webs 310 to travel, in accordance with the timing at which the inkjet heads 32 arrive at the wiping units 300. Thereby, the traveling wiping webs 310 are pressed against the nozzle surfaces 33, and the nozzle surfaces 33 are thereby wiped.

During this, the wiping webs 310 wipe the nozzle surfaces 33 while traveling in the direction opposite to the direction of movement of the nozzle surfaces 33. Thus, the nozzle surfaces 33 can be wiped efficiently. Furthermore, it is also possible to perform wiping of the nozzle surfaces 33 by using new surfaces of the wiping webs 310 at all times.

The wiping webs 310 each travel in the following manner.

When the motor 394 is driven, the rotation of the motor is transmitted to the take-up spindle drive gear 358 and the grid roller drive gear 386 through the drive gear 392 and the rotation transmission gear 388. Thereby, the take-up spindle 316 and the grid roller 324 rotate.

When the grid roller 324 rotates, the conveyance action is applied to the wiping web 310, and the wiping web 310 is paid out from the pay-out core 338. The wiping web 310 is then conveyed toward the take-up core 342.

In so doing, as described above, friction is applied to the pay-out core 338, and therefore it is possible to pay-out the wiping web 310 without the occurrence of slackness, even if there is a sudden change in tension in the wiping web 310.

Furthermore, due to the rotation of the take-up spindle drive gear 358, the take-up core 342 rotates and accordingly the wiping web 310 is taken up.

In so doing, in the wiping device according to the present embodiment, the velocity at which the wiping web 310 is wound up by the take-up core 342 is set to be faster than the velocity at which the wiping web 310 is conveyed by the grid roller 324. Thus, it is possible to take up the wiping web 310 in a stable fashion, without any slackness.

On the other hand, if the take-up velocity of the wiping web 310 is made faster than the conveyance speed in this way, then when the winding diameter in the winding core 342 is raised, a load is applied to the take-up spindle 316, but because the torque limiter 316C is arranged on the take-up spindle 316 in the wiping device according to the present embodiment, then it is possible to wind up the wiping web 310 without applying undue load, and the wiping web 310 can be made to travel stably.

In the manner described above, the wiping web 310 can be made to travel by driving the motor 394. By pressing the traveling wiping web 310 against the nozzle surface 33 in this way, the nozzle surface 33 is wiped by the wiping web 310.

The soiled state of a portion of the wiping web 310 that has been used in the wiping operation is observed through the line scanner 500 before the portion of the wiping web 310 is taken up onto the take-up core 342. The successfulness of the cleaning and the appropriateness of the settings of the wiping operation are judged on the basis of the observed soiled state of the wiping web 310.

In the wiping device according to the present embodiment, the presence of a kink in the wiping web 310, and the appropriateness of the pressing force of the wiping web 310 are judged on the basis of the observed results, for example. Then, if a kink has occurred, then reinstallation of the wiping web 310 is carried out, and if the pressing force of the wiping web 310 has been inappropriate, then adjustment of the wiping position is carried out.

The portion of the wiping web 310 of which the state of soiling has been observed through the line scanner 500 is then nipped between the grid roller 324 and the nip roller 400, and the absorbed liquid (cleaning liquid, ink, etc.) is removed from the wiping web 310. The wiping web 310 is then taken up onto the take-up core 342.

The waste liquid removed from the wiping web 310 drops down under its own weight and is recovered in the waste liquid receptacle 402. The waste liquid recovered in the waste liquid receptacle 402 is recovered to the waste liquid tank from the waste liquid port 406 through the pipe (not shown).

Thus, in the wiping device according to the present embodiment, the soiled state of the wiping web 310 having been used in the wiping operation can be observed, and it is possible to judge the successfulness of the cleaning and the appropriateness of the settings of the wiping operation on the basis of the observed results.

In the present embodiment, the presence of any kink and the appropriateness of the pressing force are judged on the basis of the observed results; and it is also possible to judge other matters. Furthermore, it is also possible to adopt a composition whereby the inclination, position, height, and the like, of the wiping units can be precisely adjusted, and to enable adjustments on the basis of the observed results.

Figure 42:
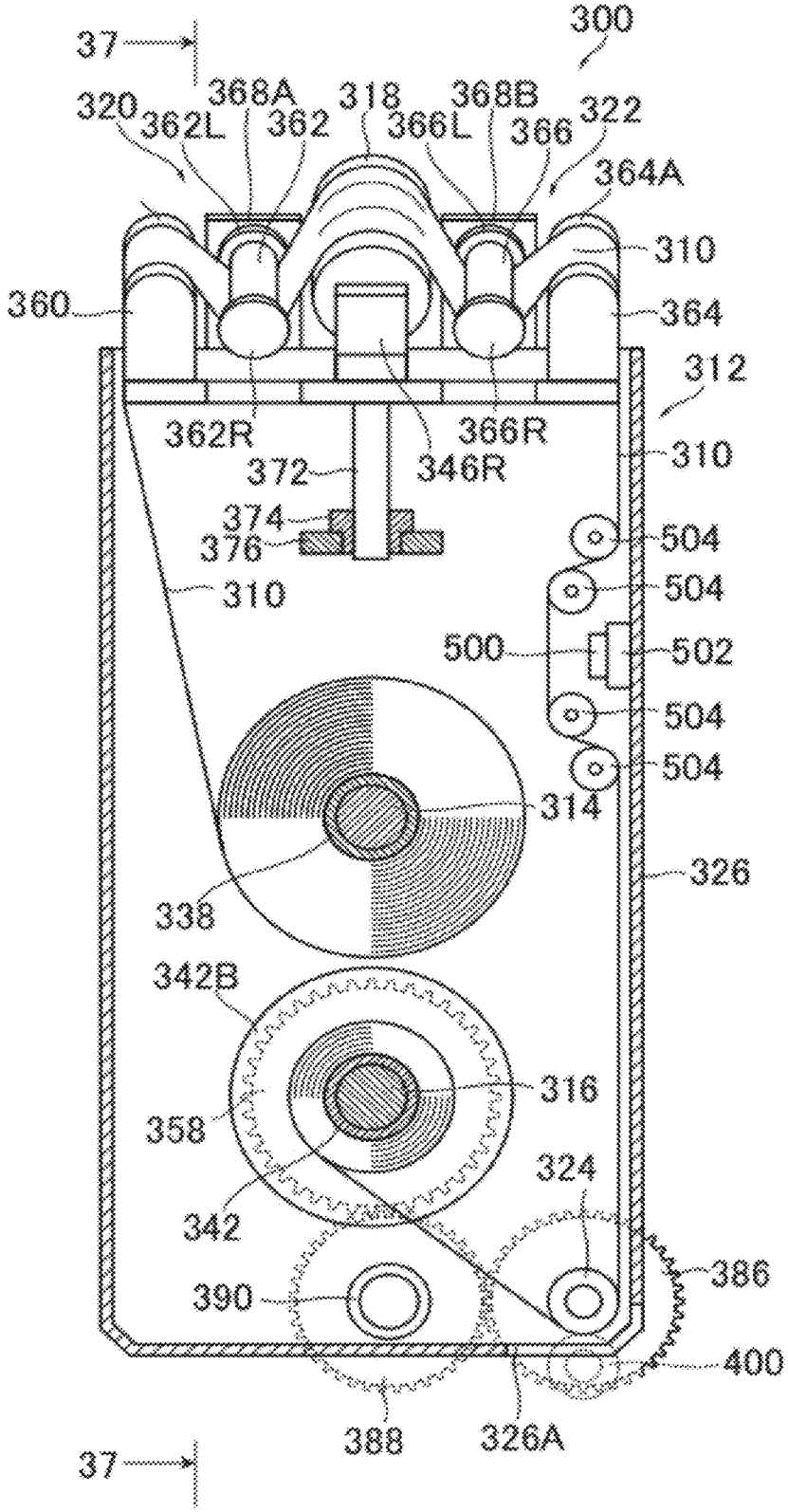
FIG. 42 is a partial cross-sectional front view diagram showing a further mode of the wiping unit.

In the wiping device according to the present embodiment, the state of the wiping web 310 having been used in the wiping operation is observed from the rear surface side of the wiping web 310; however, in a case where the state of absorption of soiling can be different on the front surface and the rear surface of the wiping web 310, for example, a composition as shown in FIG. 42 can also be adopted, in which a plurality of guide rollers 504 are arranged inside the casing main body 326 of the wiping unit 300 so as to change the traveling path of the wiping web 310, and the front surface of the wiping web 310 is observed through the line scanner 500. Thereby, it is possible accurately to observe the soiled state of the wiping web 310 having been used in the wiping operation.

Moreover, although the composition is adopted in which the line scanner is incorporated in the wiping unit in the above-described embodiments, the line scanner which observes the wiping web having been used in the wiping operation can be arranged separately from the wiping unit.

However, it is preferable to incorporate the line scanner in the wiping unit as in the above-described embodiments, since positional adjustment of the line scanner, and the like, is not required, the line scanner can be readily installed, and the state of the wiping web having been used in the wiping operation can be observed accurately.

It is also preferable to accommodate the wiping unit in the casing and to arrange the line scanner inside the casing as in the above-described embodiments, since it is possible to carry out the observation without being affected by external light, and the state of the wiping web having been used in the wiping operation can be observed more accurately.

Further, although the state of the wiping web having been used in the wiping operation is observed through the line scanner in the above-described embodiments, the device that observes the state of the wiping web having been used in the wiping operation is not limited to this, and it is also possible to adopt a composition which observes the web with another observing device. Moreover, it is also possible to adopt a composition which directly observes the density of the wiping web having been used in the wiping operation.

Furthermore, in the above-described embodiments, the cleaning liquid is sprayed from the cleaning liquid deposition nozzles toward the nozzle surfaces 33 to deposit the cleaning liquid on the nozzle surfaces 33 to wet the nozzle surfaces 33; however, the method of wetting the nozzle surfaces 33 is not limited to this. Apart from this, for example, it is also possible to use a method in which the nozzle surface 33 of the inkjet head 32 is wetted by immersing the nozzle surface 33 in the cleaning liquid in the maintenance unit, a method in which the nozzle surface 33 is wetted by bringing the nozzle surface 33 into contact with the cleaning liquid that is flowing over a prescribed surface, a method in which the nozzle surface 33 is wetted by causing the ink to seep out from the nozzles, and the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A nozzle surface cleaning apparatus which cleans a nozzle surface of an inkjet head, the apparatus comprising:

a wiping device which performs a wiping operation on the nozzle surface with a wiping member having permeability;

a wetting device which wets the nozzle surface before the wiping operation;

an observation device which observes a soiled state of the wiping member having been used in the wiping operation;

a judgment device which makes a judgment on appropriateness of a setting of the wiping operation on a basis of the soiled state observed by the observation device; and a setting correction device which corrects the setting of the wiping operation in accordance with the judgment made by the judgment device, wherein:

the wiping member includes a web;

the wiping device includes a web drive device which causes the web to travel in a web travelling direction along a web travelling path, and a pressing roller about which the web is wrapped;

the wiping device performs the wiping operation by pressing the travelling web against the nozzle surface by means of the pressing roller while the wiping device moves relatively along the nozzle surface;

the observation device observes, as the soiled state, a soiled density distribution on the web in a direction perpendicular to the web travelling direction; and the judgment device makes a judgment on appropriateness of a pressing position of the web against the nozzle surface on a basis of the soiled density distribution observed by the observation device.

2. The nozzle surface cleaning apparatus as defined in claim 1, wherein the setting correction device corrects the pressing position in accordance with the judgment made by the judgment device.

3. The nozzle surface cleaning apparatus as defined in claim 1, wherein:

the judgment device further makes at least one of: a judgment on appropriateness of parallelism of the web with respect to the nozzle surface; a judgment on appropriateness of a pressing force of the web against the nozzle surface; a judgment on appropriateness of a nozzle meniscus position in the inkjet head; a judgment on presence of a kink in the web; and a judgment on appropriateness of a wetting amount of the nozzle surface, on a basis of the soiled density distribution observed by the observation device.

4. The nozzle surface cleaning apparatus as defined in claim 1, wherein:

the observation device further observes, as the soiled state, a soiled region length on the web in the web travelling direction;

the judgment device further makes at least one of: a judgment on appropriateness of parallelism of the web with respect to the nozzle surface; a judgment on appropriateness of a pressing force of the web against the nozzle surface; a judgment on appropriateness of a nozzle meniscus position in the inkjet head; a judgment on presence of a kink in the web; and a judgment on appropriateness of a wetting amount of the nozzle surface, on a basis of the soiled density distribution observed by the observation device; and the judgment device further makes a judgment on appropriateness of at least one of a travelling speed of the web and a relative movement speed of the wiping device with respect to the nozzle surface on a basis of the soiled region length observed by the observation device.

5. The nozzle surface cleaning apparatus as defined in claim 1, wherein the setting correction device corrects the setting of the wiping operation during the wiping operation.

6. The nozzle surface cleaning apparatus as defined in claim 1, wherein:

the judgment device has a plurality of judgment standards for the judgment; and the judgment device makes the judgment while switching the judgment standards in accordance with at least one of: a number of sheets which have been printed with the inkjet head; and a duration in which the inkjet head has been used.

7. The nozzle surface cleaning apparatus as defined in claim 1, wherein:

the judgment device further makes a judgment on appropriateness of parallelism of the web with respect to the nozzle surface on a basis of the soiled density distribution observed by the observation device.

8. The nozzle surface cleaning apparatus as defined in claim 7, wherein the setting correction device corrects inclination of the pressing roller with respect to the nozzle surface in accordance with the judgment made by the judgment device.

9. The nozzle surface cleaning apparatus as defined in claim 1, wherein:

the judgment device further makes a judgment on appropriateness of a pressing force of the web against the nozzle surface on a basis of the soiled density distribution observed by the observation device.

10. The nozzle surface cleaning apparatus as defined in claim 9, wherein the setting correction device corrects the pressing force of the web against the nozzle surface applied by the pressing roller in accordance with the judgment made by the judgment device.

11. The nozzle surface cleaning apparatus as defined in claim 1, wherein:

the judgment device further makes a judgment on appropriateness of a nozzle meniscus position in the inkjet head on a basis of the soiled density distribution observed by the observation device.

12. The nozzle surface cleaning apparatus as defined in claim 11, wherein the setting correction device corrects the nozzle meniscus position in accordance with the judgment made by the judgment device.

13. The nozzle surface cleaning apparatus as defined in claim 1, wherein:

the judgment device further makes a judgment on presence of a kink in the web on a basis of the soiled density distribution observed by the observation device.

14. The nozzle surface cleaning apparatus as defined in claim 13, wherein the setting correction device corrects at least one of the kink in the web and a tension of the web in accordance with the judgment made by the judgment device.

15. The nozzle surface cleaning apparatus as defined in claim 1, wherein:

the judgment device further makes a judgment on appropriateness of a wetting amount of the nozzle surface on a basis of the soiled density distribution observed by the observation device.

16. The nozzle surface cleaning apparatus as defined in claim 15, wherein the setting correction device corrects the wetting amount of the nozzle surface in accordance with the judgment made by the judgment device.

17. The nozzle surface cleaning apparatus as defined in claim 1, wherein:

the observation device further observes, as the soiled state, a soiled region length on the web in the web travelling direction; and the judgment device further makes a judgment on appropriateness of at least one of a travelling speed of the web and a relative movement speed of the wiping device with respect to the nozzle surface on a basis of the soiled region length observed by the observation device.

18. The nozzle surface cleaning apparatus as defined in claim 17, wherein the setting correction device corrects the at least one of the travelling speed of the web and the relative movement speed of the wiping device in accordance with the judgment made by the judgment device.

19. The nozzle surface cleaning apparatus as defined in claim 1, wherein:

the inkjet head is constituted of a plurality of head modules joined together;

the observation device observes the soiled state of the wiping member for each of the head modules; and the judgment device makes the judgment on the appropriateness of the setting of the wiping operation for each of the head modules on the basis of the soiled state observed for each of the head modules by the observation device.

20. The nozzle surface cleaning apparatus as defined in claim 19, wherein the setting correction device corrects the setting of the wiping operation for each of the head modules in accordance with the judgment made for each of the head modules by the judgment device.

21. The nozzle surface cleaning apparatus as defined in claim 1, wherein the observation device includes:

an imaging device which captures an image of the wiping member having been used in the wiping operation; and an analyzation device which analyzes the image captured by the imaging device to determine the soiled state of the wiping member.

22. The nozzle surface cleaning apparatus as defined in claim 21, wherein:

the imaging device includes a line scanner which is arranged in a direction perpendicular to the web travelling direction.

23. The nozzle surface cleaning apparatus as defined in claim 22, wherein the line scanner is integrally attached to the wiping device.

24. An inkjet recording apparatus, comprising:

a conveyance device which conveys a medium;

the nozzle surface cleaning apparatus as defined in claim 1; and the inkjet head which records an image by ejecting and depositing ink droplets onto the medium conveyed by the conveyance device.

25. An inkjet recording apparatus, comprising:

a conveyance device which conveys a medium along a medium conveyance path; and a plurality of head units each of which includes: the nozzle surface cleaning apparatus as defined in claim 1; and the inkjet head which is arranged along the medium conveyance path and records an image by ejecting and depositing ink droplets onto the medium conveyed by the conveyance device, wherein in each of the head units, the judgment device in the nozzle surface cleaning apparatus has a judgment standard for the judgment specifically for the corresponding inkjet head.

26. The inkjet recording apparatus as defined in claim 25, wherein:

the conveyance device includes a drum, the medium being held on a circumferential surface of the drum and being conveyed by rotation of the drum; and the inkjet head in each of the head units is arranged around the drum in such a manner that the nozzle surface faces the circumferential surface of the drum.

27. A method of cleaning a nozzle surface of an inkjet head, comprising the steps of:

wetting the nozzle surface;

after the wetting step, performing a wiping operation on the nozzle surface with a wiping member having permeability;

observing a soiled state of the wiping member having been used in the wiping operation;

making a judgment on appropriateness of a setting of the wiping operation on a basis of the soiled state observed in the observing step; and correcting the setting of the wiping operation in accordance with the judgment made in the step of making the judgment, wherein:

the wiping member includes a web;

the step of performing the wiping operation includes: the step of driving the web by causing the web wrapped about a pressing roller to travel in a web travelling direction along a web travelling path; and the step of pressing the travelling web against the nozzle surface by means of the pressing roller while the wiping device moves relatively along the nozzle surface;

the observing step includes the step of observing, as the soiled state, a soiled density distribution on the web in a direction perpendicular to the web travelling direction; and the step of making the judgment includes the step of making a judgment on appropriateness of a pressing position of the web against the nozzle surface on a basis of the soiled density distribution observed in the observing step.

28. The method as defined in claim 27, wherein the step of correcting the setting of the wiping operation includes the step of correcting the pressing position in accordance with the judgment.

* * * * *